US011358038B2

(12) United States Patent
Stites et al.

(10) Patent No.: US 11,358,038 B2
(45) Date of Patent: Jun. 14, 2022

(54) GOLF CLUBS AND GOLF CLUB HEADS HAVING A CONFIGURED SHAPE

(71) Applicant: Karsten Manufacturing Corporation, Phoenix, AZ (US)

(72) Inventors: John T. Stites, Beaverton, OR (US); Gary G. Tavares, Beaverton, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/930,637

(22) Filed: Jul. 16, 2020

(65) Prior Publication Data

US 2020/0346083 A1 Nov. 5, 2020

Related U.S. Application Data

(63) Continuation of application No. 16/421,337, filed on May 23, 2019, now Pat. No. 10,751,588, which is a continuation of application No. 15/948,930, filed on Apr. 9, 2018, now Pat. No. 10,335,654, which is a continuation of application No. 14/591,692, filed on Jan. 7, 2015, now Pat. No. 9,937,396, which is a continuation of application No. 13/555,465, filed on (Continued)

(51) Int. Cl.
*A63B 53/04* (2015.01)

(52) U.S. Cl.
CPC ..... *A63B 53/0475* (2013.01); *A63B 53/047* (2013.01); *A63B 53/0466* (2013.01); *A63B 53/0408* (2020.08); *A63B 53/0433* (2020.08)

(58) Field of Classification Search
CPC ..... A63B 53/0475; A63B 53/0466; A63B 53/047; A63B 53/0408; A63B 53/0433
USPC ..... 473/324–350
See application file for complete search history.

(56) References Cited

U.S. PATENT DOCUMENTS 1,538,312 A 5/1925 Neish
1,669,482 A 5/1928 Miller
(Continued)

FOREIGN PATENT DOCUMENTS

EP 0537358 4/1993
EP 0784999 7/1997
(Continued)

OTHER PUBLICATIONS

Feb. 28, 2012—(WO) International Preliminary Report—App. PCT/US2010/045971.

(Continued)

*Primary Examiner* — Sebastiano Passaniti

(57) ABSTRACT

Aspects of this disclosure relate to a golf club head which includes a wood type golf club head body including a ball striking face portion at a front side thereof, a rear side opposite the front side, a crown portion, and a sole portion. Further, the sole or crown or rear portion of the golf club head body may be configured so that the golf club head body includes a bump portion which protrudes from the sole or crown or rear portion and an indented portion which recedes into the sole or crown or rear portion and creates a recess in the sole or crown or rear portion of the golf club head body. Further, the bump portion and the indented portion may be configured so that a center of gravity of the club head body is nearer to one of the heel edge of the club head body and the toe edge of the club head body.

13 Claims, 34 Drawing Sheets

Related U.S. Application Data

Jul. 23, 2012, now Pat. No. 8,961,337, which is a continuation of application No. 12/547,230, filed on Aug. 25, 2009, now Pat. No. 8,226,501.

(56) References Cited

U.S. PATENT DOCUMENTS 1,913,821 A 6/1933 Stumpf
D165,458 S * 12/1951 Jacobs ..... D21/748
3,068,011 A 12/1962 Naojiro
3,693,978 A 9/1972 East
3,761,095 A 9/1973 Thompson
3,955,820 A * 5/1976 Cochran ..... A63B 60/00 473/337
3,997,170 A 12/1976 Goldberg
D247,922 S 5/1978 Sheldon
4,332,388 A 6/1982 Crow
D285,231 S 8/1986 Solomon
4,715,601 A * 12/1987 Lamanna ..... A63B 60/00 473/291
4,869,507 A 9/1989 Sahm
4,915,386 A * 4/1990 Antonious ..... A63B 53/047 473/350
5,082,278 A 1/1992 Hsien
5,154,425 A * 10/1992 Niskanen ..... A63B 53/0466 473/342
5,242,167 A * 9/1993 Antonious ..... A63B 60/00 473/350
5,257,786 A * 11/1993 Gorman ..... A63B 53/0466 473/349
5,280,923 A 1/1994 Lu
5,286,027 A 2/1994 Koumarianos
5,333,872 A * 8/1994 Manning ..... A63B 53/04 473/291
D362,039 S 9/1995 Lin
5,480,152 A 1/1996 Schmidt et al.
5,497,995 A 3/1996 Swisshelm
5,511,786 A 4/1996 Antonious
D372,063 S 7/1996 Hueber
5,540,436 A * 7/1996 Boone ..... A63B 60/00 473/350
5,544,884 A 8/1996 Hardman
5,573,469 A 11/1996 Dekura
5,643,107 A 7/1997 Gorman
5,735,754 A 4/1998 Antonious
5,749,793 A 5/1998 Lucetti
5,851,160 A 12/1998 Rugge et al.
D404,453 S * 1/1999 Wozny ..... D21/749
5,935,020 A 8/1999 Stites et al.
6,007,433 A 12/1999 Helmstetter et al.
6,056,649 A 5/2000 Imai
6,123,627 A * 9/2000 Antonious ..... A63B 53/04 473/327
D435,278 S * 12/2000 Reed ..... D21/747
D445,863 S 7/2001 Galloway et al.
6,440,009 B1 8/2002 Guibaud et al.
6,551,200 B1 * 4/2003 Golden ..... A63B 53/04 473/349
D478,950 S 8/2003 Herber
D479,867 S 9/2003 Saliba et al.
D482,421 S 11/2003 Kessler
6,780,121 B2 8/2004 Herber
D502,232 S 2/2005 Antonious
6,942,581 B2 9/2005 Kim et al.
6,960,141 B2 11/2005 Noguchi et al.
D515,643 S 2/2006 Ortiz
D523,498 S 6/2006 Chen et al.
D526,693 S 8/2006 Murray
7,121,956 B2 10/2006 Lo
7,137,905 B2 11/2006 Kohno
7,147,575 B2 12/2006 Galloway et al.
7,207,900 B2 * 4/2007 Nicolette ..... A63B 60/02 473/334
7,235,023 B2 * 6/2007 Sugimoto ..... A63B 53/047 473/291
D554,219 S 10/2007 Vrska et al.
7,294,064 B2 11/2007 Tsurumaki et al.
D567,888 S 4/2008 Soracco
7,452,285 B2 11/2008 Chao et al.
7,588,502 B2 9/2009 Nishino
7,611,424 B2 * 11/2009 Nagai ..... A63B 53/0466 473/334
7,674,189 B2 3/2010 Beach et al.
7,704,155 B2 4/2010 Bennett et al.
7,753,806 B2 7/2010 Beach et al.
7,938,739 B2 * 5/2011 Cole ..... A63B 53/047 473/332
7,955,190 B2 6/2011 Werner et al.
7,963,860 B2 * 6/2011 Tavares ..... A63B 53/047 473/332
8,216,088 B2 * 7/2012 Hatton ..... A63B 53/04 473/335
8,556,742 B2 10/2013 John
8,771,097 B2 7/2014 Bennett et al.
9,061,186 B2 * 6/2015 Larson ..... A63B 53/04
9,474,947 B2 10/2016 Willett
9,914,025 B2 3/2018 Larson et al.
10,022,598 B2 7/2018 Willet et al.
10,293,219 B2 5/2019 Hayashi
10,420,987 B2 9/2019 Kimizuka et al.
10,463,929 B2 11/2019 Willett
10,561,908 B2 2/2020 Mizutani
2002/0077195 A1 6/2002 Carr et al.
2002/0094882 A1 7/2002 Nagai et al.
2003/0236131 A1 12/2003 Burrows
2004/0116200 A1 6/2004 Helmstetter et al.
2005/0049073 A1 3/2005 Herber
2006/0058112 A1 3/2006 Haralason et al.
2006/0094526 A1 5/2006 Reed
2006/0293114 A1 * 12/2006 Chen ..... A63B 53/04 473/290
2008/0051210 A1 2/2008 Park et al.
2009/0124410 A1 5/2009 Rife
2013/0109495 A1 5/2013 Snyder

FOREIGN PATENT DOCUMENTS

GB 941366 A * 11/1963 ..... A63B 53/04
GB 2324045 10/1998
JP S5387829 8/1978
JP 08141118 6/1996
WO 2007149552 12/2007

OTHER PUBLICATIONS

Feb. 28, 2012—(WO) International Preliminary Report—App. PCT/US2010/046067.
Jan. 11, 2011—(WO) International Search Report and Written Opinion—App. PCT/US2010/046067.
Jan. 11, 2011—(WO) International Search Report and Written Opinion—App. PCT/US2010/045971.
Jan. 11, 2011—(WO) International Search Report—App. PCT/US2010/046067.

* cited by examiner

GOLF CLUBS AND GOLF CLUB HEADS HAVING A CONFIGURED SHAPE

CROSS-REFERENCE TO RELATED APPLICATION

This is a continuation of U.S. patent application Ser. No. 16/421,337, filed on May 23, 2019, which is a U.S. patent application Ser. No. 15/948,930 filed on Apr. 9, 2018, now U.S. Pat. No. 10,335,654, which is a continuation of U.S. patent application Ser. No. 14/591,692 filed Jan. 7, 2015, now U.S. Pat. No. 9,937,396, which is a continuation of U.S. patent application Ser. No. 13/555,465 filed Jul. 23, 2012, now U.S. Pat. No. 8,961,337 issued Feb. 24, 2015, which is a continuation of U.S. patent application Ser. No. 12/547,230 filed Aug. 25, 2009, now U.S. Pat. No. 8,226,501 issued Jul. 24, 2012, all of which are incorporated by reference herein in their entirety and made part hereof.

FIELD OF THE INVENTION

The present disclosure relates to golf clubs and golf club heads. Particular example aspects of this disclosure relate to golf clubs and golf club heads having a configured shape.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, some players continue to experience difficulties in reliably hitting a golf ball in an intended and desired direction and/or with an intended and desired flight path. Accordingly, there is room in the art for further advances in golf club technology.

SUMMARY OF THE INVENTION

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

In this specification, various features and aspects of the invention are defined based on geometry and locations with respect to a golf club head. As used in this specification and as illustrated with respect to FIG. 1A, the location of the "geometric center" 101 of a wood type golf club head 102 is determined in the following manner, which is consistent with the manner in which various club head dimensions are determined in Appendix II of *The* 2008-2009 *Rules of Golf*, as promulgated by the United States Golf Association ("U.S.G.A."), which rules are entirely incorporated herein by reference. First, with the golf club head 102 oriented at its designed lie angle (the lie angle of its specifications, e.g., 60°), the outermost points P of the heel, toe, face, and rear of the club head 102 are determined. If the outermost point of the heel is not clearly defined (e.g., due to the club head's hosel, etc.), then the outermost point of the heel is deemed to be the location on the heel at 0.875 inches (22.23 mm) above the horizontal plane on which the club head is lying, in the same manner as the heel location is determined under *The Rules of Golf* mentioned above. Vertical projections along the outermost points P of the front, toe, rear, and heel (shown as "tangents" in the overhead view of FIG. 1A) enclose the club head 102 within a rectangle or square structure, as shown in FIG. 1A (all angles being right angles). Then, a first diagonal line is drawn from the front heel corner to the rear toe corner of the rectangle or square structure (labeled "Front Heel to Rear Toe Diagonal" in FIG. 1A), and a second diagonal line is drawn from the front toe corner to the rear heel corner of the rectangle or square structure (labeled "Front Toe to Rear Heel Diagonal" in FIG. 1A). The intersection of these two diagonals D is deemed to be the "geometric center" 101 of the club head 102 as that term is used in this specification.

If necessary to provide a frame of reference, the front vertical projection or tangent line will be oriented square to the club head target line or direction at the outermost point P of the face surface, and then the heel and toe projections or tangents may be provided (at their outermost points) perpendicular to the front projection or tangent, and the rear projection or tangent may be provided (at its outermost point) parallel to the front projection or tangent. An XY "coordinate axis" may be defined for the club head 102 by drawing a first coordinate axis (the Y-axis) in the front-to-rear direction perpendicular to the front and rear tangents through the geometric center 101 of the club head 102 and by drawing a second coordinate axis (the X-axis) in the heel-to-toe direction perpendicular to the first coordinate axis (and perpendicular to the heel and toe tangents) through the geometric center 101 of the club head 102.

As shown in FIG. 1B, the "heel side" of the club head, as used in this specification, is defined as everything toward the heel 118 from the front-to-back Y coordinate axis. The "toe side" of the club head, as used in this specification, is defined as everything toward the toe 116 from the front-to-back Y coordinate axis. The "front side" of the club head, as used in this specification, is defined as everything forward of the heel-to-toe X coordinate axis. The "rear side" of the club head, as used in this specification, is defined as everything rearward of the heel-to-toe X coordinate axis.

As shown in FIG. 1C, the "rear heel side" of the club head, as used in this specification, is everything toward the rear side and heel side from the front heel to rear toe diagonal. The "rear toe side" of the club head, as used in this specification, is everything toward the rear side and toe side from the front toe to rear heel diagonal. The "front heel side" of the club head, as used in this specification, is everything toward the front side and heel side from the front toe to rear heel diagonal. The "front toe side" of the club head, as used in this specification, is everything toward the front side and toe side from the front heel to rear toe diagonal. The "heel edge" of the club head body is the edge surface along the heel side between the front heel to rear toe diagonal and the front toe to rear heel diagonal. The "toe edge" of the club head body is the edge surface along the toe side between the front heel to rear toe diagonal and the front toe to rear heel diagonal. The "rear edge" of the club head body is the edge surface along the rear side between the front heel to rear toe diagonal and the front toe to rear heel diagonal. The "front edge" of the club head body is the edge surface along the front side between the front heel to rear toe diagonal and the front toe to rear heel diagonal. Something located "proximate to" one of these edges, as used in this specification in this context, unless otherwise noted, means within 0.75 inches of the relevant edge.

As shown in FIG. 1D, the "rear heel quadrant," "rear toe quadrant," "front toe quadrant," and "front heel quadrant" are defined using the geometric center 101 and the XY coordinate axes as described above.

While illustrated in FIGS. 1A through 1D on a relatively square shaped wood-type club head, these same definitions apply to more traditionally shaped wood-type golf club heads.

The "crown portion" of a golf club head is defined as that portion of the golf club head top surface that is visible looking directly downward on the club head when the golf club head 102 oriented at its designed lie angle (the lie angle of its specifications, e.g., 60°). The "sole portion" of a golf club head is defined as that portion of the golf club head bottom surface that is visible looking directly upward on the club head when the golf club head 102 oriented at its designed lie angle (the lie angle of its specifications, e.g., 60°). The topmost point of the club head crown portion and the bottommost point of the club head sole portion can be found by locating horizontal projections along the crown portion and the sole portion, respectively, with the club oriented as described above.

Aspects of this invention relate to golf club heads comprising a wood type golf club head body including a ball striking face portion on a front side of the club head body, a rear side opposite the front side, a toe side, and a heel side. Further, at least 51% of the mass of the club head body is positioned in the heel side of the golf club head body from the club head's geometric center in the front-to-rear direction.

Other aspects of this invention relate to golf club heads comprising a wood type golf club head body including a ball striking face portion on a front side of the club head body, a rear side opposite the front side, a toe side, and a heel side. Further, at least 51% of the mass of the club head body is positioned in a rear heel side of the golf club head body with respect to a diagonal running through the club head's geometric center in the front heel-to-rear toe direction.

Other aspects of this invention relate to golf club heads comprising a wood type golf club head body including a ball striking face portion at a front side of the golf club head body, a rear side opposite the front side, a toe side, and a heel side. Further, at least 26% of the mass of the club head body is positioned in a rear heel quadrant of the golf club head body with respect to a central X,Y coordinate system located at the club head's geometric center, wherein the Y axis extends in the front-to-rear direction and the X axis is perpendicular to the Y axis and extends in the heel-to-toe direction.

Other aspects of this disclosure relate to golf club heads that include a wood type golf club head body that has a ball striking face portion, a crown or top portion, and a sole or bottom portion. Further, the golf club head body includes a maximum breadth that extends from a forwardmost point of the ball striking face portion to a rearwardmost point of the club head body and a maximum depth that extends from a topmost point of the crown or top portion to the bottommost point of the sole or bottom portion. Additionally, the golf club head body includes a first portion that extends from the crown or top portion to the sole or bottom portion and includes a first depth of the golf club head body and a second portion that extends from the crown or top portion to the sole or bottom portion and includes a second depth that is less than the first depth. If desired, the first portion may include the maximum depth mentioned above. The sole or bottom region of the second portion is sunken by at least 2 mm relative to a sole or bottom region of the first portion. Further, the sole or bottom portion of the golf club head body is configured so that it includes a sloped boundary portion that separates the sole or bottom region of the first portion from the sole or bottom region of the second portion, wherein the sloped boundary portion has a depth of at least 2 mm and recedes from the sole or bottom region of the first portion to the sole or bottom region of the second portion, thereby defining a transition in depth between the first portion and the second portion of the golf club head body. Further, the sloped boundary portion extends across the sole or bottom portion from a point proximate to a heel edge of the club head body that is at least 70% of the maximum breadth of the golf club head body away from the forwardmost point of the ball striking face portion to a point proximate to a toe edge of the club head body that is at least 70% of the maximum breadth of the golf club head body away from the rearwardmost point of the rear edge. Still further, the first portion and second portion are configured so that a center of gravity of the golf club head body is positioned nearer to the heel edge than the toe edge.

Other aspects of this invention relate to golf club heads that include a wood type golf club head body including a ball striking face portion, a crown or top portion, and a sole or bottom portion. Further, the golf club head body includes a maximum breadth that extends from a forwardmost point of the ball striking face portion to a rearwardmost point of the club head body and a maximum depth that extends from a topmost point of the crown or top portion to a bottommost point of the sole or bottom portion. Additionally, the golf club head body includes a first portion that extends from the crown or top portion to the sole or bottom portion and includes a first depth of the golf club head body and a second portion that extends from the crown or top portion to the sole or bottom portion and includes a second depth that is less than the first depth. If desired, the first portion may include the maximum depth mentioned above. The sole or bottom region of the second portion is sunken by at least 2 mm relative to a sole or bottom region of the first portion. Further, the sole or bottom portion of the golf club head body is configured so that it includes a sloped boundary portion that separates the sole or bottom region of the first portion from the sole or bottom region of the second portion, wherein the sloped boundary portion has a depth of at least 2 mm and recedes from the sole or bottom region of the first portion to the sole or bottom region of the second portion, thereby defining a transition in depth between the first portion and the second portion of the golf club head body. Further, the sloped boundary portion extends across the sole or bottom portion from a point proximate to a toe edge of the club head body that is at least 70% of the maximum breadth of the golf club head body away from the forwardmost point of the ball striking face portion to a point proximate to a heel edge of the club head body that is at least 70% of the maximum breadth of the golf club head body away from the rearwardmost point of the rear edge. Still further, the first portion and second portion are configured so that a center of gravity of the golf club head body is positioned nearer to the toe edge than the heel edge.

Still other aspects of this disclosure relate to golf club heads that include a wood type golf club head body including a ball striking face portion, a crown or top portion, and a sole or bottom portion. Further, the golf club head body includes a maximum breadth that extends from a forwardmost point of the ball striking face portion to a rearwardmost point of the club head body and a maximum depth that extends from the topmost point of the crown or top portion to a bottommost point of the sole or bottom portion. Additionally, the golf club head body includes a first portion that extends from the crown or top portion to the sole or bottom portion and includes a first depth of the golf club head body and a second portion that extends from the crown or top portion to the sole or bottom portion and includes a second depth that is less than the first depth. If desired, the first portion may include the maximum depth mentioned above. The crown or top region of the second portion is sunken by at least 2 mm relative to a crown or top region of the first portion. Further, the crown or top portion of the golf club head body is configured so that it includes a sloped boundary portion that separates the crown or top region of the first portion from the crown or top region of the second portion, wherein the sloped boundary portion has a depth of at least 2 mm and recedes from the crown or top region of the first portion to the crown or top region of the second portion, thereby defining a transition in depth between the first portion and the second portion of the golf club head body. Further, the sloped boundary portion extends across the crown or top portion from a point proximate to a heel edge of the club head body that is at least 70% of the maximum breadth of the golf club head body away from the forwardmost point of the ball striking face portion to a point proximate to a toe edge of the club head body that is at least 70% of the maximum breadth of the golf club head body away from the rearwardmost point of the rear edge. Still further, the first portion and second portion are configured so that a center of gravity of the golf club head body is positioned nearer to the heel edge than the toe edge.

Additional aspects of this disclosure relate to golf club structures (wood or irons) that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; weighting members (e.g., internal or external to the club head body, permanently mounted or removable, etc.); vibration dampening members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head body at a separate hosel member or a hosel member provided as an integral part of one or more of the club head or shaft.

Methods according to examples of this disclosure may include additional steps, such as engaging a grip member with the shaft member; engaging weights with the club head body; moving or interchanging weights with respect to the club head body; etc. Other steps also may be included in these methods, such as club head body finishing steps, etc.

BRIEF DESCRIPTION OF THE DRAWINGS

The present invention is illustrated by way of example and not limited in the accompanying figures, in which like reference numerals indicate similar elements throughout, and in which.

Figure 1A:
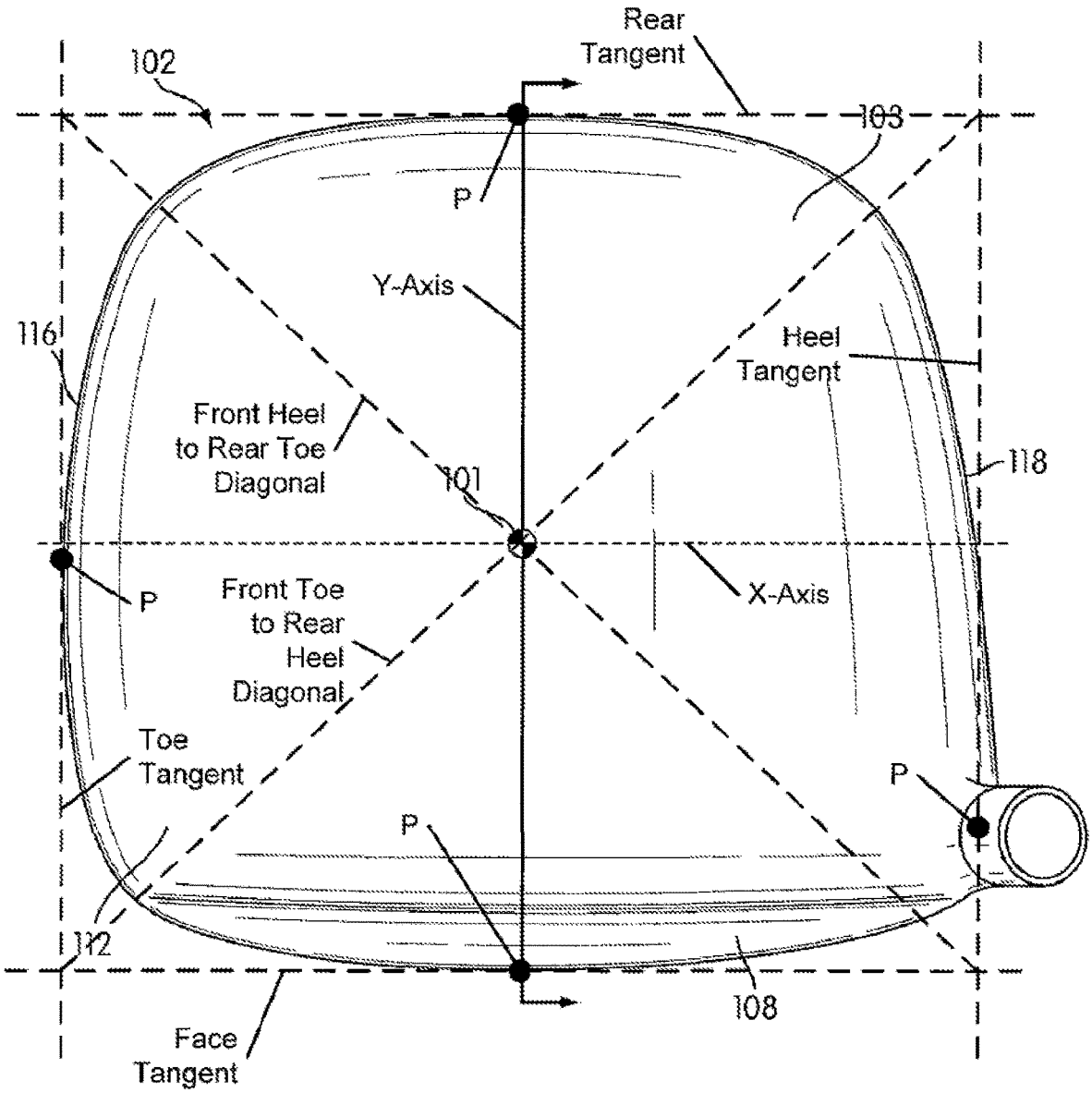
FIGS. 1A through 1D generally illustrates features of golf club head structures according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Invention As described above, some players experience difficulty in reliably hitting a golf ball in an intended and desired direction and/or with an intended and desired flight path. Therefore, aspects of this disclosure are directed to golf club heads configured with the mass and volume of the golf club head body distributed so as to aid a player in reliably hitting the ball in an intended and desired direction and/or with an intended and desired flight path. Particular aspects of the disclosure are directed to golf club head bodies wherein the mass and/or volume of the golf club head body are distributed so that they alter the location of its center of gravity as compared with a conventional golf club head body. According to some aspects of the disclosure, the distribution of the mass and/or volume of the golf club head body aids in squaring the golf club head at impact with ball and/or in imparting a particular trajectory and/or spin to a golf ball when the golf club head strikes the golf ball.

For example, according to aspects of this disclosure, the mass and/or volume of the golf club head structure are positioned so that more mass and/or volume of the golf club head structure are distributed toward the heel side of the golf club head. Such a configuration may help a golfer who has a tendency to "slice." A "slice" is an errant golf shot in which the ball curves a direction away from the side from which it was stuck. For example, for a right handed golfer, a slice will cause the golf ball to curve to the right. Positioning more of the mass and/or volume of the golf club head toward the heel side of the club head body can help slow the heel during a swing as compared with the toe of the golf club head. This will allow the golfer to better square the club head during the swing, which may result in less "slice" (i.e., a straighter trajectory). Therefore, according to some aspects of this disclosure, the mass and/or volume of the golf club head body are distributed so that at least more than half of the mass and/or volume of the club head is in a heel side of the club head (with respect to a central axis through the club head's geometric center in the front-to-rear direction).

According to another aspect of this disclosure, the mass and/or volume of the golf club head structure are positioned so that more mass and/or volume of the golf club head structure are distributed toward the rear side (and optionally toward the bottom) of the golf club head. Such a configuration may help a golfer get the ball airborne. A common problem that many golfers experience, especially those just learning to play, is not being able to reliably get the ball in the air (i.e., a lofted trajectory). Positioning more of the mass and/or volume of the golf club head in the rear and/or toward the bottom of the golf club head keeps more of the weight of the golf club head body rearward and low. This will aid the golfer in getting the ball airborne upon striking the ball with the club head (i.e., it provides a more lofted trajectory).

According to another aspect of this disclosure, the mass and/or volume of the golf club head structure are positioned so that more of the mass and/or volume of the golf club head structure are distributed toward both the rear side of the golf club head body and toward the heel side of the golf club head body. Such a configuration may both help a golfer get the ball airborne and compensate for a "slice." Therefore, according to other aspects of this disclosure, the mass and/or volume of the golf club head body are distributed so that at least more than half of the mass and/or volume of the golf club head body is in the rear heel side of the golf club head body (with respect to a diagonal running through the club head's geometric center in the front heel-to-rear toe direction). Further, according to other aspects of this disclosure, the mass and/or volume of the golf club head body are distributed so that at least more than a quarter of the mass and/or volume of the golf club head body is in the rear heel quadrant of the golf club head body (with respect to a central coordinate system located at the club head's geometric center).

According to other aspects of this disclosure, the mass and/or volume of the golf club head structure are positioned so that more mass and/or volume of the golf club head structure are distributed in other different areas of the golf club head (e.g., positioned toward the toe side to compensate for a "hooked" golf shot, positioned toward the top for a more penetrating and less lofted shot, etc.).

According to some aspects of this disclosure, the mass and/or volume of the golf club head body are distributed so that the configuration of the club head body includes a first portion that has an exaggerated depth or thickness (compared with other portions of the golf club head and/or a conventional golf club head). For example, according to at least some aspects of this disclosure, a golf club head body has an exaggerated thickness or depth at the heel side of the golf club head (as described above). According to other aspects of this disclosure, a golf club head body has an exaggerated thickness or depth at the rear heel side of the club head (as described above). According to some other aspects of this disclosure, a golf club head body has an exaggerated thickness or depth at the rear heel quadrant of the club head (as described above).

In some example structures according to this disclosure, in addition to the first portion having an exaggerated depth or thickness, the golf club head may include a second portion having a reduced depth or thickness (compared with other portions of the golf club head and/or with a conventional golf club head). The second portion may include a thinner portion (e.g., a recessed or depressed portion) as compared to the first portion described above. The first and second portions may be separated by a boundary portion. For example, according to at least some aspects of this disclosure, a golf club head body has an exaggerated thickness or depth at the heel side (as described above) and a reduced thickness or depth at the toe side. Another example according to at least some aspects of this disclosure, is a golf club head body that has an exaggerated depth or thickness at the rear heel side of the club head (as described above) and a reduced depth or thickness at the remaining portion of the golf club head. Another example, according to at least some aspects of this disclosure, is a golf club head body that has an exaggerated depth or thickness at the rear heel quadrant of the club head (as described above) and a reduced depth or thickness at the remaining portion of the golf club head.

According to some aspects of this disclosure, the mass and/or volume of the golf club head body are distributed so that the configuration of the club head body includes a "bump" portion and "indented" portion. The "bump" and the "indented" portions may be distinct from each other. For example, according to at least some aspects of this disclosure, a golf club head body has a "bump" portion that extends or protrudes from the golf club head body at a heel side of the golf club head body (as described above), and a "indented" portion that recedes into the golf club head body at a toe side of the golf club head body (e.g., with respect to a base surface level of the club head's crown, sole, or other feature). Another example, according to at least some aspects of this disclosure, is a golf club head body that has a "bump" portion that extends or protrudes from the golf club head body at the rear heel side of the club head body (as described above) and an "indented" portion that recedes into the golf club head body in at least some of the remaining portions of the golf club head body. Another example, according to at least some aspects of this disclosure, is a golf club head body that has a "bump" portion that extends or protrudes from the golf club head body at the rear heel quadrant of the club head (as described above) and a reduced depth or thickness in at least some of the remaining portions of the golf club head body.

Configurations of golf club head bodies, such as those described above, may provide more mass and/or volume to the golf club head body at the thicker or "bump" portion of the golf club head body as compared with the thinner or "indented" portion of the golf club head body. Therefore, such configurations will shift the center of gravity of the golf club head body toward the thicker or "bump" portion and away from the thinner or "indented" portion. In this way, the golf club head body can be configured to bias the trajectory of the golf ball when it is struck by the golf club head. For example, a draw, fade, lofted, penetrating, etc. biased trajectory can be achieved. A "fade" is a golf shot in which the golfer gently curves the ball a direction away from the side from which it was stuck. Conversely, a "draw" is a golf shot in which the golfer gently curves the ball in a direction toward the side from which it was stuck.

Aspects of this disclosure relate to wood-type or iron type golf club heads. Wood-type golf club heads according to at least some example aspects of this disclosure may include: (a) a wood-type golf club head body; (b) a ball striking face portion on a front side of the club head body; (c) a rear side opposite the front side; (d) a toe side; and (e) a heel side. Iron-type golf club heads according to at least some example aspects of this disclosure may include: (a) an iron-type golf club head body; (b) a ball striking face portion on a front side of the club head body; (c) a rear side opposite the front side; (d) a toe side; and (e) a heel side. The golf club head body is configured with the mass and/or volume distributed at portions of the club head body as described above so as to impart a desired biased trajectory to the golf ball when it is struck by the golf club head.

The club head body itself also may be constructed in any suitable or desired manner and/or from any suitable or desired materials without departing from this disclosure, including from conventional materials and/or in conventional manners known and used in the art. For example, the club head body may include a ball striking face portion (including a ball striking face plate integrally formed with the ball striking face portion or attached to a frame member such that the face plate and frame portion together constitute the overall ball striking face portion).

Wide varieties of overall club head constructions are possible without departing from this disclosure. For example, if desired, some or all of the various individual parts of the club head body described above may be made from multiple pieces that are connected together (e.g., by adhesives or cements; by welding, soldering, brazing, or other fusing techniques; by mechanical connectors; etc.). The various parts (e.g., top portion, sole portion, cup face, aft body, crown member, body ribbon members, etc.) may be made from any desired materials and combinations of different materials, including materials that are conventionally known and used in the art, such as metal materials, including lightweight metal materials (e.g., titanium, titanium alloys, aluminum, aluminum alloys, magnesium, magnesium alloys, etc.), composite materials, polymer materials, etc. The club head body and/or its various parts may be made by forging, casting, molding, machining, and/or using other techniques and processes, including techniques and processes that are conventional and known in the art.

For golf club structures according to this disclosure, the overall golf club structure (wood or iron) may include a hosel region, a shaft member received in and/or inserted into and/or through the hosel region, and a grip or handle member attached to the shaft member. Optionally, if desired, the external hosel region may be eliminated and the shaft member may be directly inserted into and/or otherwise attached to the head member (e.g., through an opening provided in the top of the club head, through an internal hosel member (e.g., provided within an interior chamber defined by the club head), etc.). The hosel member may be integrally formed as part of the club head structure, or it may be separately formed and engaged therewith (e.g., by adhesives or cements; by welding, brazing, soldering, or other fusing techniques; by mechanical connectors; etc.). Conventional hosels and their inclusion in an iron or wood-type club head structure may be used without departing from this disclosure.

The shaft member may be received in, engaged with, and/or attached to the club head in any suitable or desired manner, including in conventional manners known and used in the art, without departing from the disclosure. As more specific examples, the shaft member may be engaged with the club head via a hosel member and/or directly to the club head structure, e.g., via adhesives, cements, welding, soldering, mechanical connectors (such as threads, retaining elements, or the like), etc.; through a shaft-receiving sleeve or element extending into the club head body; etc. If desired, the shaft may be connected to the head in a releasable manner using mechanical connectors to allow easy interchange of one shaft for another on the head.

The shaft member also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member may be attached to, engaged with, and/or extend from the shaft member in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member may be integrally formed as a unitary, one-piece construction with the shaft member. Additionally, any desired grip or handle member materials may be used without departing from this disclosure, including, for example: rubber materials, leather materials, rubber or other materials including cord or other fabric material embedded therein, polymeric materials, cork materials, and the like.

Still other additional aspects of this disclosure relate to methods for producing iron or wood-type golf club heads and iron or wood-type golf club structures in accordance with examples of this disclosure. Such methods may include, for example, one or more of the following steps in any desired order and/or combinations: (a) providing a wood-type or iron-type golf club head body and/or a golf club head of the various types described above (including any or all of the various structures, features, and/or arrangements described above), e.g., by manufacturing or otherwise constructing the golf club head body or the golf club head, by obtaining it from a third party source, etc.; (b) engaging a shaft member with the golf club head; (c) engaging a grip member with the shaft member; etc.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Invention The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

Figure 1B:
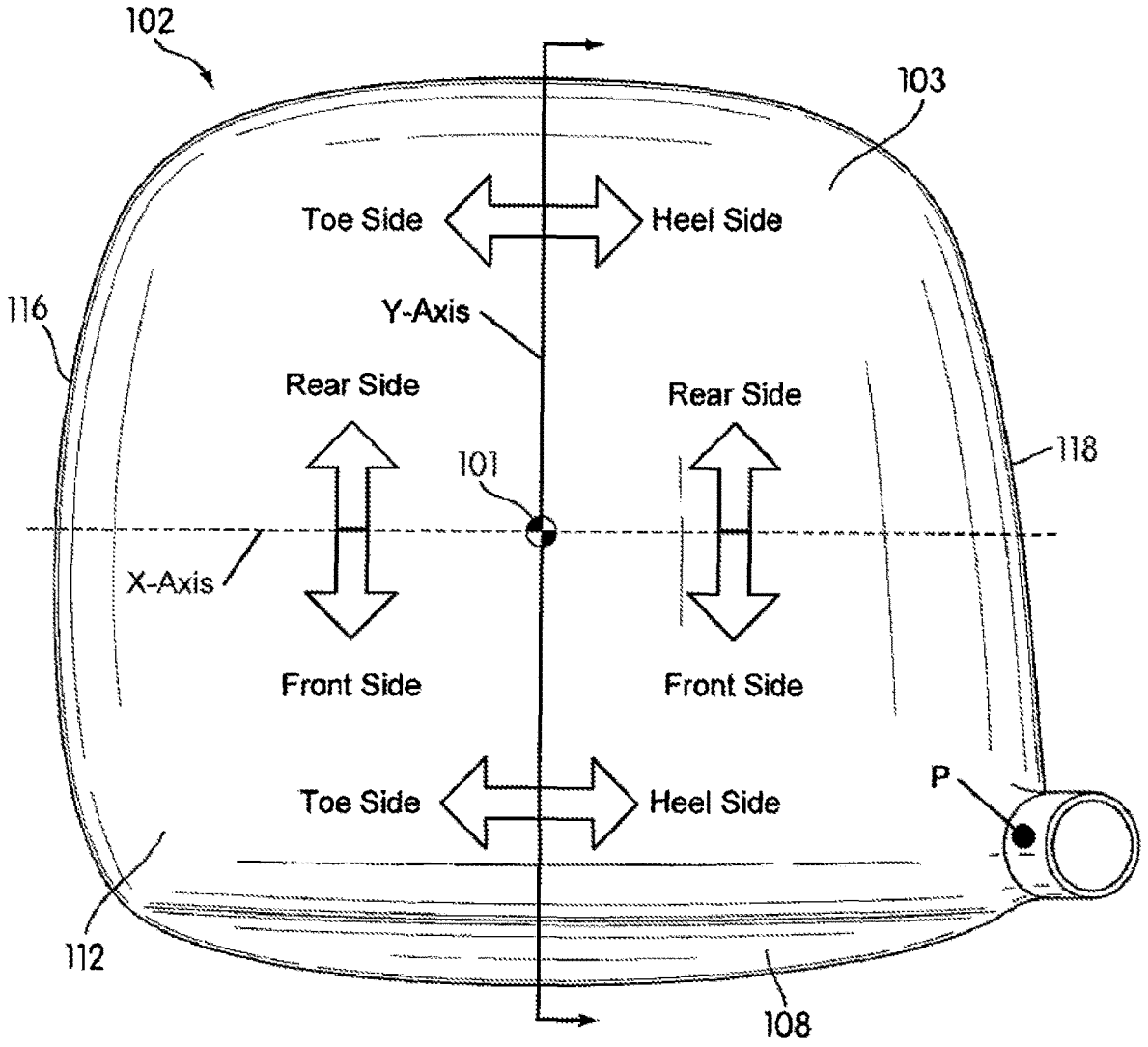
Figure 1C:
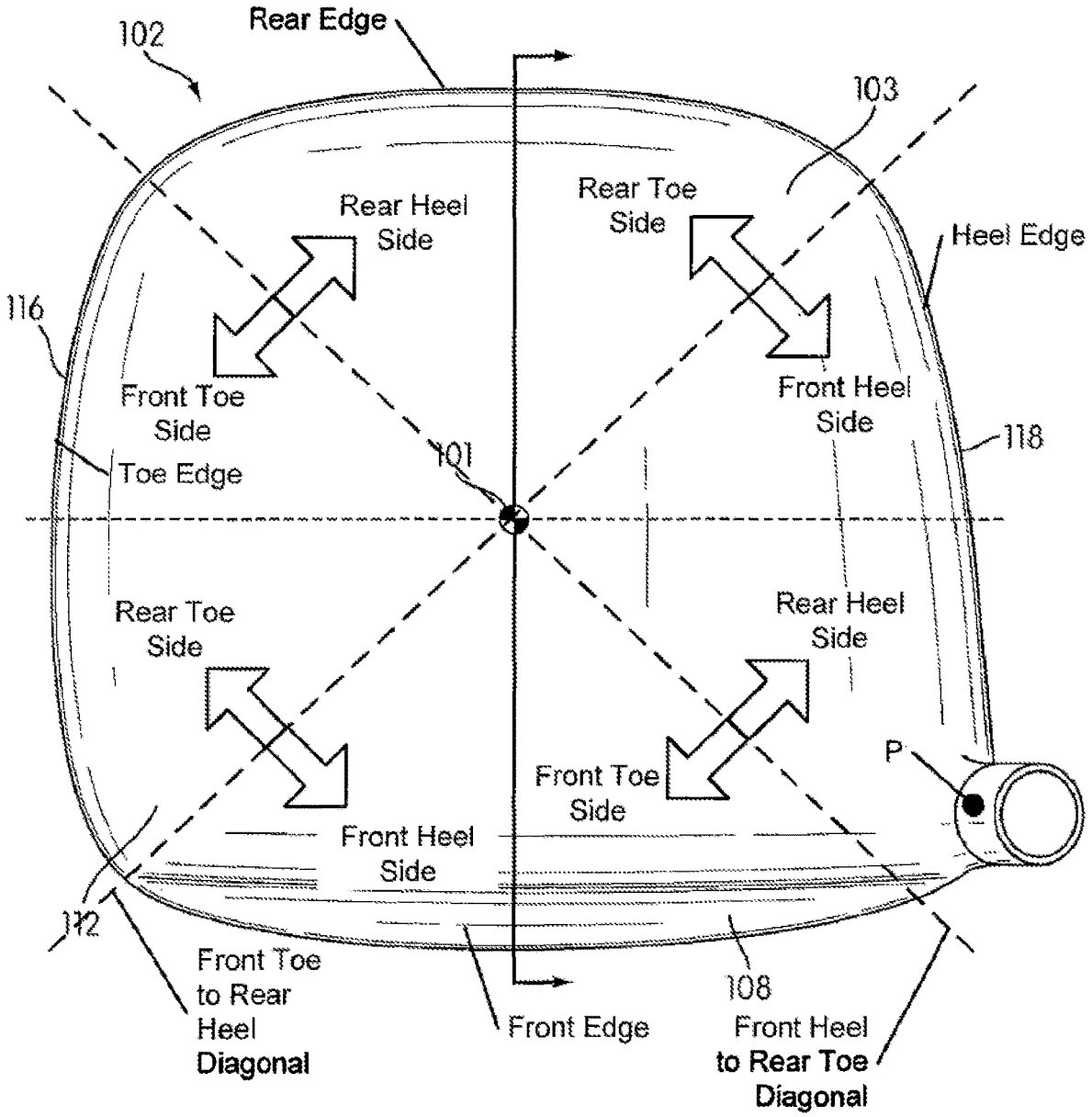
Figure 1D:
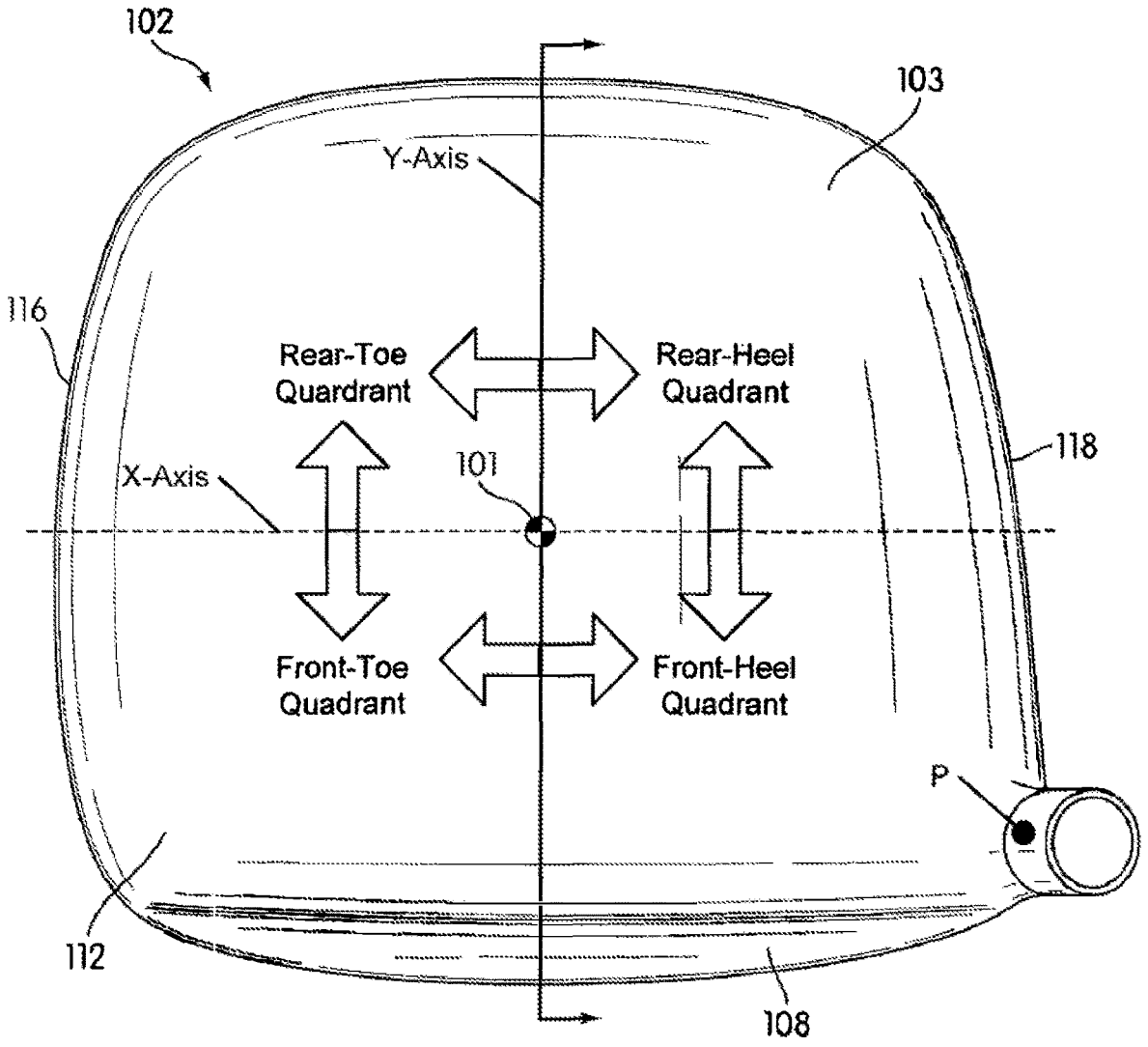
Figure 2:
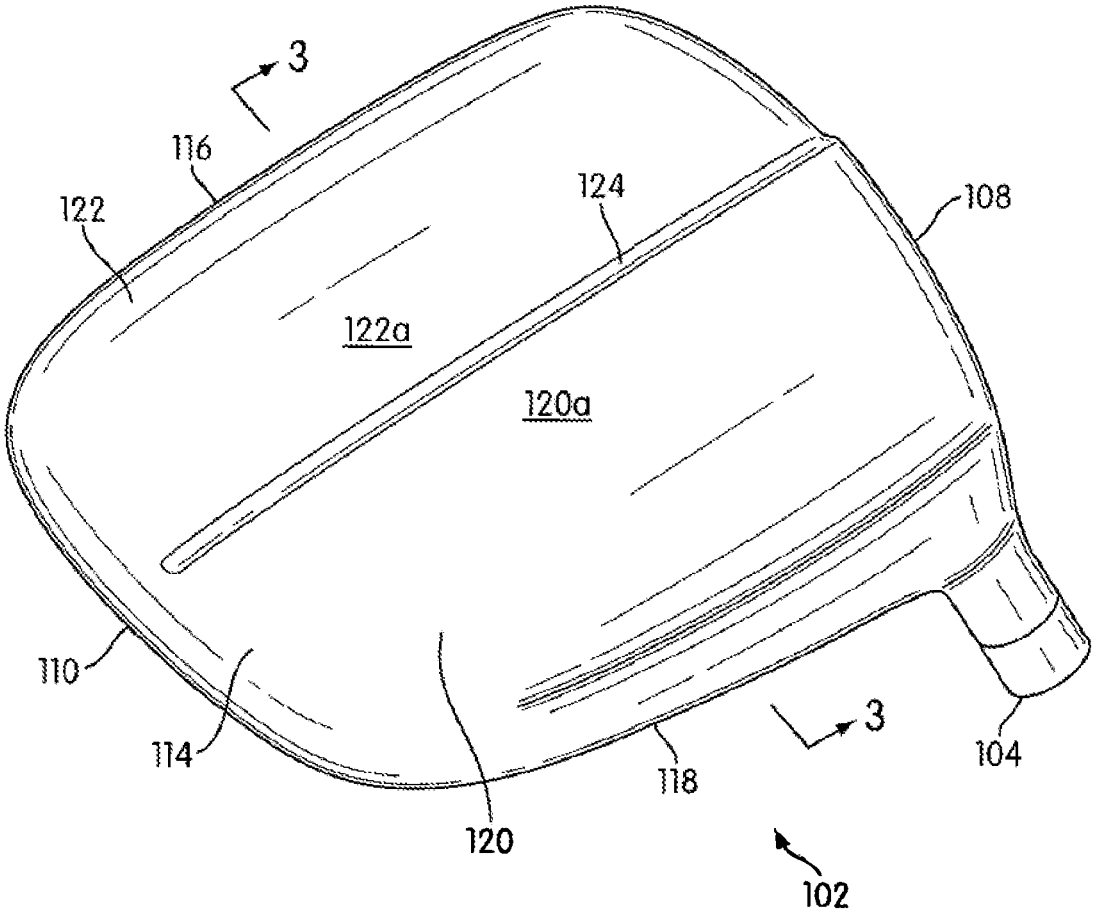
FIG. 2 is a perspective bottom view of the golf club head structure shown in FIGS. 1A through 1D.

An illustrative embodiment according to one or more aspects of the disclosure is shown in FIGS. 1A-3E. FIG. 1A generally illustrates an example of a wood-type golf club head in accordance with the disclosure. According to some aspects of the disclosure, the dimensions of the club head body 102 may include a volume between 200-500 cubic centimeters. As seen in FIGS. 1A and 2, the club head body 102 of this illustrated example includes a ball striking face portion 108 on a front side thereof, a rear side 110 opposite the front side, a crown (or top) portion 112, a sole portion 114, a toe side and toe edge 116 and a heel side and heel edge 118. As further seen in FIGS. 1A and 2, the golf club head body 102 may have a generally rectangular or square shape (although this is not required). Further, the golf club head body 102 includes a maximum breadth that extends from a forwardmost point P of the ball striking face portion 108 to a rearwardmost point P of the rear side 110 and a maximum depth that extends from a topmost point of the crown portion 112 to a bottommost point of the sole portion 114. Further, as seen in FIG. 1A, the geometric center of the golf club head 102 is denoted symbolically by reference numeral 101. Also, as seen in FIG. 1B, a heel side of the golf club head body (with respect to a centerline extending from the ball striking face and through the club head's geometric center 101 in the front-to-rear direction) is denoted by reference numeral 103.

According to aspects of this disclosure, the mass and/or volume of the golf club head structure are positioned so that more mass and/or volume of the golf club head structure are distributed toward the heel side 103 and toward the heel edge 118 of the golf club head body 102. For example, according to particular aspects of this disclosure, at least 51% of the mass and/or at least 51% of the volume of the club head body is positioned on the heel side 103 of the golf club head body. In other aspects of this disclosure, at least 55% of the mass and/or at least 55% of the volume; at least 60% of the mass and/or at least 60% of the volume; at least 65% of the mass and/or at least 65% of the volume may be positioned in the heel side 103. According to some aspects of this disclosure, it is the configuration (e.g., shape and/or geometry) of the golf club head body 102 that provides the above mass, volume and geometric characteristics.

For example, in order to provide the above mass, volume and geometric characteristics, according to one aspect of this disclosure, the golf club head body 102 includes a first portion 120 and a second portion 122. The first portion 120 of the golf club head body extends from the crown portion 112 to the sole portion 114 and may include the maximum depth of the golf club head body 102. The second portion 122 of the golf club head body also extends from the crown portion 112 to the sole portion 114. The first portion 120 of the golf club head body has a greater depth than the second portion 122. In other words, the overall maximum height or thickness of the first portion 120 measured from the crown to the sole is greater than the overall maximum height or thickness of the second portion 122 measured from the crown to the sole. For example, according to some example embodiments of the disclosure, the maximum depth or overall maximum height or thickness of the first portion 120 may be 2-50 mm greater than the maximum depth or overall maximum height or thickness of the second portion 120. In other words, the difference in height (e.g., the overall height of the step from one portion to the next) may be in the range of 2-50 mm. Therefore, when the club is at the address position (see e.g., FIG. 1A), at least some portion of the first portion 120 is 2-50 mm lower than the second portion 122. Other example embodiments would have this thickness differential be in the range of 4-45 mm, 6-40 mm, 8-35 mm and 12-30 mm. In other embodiments, the difference in maximum depth or overall maximum height or thickness between the two portions may be more than 50 mm. The second portion 122 of this illustrative embodiment is a thinner region of the golf club head body 102. In other words, the second portion 122 may be a recessed or depressed portion of the golf club head body 102. For example, as shown in FIG. 2, a sole region **122*a* of the second portion 122 may be sunken relative to a sole region 120***a* of the first portion 120 (e.g., by 2-50 mm or more).

As seen in FIG. 2, the first portion 120 and the second portion 122 are separated at a sloped boundary portion 124 wherein the thickness/depth of club head body 102 changes. As shown, the sloped boundary portion 124 separates the sole region 120*a* of the first portion 120 from the sole region 122*a* of the second portion 122 and defines a transition in depth between the first portion 120 and the second portion 122. The size (e.g., height, width) and slope of the boundary 124 will be dependent upon the difference in depth between the first and second portions, 120, 122. For example, according to some illustrative embodiments of the disclosure, the height/width of the boundary as measured between the first portion and second portion may range, for example, from 2-50 mm, or more. Further, the slope of the boundary may range from 10-90° from a horizontal plane when the club is in an address position. It is noted that the sloped boundary portion 124 may have a slope which is steeper than a gradient of curvature or slope of the sole regions of either of the first two portions. In other words, conventional golf clubs may have soles with a slope (e.g., a convex shape) and, therefore, have a gradient of curvature along the sole defined by the slope or convex shape. In a golf club according to the present disclosure there may be such a slope or gradient of curvature in both the sole region of the first portion and the sole region of the second portion. However, the sloped boundary portion 124 will have a slope that is steeper than such a gradient of curvature or slope of either the first or second sole regions (i.e., the sloped boundary portion 124 may constitute an abrupt change in curvature or slope). In fact, the steepness of the sloped boundary portion 124 may provide the sole portion 114 with a notched, indented, sunken, etc. configuration or shape.

In the depicted embodiment, the sloped boundary portion 124 extends in a generally linear fashion along the sole portion 114 of golf club head body 102. For example, the sloped boundary portion 124 may extend across the sole portion from a point at or proximate to the rear side 110 to a point at or proximate to the ball striking face portion 108. According to some embodiments, the sloped boundary portion 124 may extend along a centerline running through the club head's geometric center in the front-to-rear direction which defines the heel side of the golf club head body and the toe side of the golf club head body as depicted in FIG. 1B. As seen in the depicted embodiment, the sloped boundary portion 124 can extend across the entire sole of the golf club head body (or alternatively, in other embodiments it may extend only partially along the sole of the golf club head body 102 or it may be constructed to smoothly morph with the front and rear sides). Therefore, the first portion 120 and the second portion 122 may have generally rectangular areas, although, it is noted that the first and second portions do not have to be rectangular. Other shapes, such as circular or L-shapes may be employed. Of course, the sloped boundary portion 124 can be modified to any such shapes.

According to some embodiments of the disclosure, the area of the sole region 120*a* of the first portion 120 may be substantially equal to the area of the sole region 122*a* of the second portion 122. For example, the area of the sole region of the first portion may within a range of 80% to 120% of the area of the sole region of the second portion. In other embodiments the range could be closer, while in still other embodiments the difference in area could be greater. According to some embodiments the area of the sole region 120*a* of the first portion 120 may be greater than the area of the sole region 122*a* of the second portion 122. For example, the area of the sole region of the first portion may be at least 50% of the total area of the sole portion of the golf club head body and the area of the sole region of the second portion may be 50% or less of the total area of the sole portion of the golf club head body.

Further, it is noted that the sole region 122*a* of the second portion 122 may be surrounded by the sole region 120*a* of the first portion 120 (i.e., the sole region 122*a* of the second portion 122 may be configured as a "cut out" within the sole region 120*a* of first portion 120) or alternatively, the sole region 120*a* of the first portion 120 may be surrounded by the sole region 122*a* of the second portion 122. Various examples of features of the sole portions will be described in more detail below.

In the golf club head body 102, the first portion 120 and the second portion 122 are configured and weighted so that a center of gravity of the golf club head body 102 is positioned nearer to the heel edge 118 than the toe edge 116. Further, the first portion 120 and the second portion 122 are configured so that a majority of the volume of the golf club head body 102 and a majority of the mass of the golf club head body 102 are positioned nearer to the heel edge 118 than the toe edge 116. The distance that the center of gravity is shifted will depend on the differences in the amount of mass and/or volume between the first portion and the second portion. For example, due to the volume, weighting, and mass features of club head structures in accordance with this disclosure, the center of gravity of the club head may be shifted in the heel direction at least 0.25 inches from the geometric centerline running front to back, and in some examples, at least 0.5 inches, at least 0.75 inches, or even at least 1 inch. As a result of the shifted center of gravity, this configuration of the golf club head body may provide a draw biased trajectory to a golf ball when it is struck by the golf club head (and may help reduce a slicing trajectory).

Figure 3A:
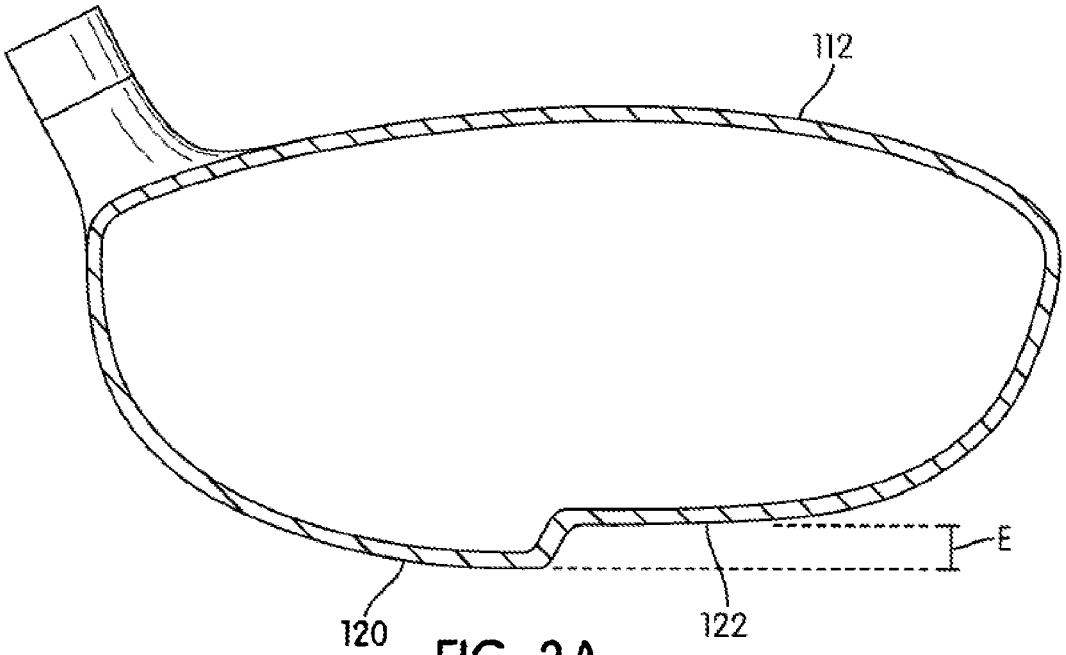
FIG. 3A is a cross sectional view of the golf club head structure taken along line 3-3 shown in FIG. 2.
Figure 3B:
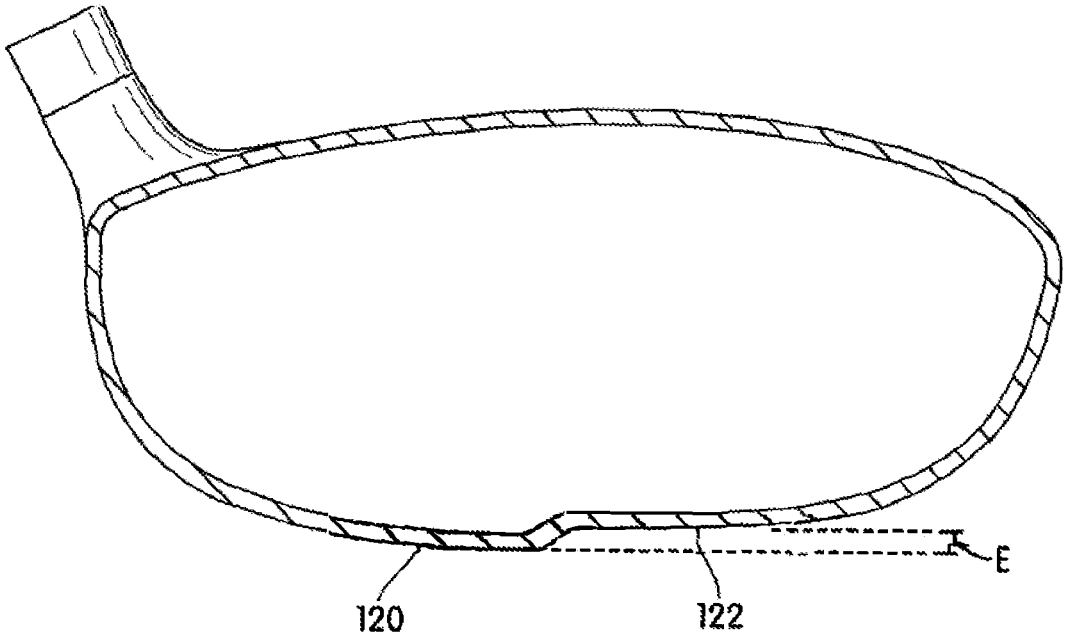
FIGS. 3B through 3E are cross sectional views of various alternate example golf club head structures.
Figure 3C:
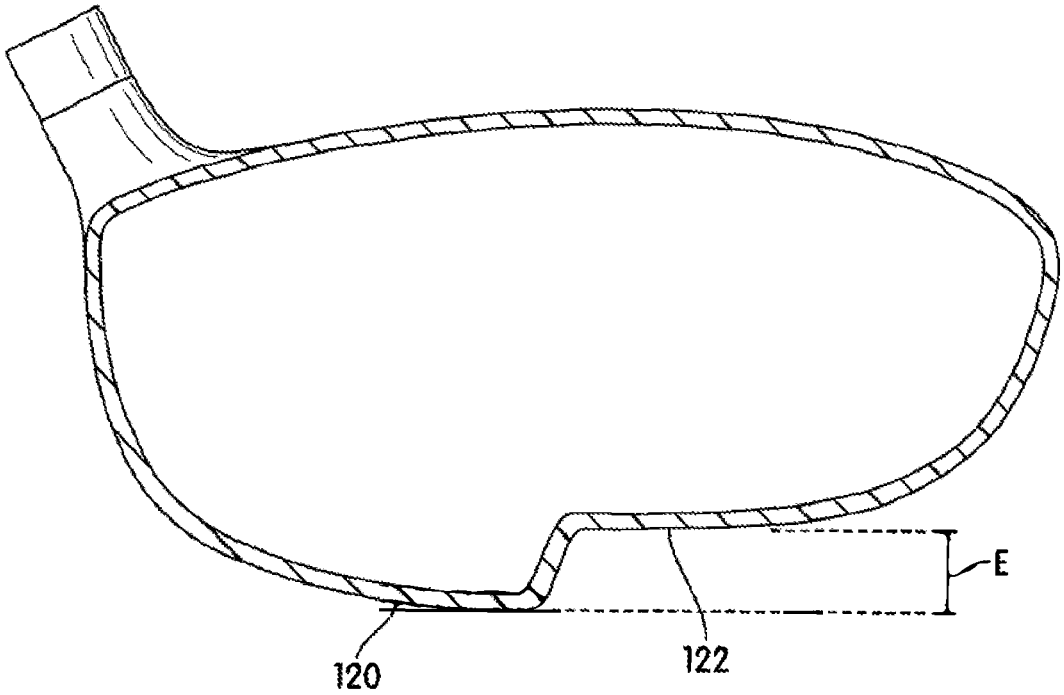
Figure 3D:
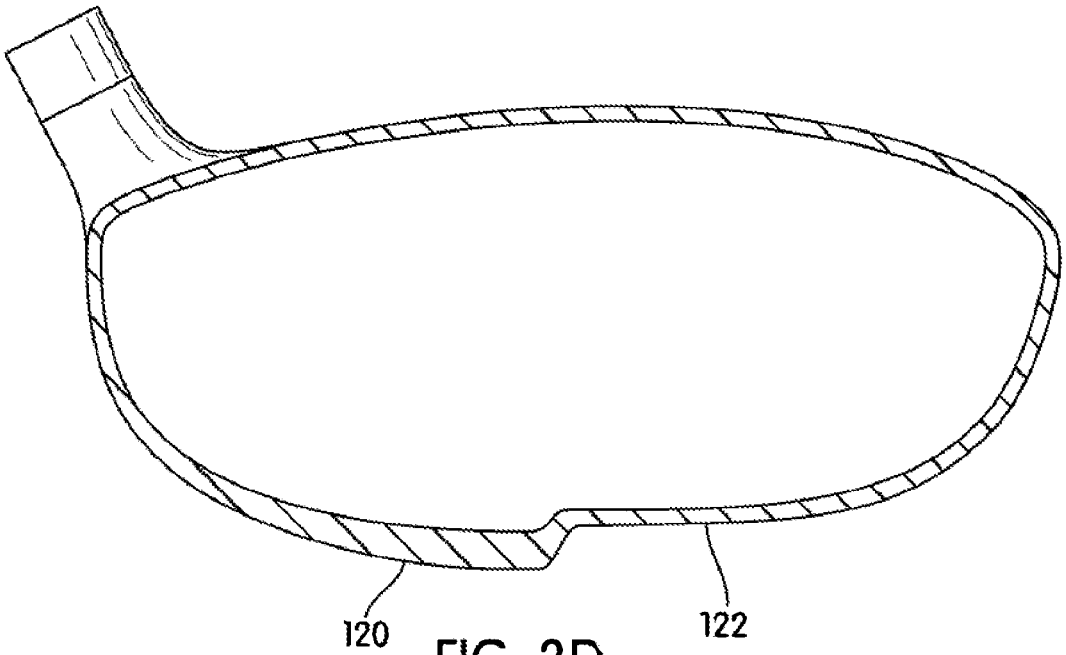
Figure 3E:
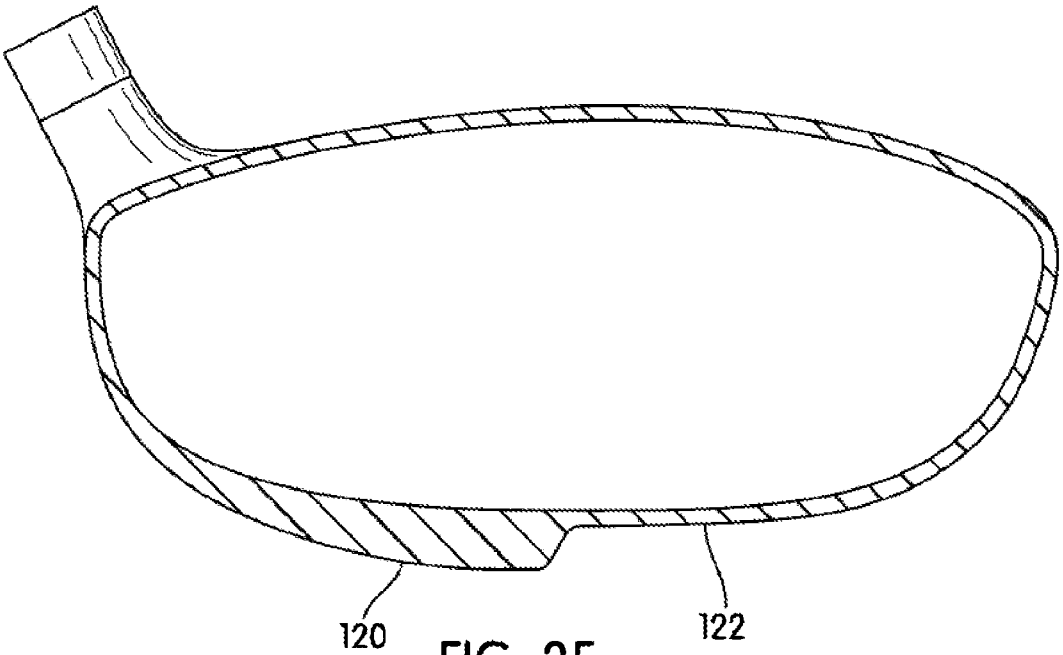

FIG. 3A is a cross sectional view of the golf club head body 102 taken along line 3-3 shown in FIG. 2. The cross sectional view of FIG. 3A shows the change in elevation, E, between the first portion 120 and the second portion 122. The change in elevation will depend on the difference in depth between the first and second portions 120, 122. As described above, this difference in depth may be 2-50 mm or more. FIG. 3A shows one illustrative embodiment with a change in elevation, E, while FIGS. 3B and C show other illustrative embodiments where the change in elevation, E, is less and more dramatic, respectively.

Further, as seen in FIG. 3A, the cross sectional thickness of the wall of the actual club head body at the sole regions 120*a* and 122*a* of the first and second portions 120 and 122 is slight. For example, the wall thickness of the first portion may be between 0.05-10 mm, 0.5-8 mm 1-5 mm or 1.5-2 mm, while the wall thickness of the second portion may be 0.025-9 mm, 0.5-8 mm, 1-5 mm or 1.5-2 mm. In alternative embodiments shown in FIGS. 3D and 3E, the cross sectional thicknesses of the wall of the actual club head body in the sole region 120*a* of the first portion 120 are greater than the cross sectional thicknesses of the wall of the actual club head body in the sole region 122*a* in the second portion 122. This difference in the wall thickness of the respective sole regions allows even more mass to be concentrated near the heel end portion 118 of the golf club head 102 thus shifting the center of gravity closer to the heel end portion 118 than the toe end portion 116.

As described above, the second portion 122 of the golf club head body 102 may be a recessed or depressed portion relative to the first portion 120 of the golf club head body 102. Further, the volume of the depression may be the same as the volume by which the first portion 120 extends beyond a plane along sole portion 114 at a level of the recessed or depressed portion. In other words, the amount of volume of the "cut out" of the club head body 102 at the second portion 122 can be "added" to the first portion 120 to exaggerate the depth at the first portion 120. Therefore, the first portion's depth can be exaggerated by the same amount that the second portion's depth is depressed, while the overall volume of the club head body remains the same.

It is noted that while according to some illustrative embodiments, the first portion 120 has an exaggerated depth (compared with a conventional golf club head) and the second portion 122 of the club head body has a reduced depth, the club head body's first and second portions do not have to be enlarged or recessed by equal amounts. For example, the first portion 120 may be exaggerated by an amount more or less than the volume of the "cut out" of the second portion 122. Therefore, the amount of bias can be controlled or customized to fit particular swing types or a golfer's tendencies.

Also, it is noted that according to some aspects of this disclosure, the first portion 120 does not have to be exaggerated at all. Instead, the first portion 120 can merely be a conventional depth and the second portion 122 can be recessed by a particular amount. Therefore, according to some aspects of this disclosure, the club head body may be configured so that a first portion 120 has a depth that is substantially the same as a conventional golf club head body and a second portion 122 of the club head body has a reduced depth or thickness. This configuration will still create a draw biased trajectory for a golf ball struck by the golf club head, because the recessed portion will still ensure that more of the mass and/or volume of the golf club head is distributed at the first portion 120.

Figure 4:
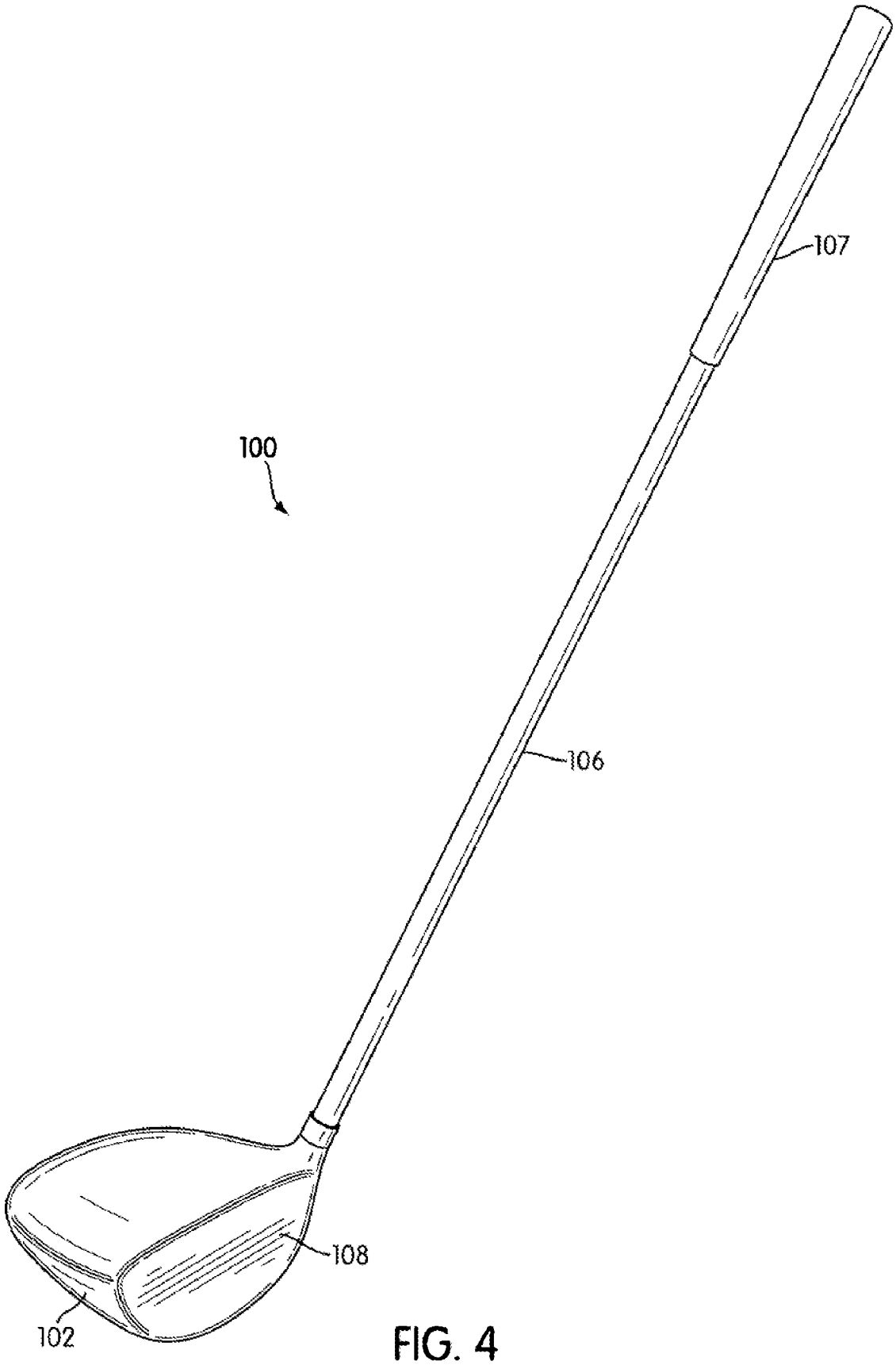
FIG. 4 generally illustrates a golf club with the golf club head structure shown in FIGS. 1A through 1D incorporated therein.

FIG. 4 shows the club 100 at the address position with shaft 106 and grip 107 extending upward. In some embodiments the region immediately behind the ball striking face 108 of the golf club head body 102 can be made a uniform depth (e.g., the maximum depth of the golf club head body) so that the region immediately behind the ball striking face 108 of the golf club head body 102 provides a stable and level surface when the club contacts the ground when the club is placed in the address position. In other words, the portion of the golf club head that extends along a region immediately behind the ball striking face 108 of the golf club head body 102 (in the heel-to-toe direction) could be the main portion that contacts the ground, and therefore such a configuration could provide stability while the golf club is in the address position because it would prevent the golf club 100 from rocking between the heel end portion and the toe portion. Hence, this configuration positions the sloped boundary portion 124 and, therefore, the change in elevation, E, between the first portion 120 and the second portion 122 somewhat away from the area immediately behind the ball striking face in order to provide a stable environment when the golf club 100 is at the address position.

Figure 5:
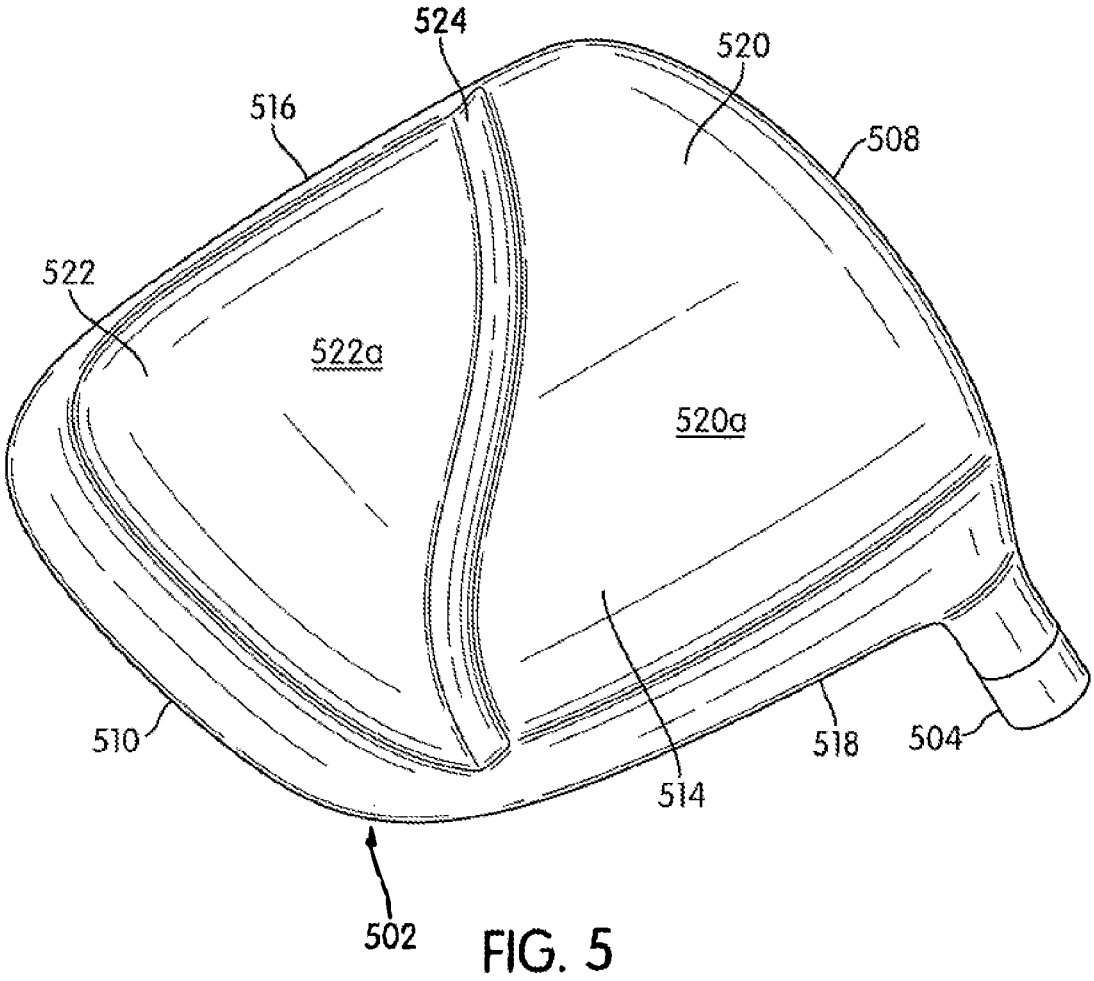
FIG. 5 generally illustrates another example golf club head structure in accordance with this disclosure.
Figure 6:
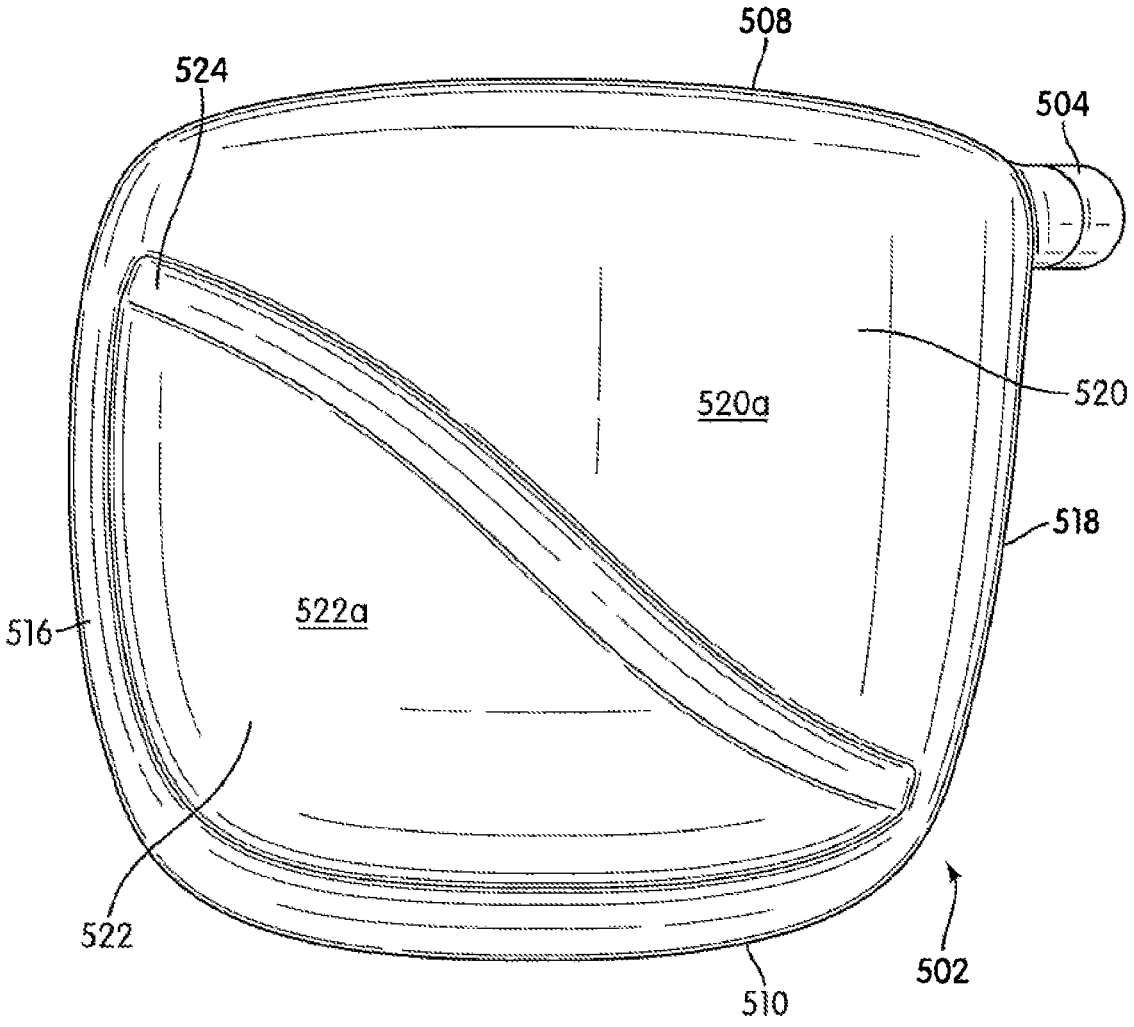
FIG. 6 is a plan view of the golf club head structure shown in FIG. 5.

FIGS. 5 and 6 show an alternative embodiment of a golf club head in accordance with this invention. This embodiment is similar to the embodiments shown in FIGS. 2-3E and can provide a similar mass distribution by placing at least 51% of the mass of the of the golf club head body on the heel side of the club head body (depending, for example, on the cross-sectional wall thickness of the body portion of the club head body sole), but the sloped boundary portion creates a differently configured golf club head. In this embodiment, the sloped boundary portion 524 extends in somewhat of a diagonal fashion along the sole portion 514 of golf club head body 502. For example, the sloped boundary portion 524 may extend across the sole portion from a point at or proximate to the heel edge (the rear heel area) 518 to or toward a point at or proximate the toe edge 516 (the front toe area). Further, as seen in FIGS. 5 and 6, the boundary 524 may exhibit a generally S-shaped curve as it extends along the sole portion 514 from the heel edge 518 toward the toe edge 516. According to some embodiments, the sloped boundary portion 524 may extend across the sole portion from a point along the heel edge 518 that is at least 60% of the maximum breadth of the golf club head body away from the forwardmost point of the ball striking face portion 508 to a point along the toe edge 516 that is at least 60% of the maximum breadth of the golf club head body away from the rearwardmost point of the rear side 510. As can be seen in FIG. 5, the first portion 520 extends along the ball striking face portion 508 from the heel edge 518 to the toe edge 516. The first portion 520 also extends along at least 60% of the heel edge 518. Therefore, the first portion 520 may have a generally triangular area extending along the heel edge 518 and the ball striking face portion 508 of the golf club head body 502. Further, as can be seen in FIG. 5, the second portion 522 extends along the rear side 510 from the heel edge 518 to the toe edge 516. The second portion 522 also extends along at least 60% of the toe edge 516. Therefore, the second portion 522 may have a generally triangular area extending along the toe edge 516 and the rear side 510 of the golf club head body 502. It is noted that the first and second portions do not have to be triangular. Other shapes, such as circular or L-shapes may be employed. Of course, the sloped boundary portion 524 can be modified to define such shapes.

According to some embodiments of the disclosure, the area of the sole region 520*a* of the first portion 520 may be substantially equal to the area of the sole region 522*a* of the second portion 522. For example, the area of the sole region 520*a* of the first portion 520 may be within a range of 80% to 120% of the area of the sole region 522*a* of the second portion 522. In other embodiments the range could be closer, while in still other embodiments the difference in area could be greater. According to some embodiments the area of the sole region 520*a* of the first portion 520 may be greater than the area of the sole region 522*a* of the second portion 522. For example, the area of the sole region 520*a* of the first portion 520 may be at least 50% of the total area of the sole portion of the golf club head body and the area of the sole region 522*a* of the second portion 522 may be 50% or less of the total area of the sole portion of the golf club head body.

Further, it is noted that the sole region 522*a* of the second portion 522 may be surrounded by the sole region 520*a* of the first portion 520 (i.e., the sole region 522*a* of the second portion 522 is configured as a "cut out" within the sole region 520*a* of first portion 520) or alternatively, the sole region 520*a* of the first portion 520 may be surrounded by the sole region 522*a* of the second portion 522.

In the golf club head body 502, the first portion 520 and the second portion 522 are configured and weighted so that a center of gravity of the golf club head body 502 is positioned nearer to the heel edge 518 than the toe edge 516. Further, the first portion 520 and the second portion 522 are configured and weighted so that a majority of the volume of the golf club head body 502 and a majority of the mass of the golf club head body 502 are positioned nearer to the heel edge 518 than the toe edge 516. The distance that the center of gravity is shifted will depend on the differences in the amount of mass and/or volume between the first portion and the second portion. For example, due to the volume, weighting, and mass features of club head structures in accordance with this disclosure, the center of gravity of the club head may be shifted in the heel direction at least 0.25 inches from the geometric centerline running front to back, and in some examples, at least 0.5 inches, at least 0.75 inches, or even at least 1 inch. As a result of the shifted center of gravity, this configuration of the golf club head body can provide a draw biased trajectory to a golf ball when it is struck by the golf club head.

Figure 7:
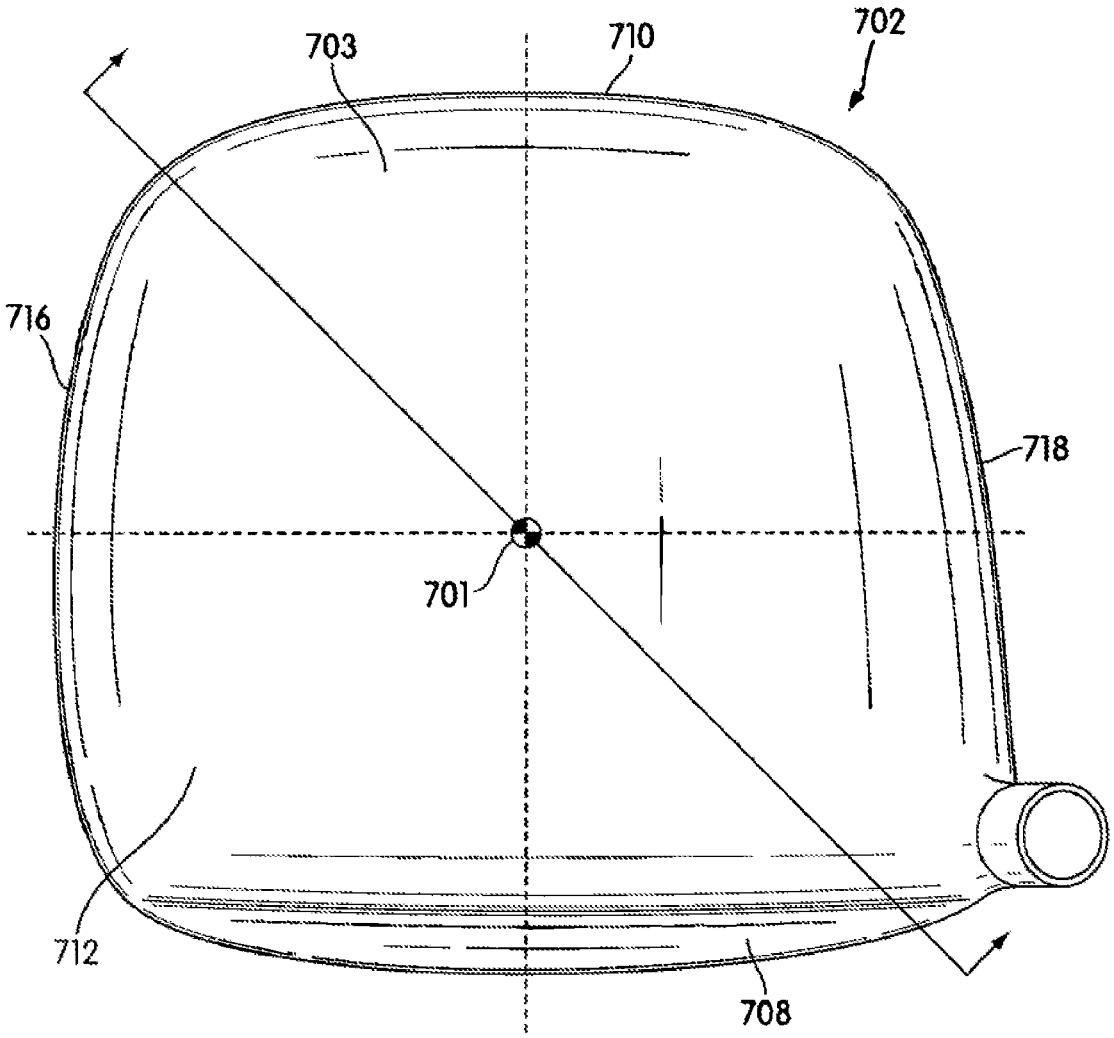
FIG. 7 generally illustrates another example golf club head structure in accordance with this disclosure.
Figure 8:
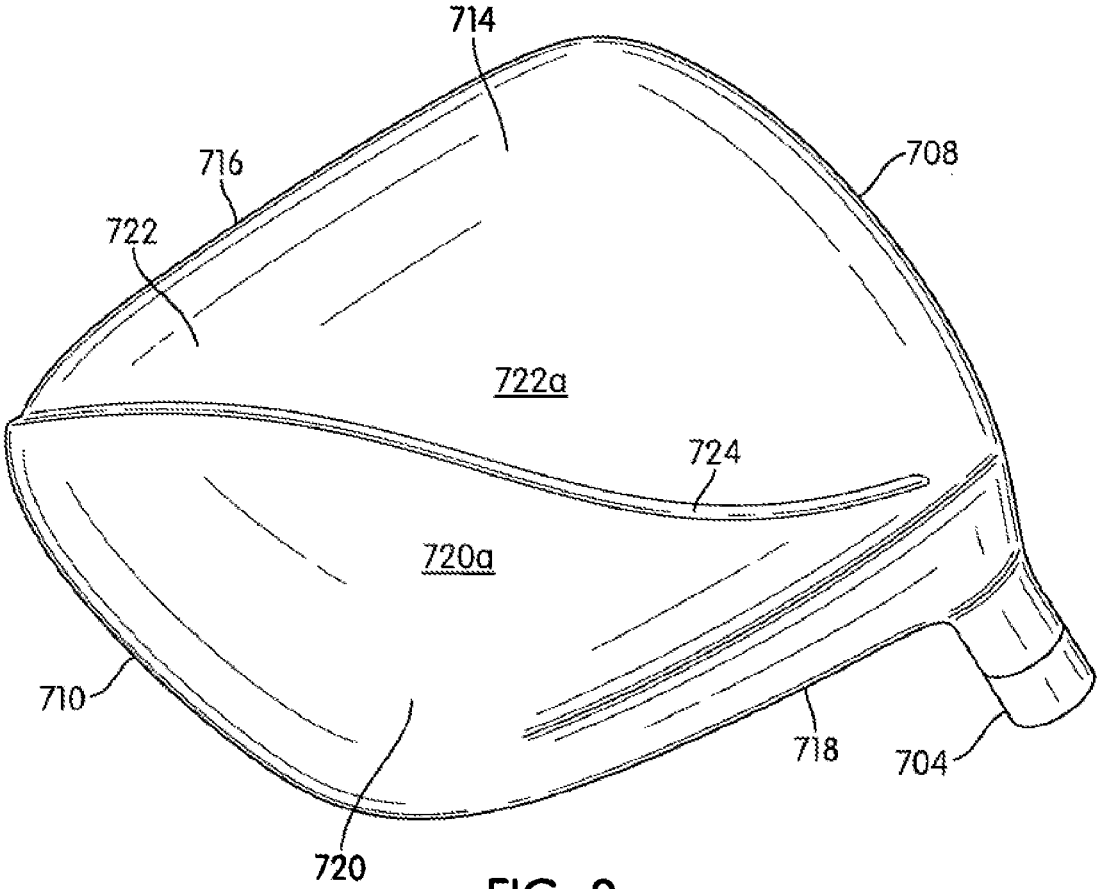
FIG. 8 is a perspective bottom view of the golf club head structure shown in FIG. 7.

An illustrative embodiment according to other aspects of the disclosure is shown in FIGS. 7-8. FIG. 7 generally illustrates an example of a wood-type golf club head 702 in accordance with the disclosure. The wood-type golf club head 702 is similar to the previous embodiments in that, as seen in FIG. 8, the club head body 702 of this illustrated example includes a ball striking face portion 708 on a front side of the club head body, a rear side 710 opposite the front side, a crown (or top) portion 712, a sole portion 714, a toe side and toe edge 716 and a heel side and heel edge 718. Further, the golf club head body 702 includes a maximum breadth that extends from a forwardmost point of the ball striking face portion 708 to a rearwardmost point of the rear side 710 and a maximum depth that extends from a topmost point of the crown portion 712 to a bottommost point of the sole portion 714. Further, as seen in FIG. 7, the geometric center of golf club head is denoted symbolically by reference numeral 701. Also, as seen in FIG. 7, a rear heel side of the golf club head body (with respect to a diagonal centerline running through the club head's geometric center in the front heel-to-rear toe direction) is denoted by reference numeral 703.

According to aspects of this disclosure, the mass and/or volume of the golf club head structure are positioned so that more of the mass and/or volume of the golf club head body 702 are distributed toward both the rear side 710 of the golf club head body and the heel side of the golf club head body. For example, according to particular aspects of this disclosure, at least 51% of the mass and/or at least 51% of the volume of the club head body is positioned in the rear heel side 703 of the golf club head body. In other aspects of this disclosure, at least 55% of the mass and/or at least 55% of the volume; at least 60% of the mass and/or at least 60% of the volume; at least 65% of the mass and/or at least 65% of the volume may be positioned in the rear heel side 703. According to some aspects of this disclosure, the specific configuration of the golf club head provides the above mass, volume and geometric characteristics.

As further shown in FIG. 8, the golf club head body 702 includes a first portion 720 and a second portion 722. The first portion 720 of the golf club head body extends from the crown portion 712 to the sole portion 714 and may include the maximum depth of the golf club head body 702. The second portion 722 of the golf club head body also extends from the crown portion 712 to the sole portion 714. The first portion 720 of the golf club head body has a greater depth than the second portion 722 of the golf club head body. In other words, the overall club head height or thickness of the first portion 720 measured from the crown to the sole is greater than the overall club head height or thickness of the second portion 722 measured from the crown to the sole. According to some example embodiments of the disclosure, the depth of the first portion may be 2-50 mm greater than the depth of the second portion. In other words, the difference in height (e.g., the overall height of the step from one portion to the next) will be in the range of 2-50 mm. Therefore, when the club is at the address position (see, e.g., FIG. 4), at least some portion of the first portion 720 is 2-50 mm lower than the second portion 722. Other example embodiments would have step heights in the ranges of 4-45 mm, 6-40 mm, 8-35 mm and 12-30 mm. In other embodiments the difference in depth between the two portions may be more than 50 mm. The second portion 722 of this illustrative embodiment is a thinner overall region of the golf club head body 702. In other words, the second portion 722 may be a recessed or depressed portion of the golf club head body 702. For example, as shown in FIG. 8, a sole region 722*a* of the second portion 722 may be sunken relative to a sole region 720*a* of the first portion 720 (e.g., by 2-50 mm or more).

As seen in FIG. 8, the first portion 720 and the second portion 722 are separated at a sloped boundary portion 724 wherein the thickness/depth of club head body 702 changes. As shown, the sloped boundary portion 724 separates the sole region 720*a* of the first portion 720 from the sole region 722*a* of the second portion 722. Further, the sloped boundary portion 724 recedes from the first sole region 720*a* of the first portion 720 to the sole region 722*a* of the second portion 722 to define a transition in depth between the first portion 720 and the second portion 722. This change in depth can be seen in FIG. 8 where the sloped boundary portion 724 is sloped between the first portion 720 and the second portion 722. The size (e.g., height, width) and slope of the boundary portion 724 will be dependent upon the difference in depth between the first and second portions, 720, 722. For example, according to some illustrative embodiments of the disclosure, the height/width of the boundary as measured between the first portion and second portion can range from 2-50 mm, or more. Further, the slope of the boundary can range from 10-90° from a horizontal plane when the club is in an address position. It is noted that the sloped boundary portion 724 may have a slope that is steeper than a gradient of curvature or slope of the sole regions of either of the first two portions. In other words, conventional golf clubs may have soles with a slope (e.g., a convex shape) and, therefore, have a gradient of curvature along the sole defined by the slope or convex shape. In a golf club according to the present disclosure there may be such a slope or gradient of curvature in both the sole region of the first portion and the sole region of the second portion. However, the sloped boundary portion 724 will have a slope that is steeper than such a gradient of curvature or slope of either the first or second sole regions (e.g., the change in curvature and/or depth may be abrupt). In fact, the steepness of the sloped boundary portion may provide the sole portion 714 with a notched, indented, sunken, etc. configuration or shape.

In the depicted embodiment, the sloped boundary portion 724 extends in a generally diagonal fashion along the sole portion 714 of golf club head body 702. For example, the sloped boundary portion 724 may extend across the sole portion from a point at or proximate to the heel edge 718 to a point at or proximate to the toe edge 716. Further, as seen in FIG. 8, the boundary 724 may exhibit a generally S-shaped curve as it extends along the sole portion 714 from the heel edge 718 to the toe edge 716. According to some embodiments, the sloped boundary portion 724 may extend across the sole portion 714 from a point along the toe edge 716 that is at least 60% of the maximum breadth of the golf club head body away from the forwardmost point of the ball striking face portion 708 to a point along the heel edge 718 that is at least 60% of the maximum breadth of the golf club head body away from the rearwardmost point of the rear side 710. As can be seen in FIG. 8, the first portion 720 extends along the rear side 710 from the heel edge 718 to the toe edge 716. The first portion 720 also extends along at least 60% of the heel edge 718. Therefore, the first portion 720 may have a generally triangular area extending along the heel edge 718 and the rear side 710 of the golf club head body 702. Further, as can be seen in FIG. 8, the second portion 722 extends in a direction parallel to the ball striking face 710 from the heel edge 718 to the toe edge 716. The second portion 722 also extends along at least 60% of the toe edge 716. Therefore, the second portion 722 may have a generally triangular area extending along the toe edge 716 and the ball striking face portion 708 of the golf club head body 702. It is noted that the first and second portions do not have to be triangular. Other shapes, such as circular or L-shapes may be employed. Of course, the sloped boundary portion 724 can be modified to define such shapes.

Further, according to some aspects of this disclosure, if desired a second sloped boundary portion could be provided to define a region immediately behind the ball striking face portion 708 so that such a region immediately behind the ball striking face portion 708 has a depth that may include the maximum depth of the golf club head body. In this way, as described above, additionally stability could be achieved by preventing rocking when the golf club is placed at the address position.

According to some embodiments of the disclosure, the area of the sole region 720*a* of the first portion 720 may be substantially equal to the area of the sole region 722*a* of the second portion 722. For example, the area of the sole region of the first portion may be within a range of 80% to 120% of the area of the sole region of the second portion. In other embodiments the area could be closer, while in still other embodiments the difference in area could be greater. According to some embodiments, the area of the sole region 720*a* of the first portion 720 may be greater than the area of the sole region 722*a* of the second portion 722. For example, the area of the sole region 720*a* of the first portion may be at least 50% of the total area of the sole portion of the golf club head body and the area of the sole region 722*a* of the second portion may be 50% or less of the total area of the sole portion of the golf club head body.

Further, it is noted that the sole region 722*a* of the second portion 722 may be surrounded by the sole region 720*a* of the first portion 720 (i.e., the sole region 722*a* of the second portion 722 is configured as a "cut out" within the sole region 720*a* of first portion 720) or alternatively, the sole region 720*a* of the first portion 720 may be surrounded by the sole region 722*a* of the second portion 722.

In the golf club head body 702, the first portion 720 and the second portion 722 are configured and weighted so that a center of gravity of the golf club head body 702 is positioned nearer to the heel edge 718 than the toe edge 716 and nearer to the rear side 710 than the ball striking face portion 708. Further, the first portion 720 and the second portion 722 are configured and weighted so that a majority of the volume of the golf club head body 702 and a majority of the mass of the golf club head body 702 are positioned nearer to the heel edge 718 than the toe edge 716 and nearer to the rear side 710 than the ball striking face portion 708. The distance that the center of gravity is shifted will depend on the differences in the amount of mass and/or volume between the first portion and the second portion. For example, due to the volume, weighting, and mass features of club head structures in accordance with this disclosure, the center of gravity of the club head may be shifted in the heel direction at least 0.25 inches from the geometric centerline running front to back, and in some examples, at least 0.5 inches, at least 0.75 inches, or even at least 1 inch. Further, the center of gravity of the club head may be shifted in the rear direction at least 0.25 inches from the geometric centerline running heel to toe, and in some examples, at least 0.5 inches, at least 0.75 inches, or even at least 1 inch. As a result of the shifted center of gravity, this configuration of the golf club head body can provide a draw and lofted biased trajectory to a golf ball when it is struck by the golf club head.

Figure 9:
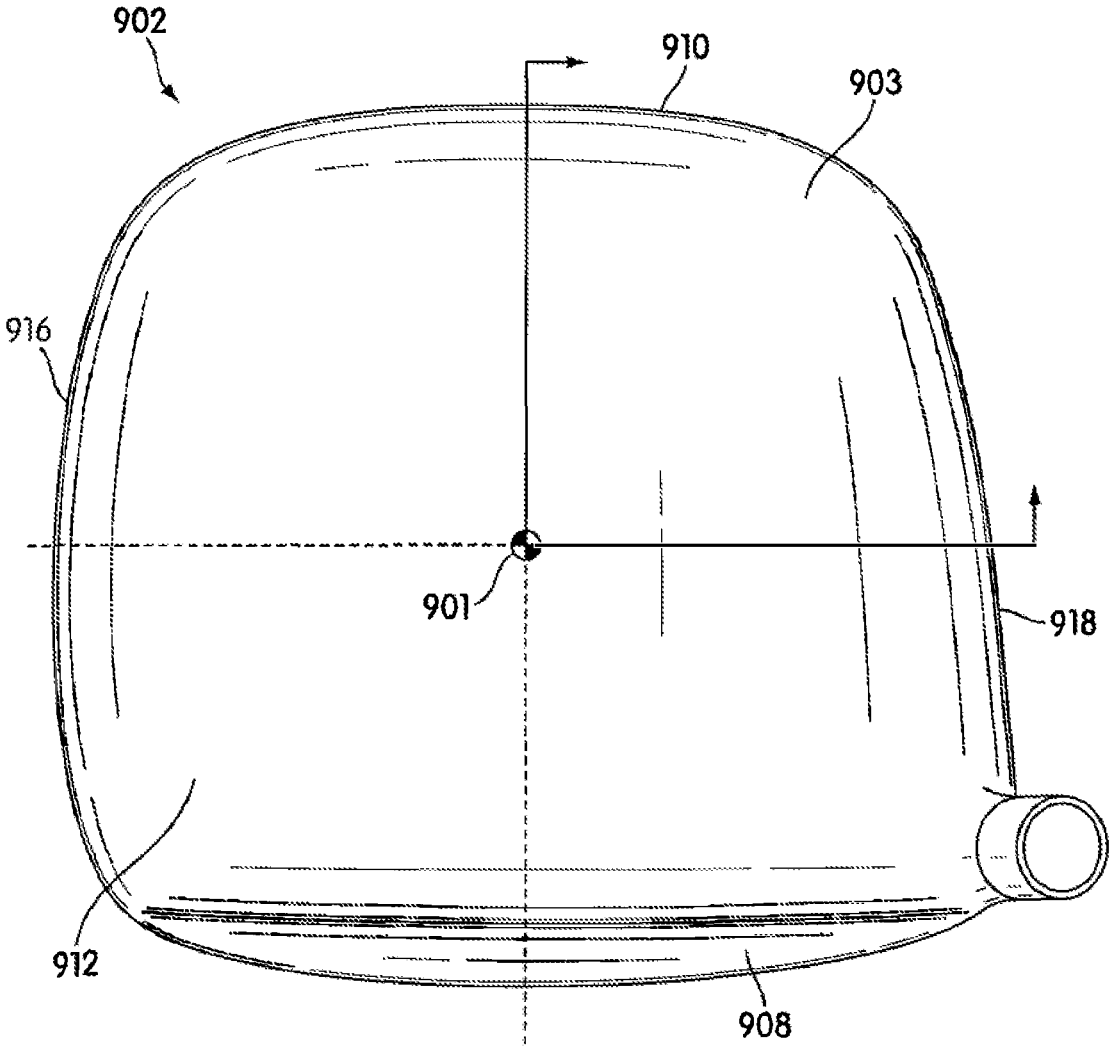
FIG. 9 generally illustrates another example golf club head structure in accordance with this disclosure.
Figure 10:
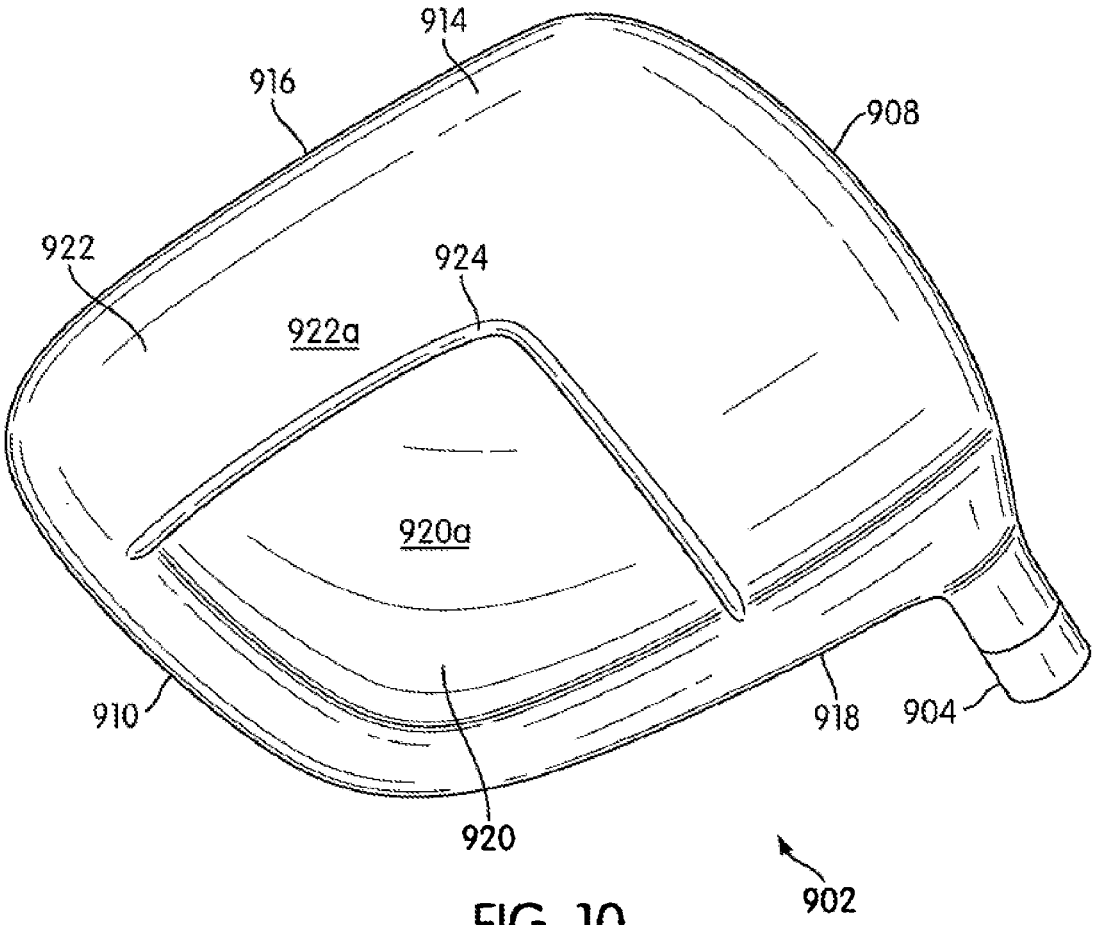
FIG. 10 is a perspective bottom view of the golf club head structure shown in FIG. 9.

An illustrative embodiment according to other aspects of the disclosure is shown in FIGS. 9-10. FIG. 9 generally illustrates an example of a wood-type golf club head 902 in accordance with the disclosure. The wood-type golf club head 902 is similar to the previous embodiments in that, as also shown in FIG. 10, the club head body 902 of this illustrated example includes a ball striking face portion 908 on a front side thereof, a rear side 910 opposite the front side, a crown (i.e., top) portion 912, a sole portion 914, a toe side and toe edge 916 and a heel side and heel edge 918. Further, the golf club head body 902 includes a maximum breadth that extends from a forwardmost point of the ball striking face portion 908 to a rearwardmost point of the rear side 910 and a maximum depth that extends from a topmost point of the crown portion 912 to a bottommost point of the sole portion 914. Further, as seen in FIG. 9, the geometric center of golf club head is denoted symbolically by reference numeral 901. Also, seen is FIG. 9, a rear heel quadrant of the golf club head body (with respect to a central coordinate system located at club head's geometric center) is denoted by reference numeral 903.

According to aspects of this disclosure, the mass and/or volume of the golf club head body 902 are distributed so that at least more than a quarter of the mass of the club head is located in the rear heel quadrant of the club head (with respect to a central coordinate system located at club head's geometric center). For example, according to particular aspects of this disclosure, at least 26% of the mass and/or at least 26% of the volume of the club head body is located in the rear heel quadrant of the golf club head body. In other aspects of this disclosure, at least 28% of the mass and/or at least 28% of the volume; at least 30% of the mass and/or at least 30% of the volume; at least 33% of the mass and/or at least 33% of the volume; and even at least 36% of the mass and/or at least 36% of the volume may be positioned in the rear heel quadrant 903. According to some aspects of this disclosure, it is the configuration of the golf club head provides the above mass, volume and geometric characteristics.

As further shown in FIG. 10, the golf club head body 902 includes a first portion 920 and a second portion 922. The first portion 920 of the golf club head body extends from the crown portion 912 to the sole portion 914 and may include the maximum depth of the golf club head body 902. The second portion 922 of the golf club head body also extends from the crown portion 912 to the sole portion 914. The first portion 920 of the golf club head body has a greater depth than the second portion 922 of the golf club head body. In other words, the overall club head height or thickness of the first portion 920 measured from the crown to the sole is greater than the overall club head height or thickness of the second portion 922 measured from the crown to the sole. According to some example embodiments of the disclosure, the depth of the first portion may be 2-50 mm greater than the depth of the second portion. In other words, the difference in height (e.g., the overall height of the step from one portion of the club head body to the next) may be in the range of 2-50 mm. Therefore, when the club is at the address position (see e.g., FIG. 4), at least some portion of the first portion is 2-50 mm lower than the second portion. In other example embodiments, this height differential may be in the range of 4-45 mm, 6-40 mm, 8-35 mm and 12-30 mm. In other embodiments the difference in depth between the two portions may be more than 50 mm. The second portion 922 of this illustrative embodiment is a thinner region of the golf club head body 902. In other words, the second portion 922 may be a recessed or depressed portion of the golf club head body 902. For example, as shown in FIG. 10, a sole region 922*a* of the second portion 922 may be sunken relative to a sole region 920*a* of the first portion 920 (e.g., by 2-50 mm or more).

As seen in FIG. 10, the first portion 920 and the second portion 922 are separated at a sloped boundary portion 924 wherein the thickness/depth of club head body 902 abruptly changes. As shown, the sloped boundary portion 924 separates the sole region 920*a* of the first portion 920 from the sole region 922*a* of the second portion 922. Further, the sloped boundary portion 924 recedes from the first sole region 920*a* of the first portion 920 to the sole region 922*a* of the second portion 922 to define a transition in depth between the first portion 920 and the second portion 922. The size (e.g., height, width) and slope of the boundary 924 will be dependent upon the difference in depth between the first and second portions, 920, 922. For example, according to some illustrative embodiments of the disclosure, the height/width of the boundary as measured between the first portion and second portion can range from 2-50 mm, or more. Further, the slope of the boundary can range from 10-90° from a horizontal place when the club is at an address position. It is noted that the sloped boundary portion 924 may have a slope that with respect to horizontal when the club head is oriented at the address position is steeper than a gradient of curvature or slope of the sole regions of either of the first two portions. In other words, conventional golf clubs may have soles with a slope (e.g., a convex shape) and, therefore, have a gradient of curvature along the sole defined by the slope or convex shape. In a golf club according to the present disclosure there may be such a slope or gradient of curvature in both the sole region of the first portion and the sole region of the second portion. However, the sloped boundary portion 924 will have a slope that is steeper than such a gradient of curvature or slope of either the first or second sole regions (e.g., a more abrupt change in these slopes). In fact, the steepness of the sloped boundary portion may provide the sole portion 914 with a notched, indented, sunken, etc. configuration or shape.

In the depicted embodiment, the sloped boundary portion 924 extends along the sole portion 914 of golf club head body 902. For example, the sloped boundary portion 924 may extend so as to define the rear heel quadrant of the golf club head body. As can be seen in FIG. 10, the first portion 920 extends along and substantially fills the rear heel quadrant 903. Therefore, the first portion 920 may have a quadrilateral area extending along the heel edge 918 and the rear side 910 of the golf club head body 902. Further, as can be seen in FIG. 10, the second portion 922 extends along the remaining portion of the sole portion 914 of the club head body 902. Therefore, the second portion 922 may have an L-shaped area extending along the toe edge 916 and in a direction parallel to the ball striking face portion 908 of the golf club head body 902. Other shapes, such as circular, sectors, etc., may be employed. The sloped boundary portion 924 can be modified to define any desired shape.

Further, according to some aspects of this disclosure, if desired a second sloped boundary portion could be provided to define a region immediately behind the ball striking face portion 908 so that such a region immediately behind the ball striking face portion 908 has a depth that may include the maximum depth of the golf club head body. In this way, as described above, additionally stability could be achieved by preventing rocking when the golf club is place at the address position.

In the golf club head body 902, the first portion 920 and the second portion 922 are configured so that a center of gravity of the golf club head body 902 is positioned nearer to the heel edge 918 than the toe edge 916 and nearer to the rear side 910 than the ball striking face portion 908. Further, the first portion 920 and the second portion 922 are configured so that a majority of the volume of the golf club head body 902 and a majority of the mass of the golf club head body 902 are positioned nearer to the heel edge 918 than the toe edge 916 and nearer to the rear side 910 than the ball striking face portion 908. The distance that the center of gravity is shifted will depend on the differences in the amount of mass and/or volume between the first portion and the second portion. For example, due to the volume, weighting, and mass features of club head structures in accordance with this disclosure, the center of gravity of the club head may be shifted in the heel direction at least 0.25 inches from the geometric centerline running front to back, and in some examples, at least 0.5 inches, at least 0.75 inches, or even at least 1 inch. Further, the center of gravity of the club head may be shifted in the rear direction at least 0.25 inches from the geometric centerline running heel to toe, and in some examples, at least 0.5 inches, at least 0.75 inches, or even at least 1 inch. As a result of the shifted center of gravity, this configuration of the golf club head body can provide a draw and lofted biased trajectory to a golf ball when it is struck by the golf club head.

While some aspects of the present disclosure are directed to golf club head bodies that position more mass and/or volume of the golf club head toward the heel edge as compared with the toe edge, other aspects of the disclosure are directed to golf club head bodies that position more mass and/or volume of the golf club head toward the toe edge as compared with the heel edge. Such a configuration shifts the center of gravity of the golf club head body closer to the toe edge as compared with the heel edge. As a result, this configuration of the golf club head body can provide a fade biased trajectory to a golf ball when it is struck by the golf club head (and may help provide corrections for hooking type ball trajectories).

Figure 11A:
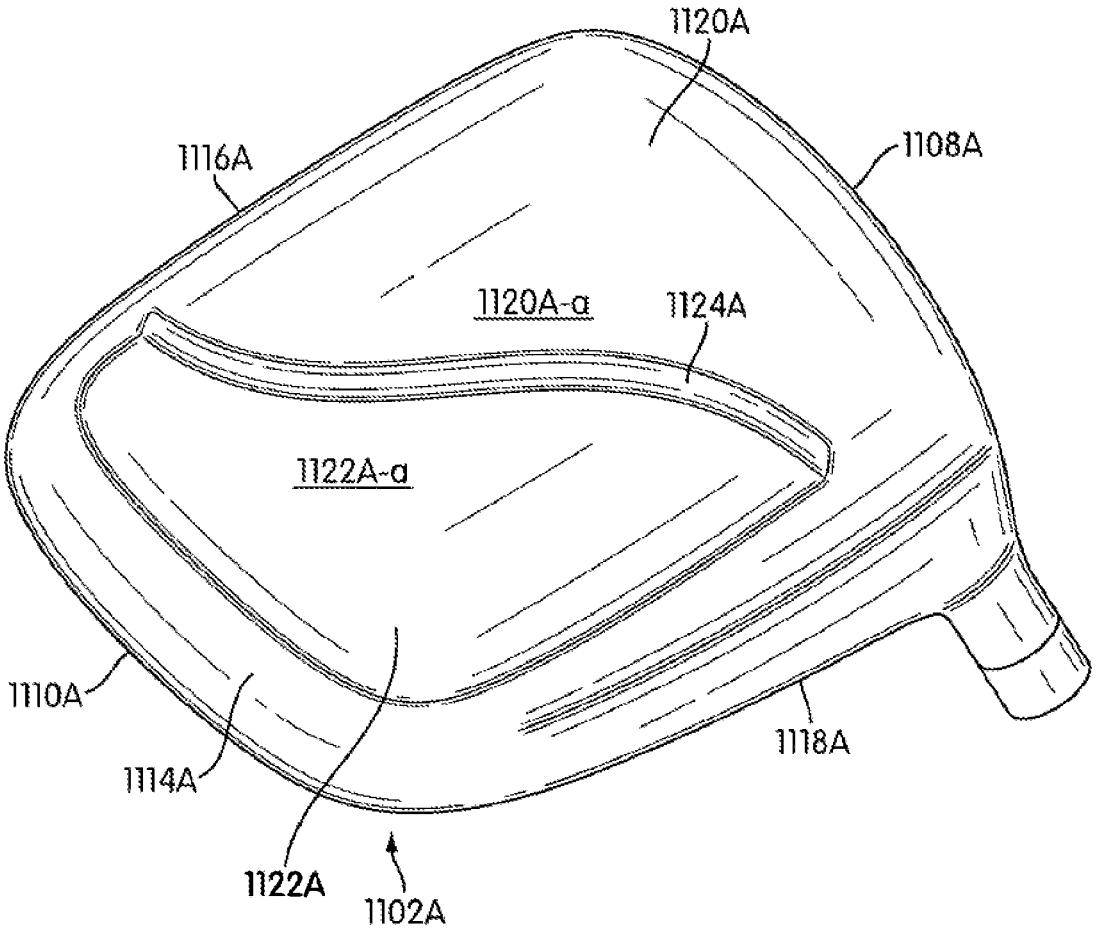
FIG. 11A generally illustrates another example golf club head structure in accordance with this disclosure.

FIG. 11A is an illustrative embodiment of a golf club head body 1102A wherein more mass and/or volume of the golf club head body is distributed toward the toe edge 1116A as compared with the heel edge 1118A. The portions of this golf club head body 1102A are similar to the embodiments described above and therefore, for the sake of brevity, will not be described in detail here.

Further, while some aspects of the disclosure are directed to golf club head bodies wherein the sole portion of the golf club head body is configured so that the golf club head body positions more mass and/or volume of the golf club head at a particular location (e.g., toward the heel edge or the rear side), other aspects of the disclosure are directed to golf club head bodies wherein the crown portion of the golf club head body is configured so that the golf club head body positions more mass and/or volume of the golf club head at a particular location (e.g., toward the heel edge or the rear side). An advantage of configuring the crown (instead of the sole) in such a fashion is that the same fade or draw biasing can be achieved, but the sole can be shaped in a conventional fashion to provide a stable surface upon which the club head body can rest while at an address position.

Figure 11B:
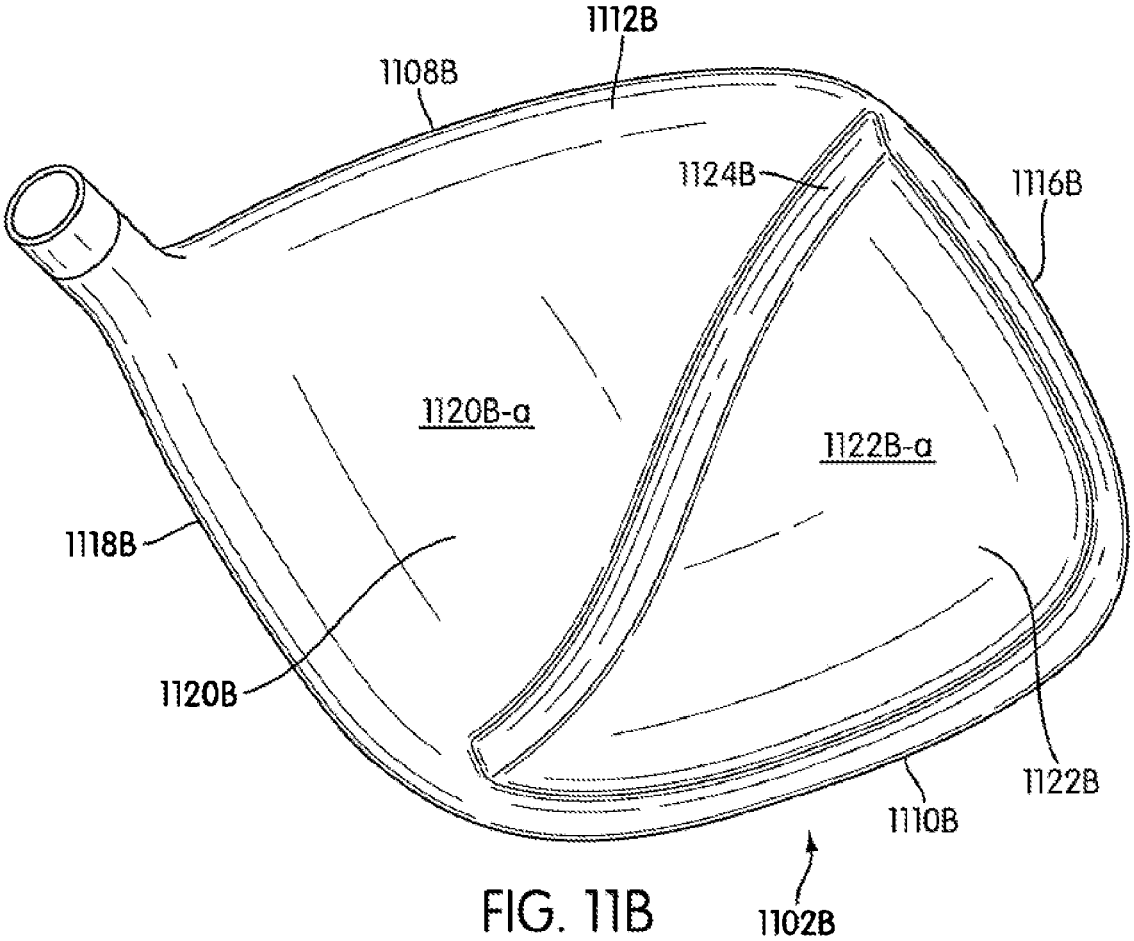
FIG. 11B generally illustrates another example golf club head structure in accordance with this disclosure.

FIG. 11B is an illustrative embodiment of a golf club head body 1102B wherein a crown portion 1112B of the golf club head body 1102B is configured so that the golf club head body positions more mass and/or volume of the golf club head toward the heel edge 1118B as compared with the toe edge 1116B.

Figure 11C:
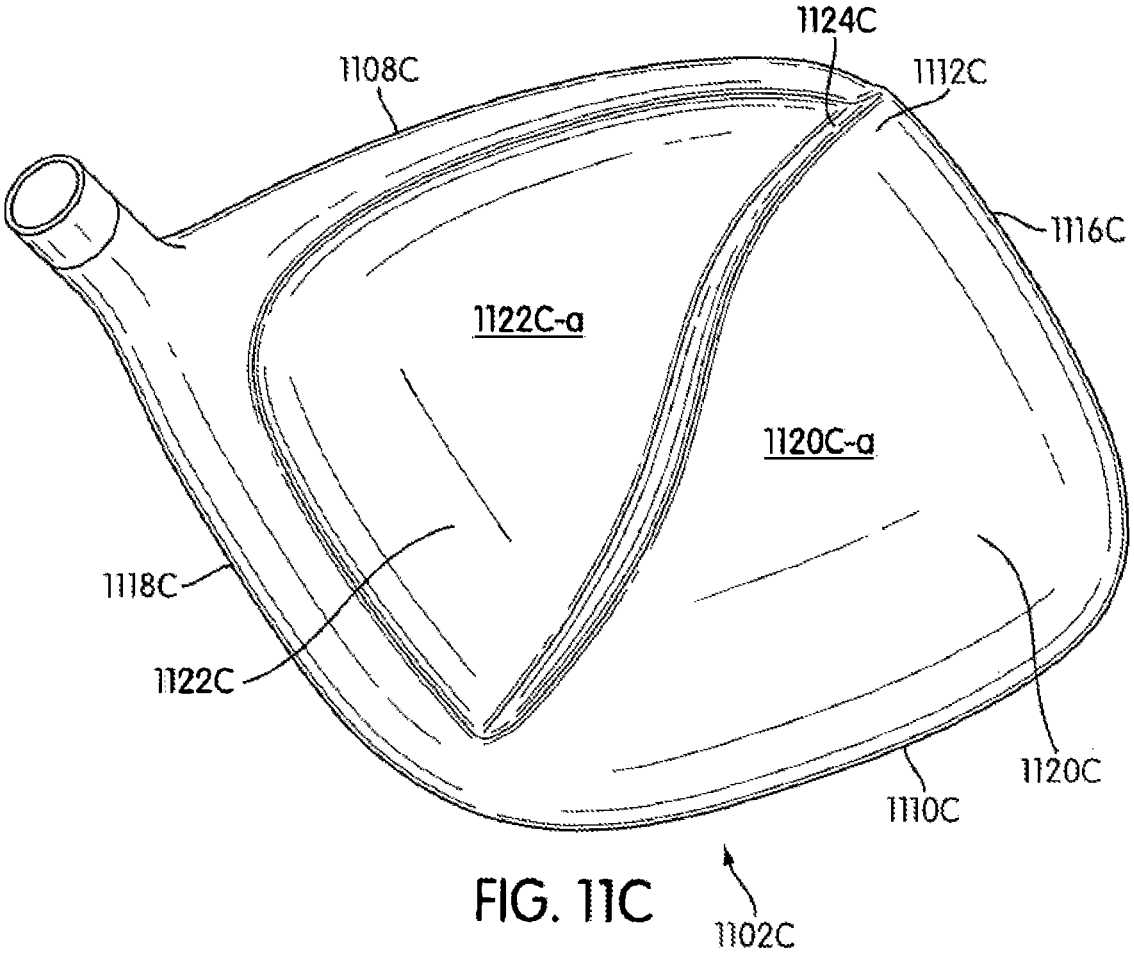
FIG. 11C generally illustrates another example golf club head structure in accordance with this disclosure.

Similarly, FIG. 11C is an illustrative embodiment of a golf club head body 1102C wherein a crown portion 1112C of the golf club head body 1102C is configured so that the golf club head body positions more mass and/or volume of the golf club head toward the toe edge 1116C as compared with the heel edge 1118C.

Figure 11D:
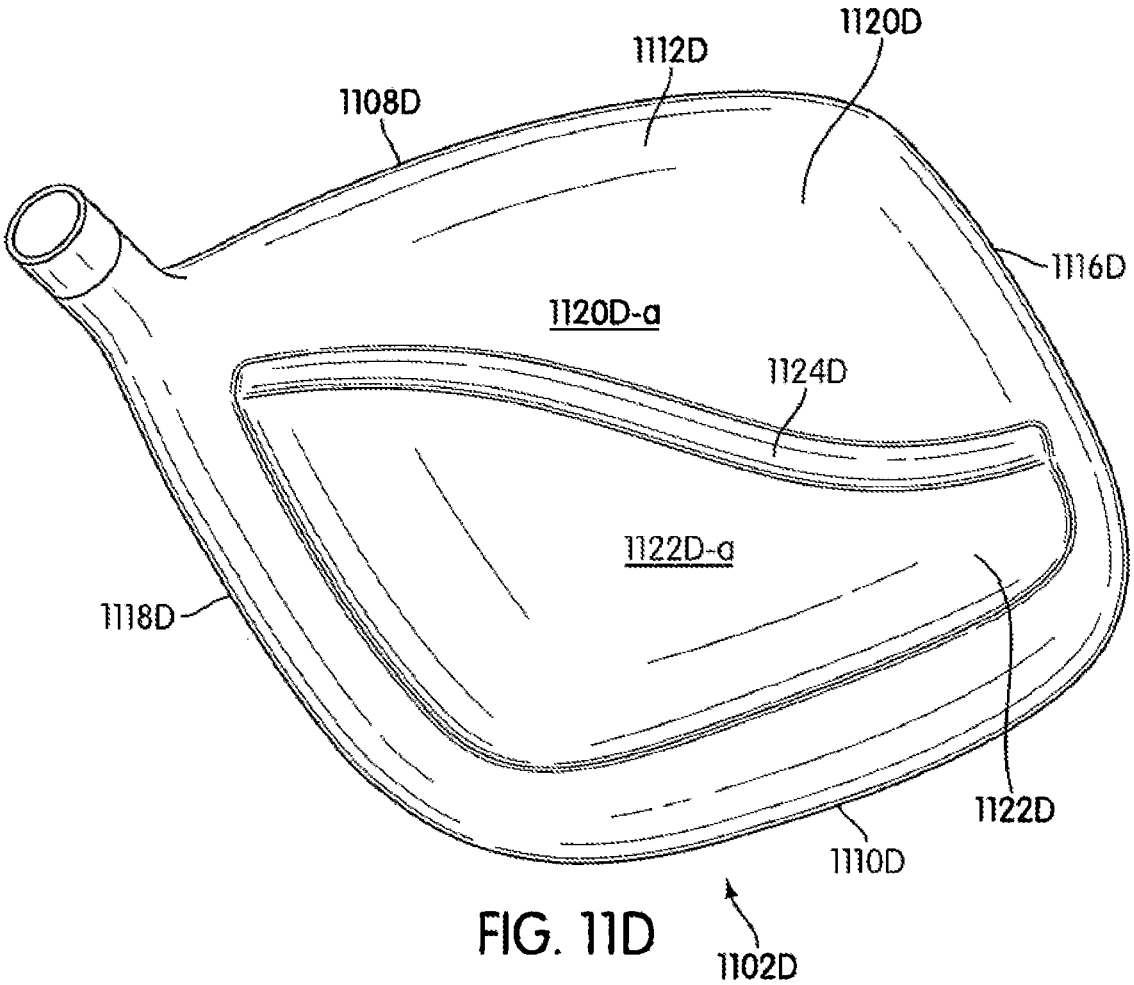
FIG. 11D generally illustrates another example golf club head structure in accordance with this disclosure.

Further, as described above, when the sole is configured to impart different ball flight trajectory biases, consideration should be given to the configuration to ensure stability when the club is in the address position. However, when the crown (instead of the sole) is configured, it allows other embodiments to be implemented without regard to the stability issues. Therefore, other embodiments, such as that shown in FIG. 11D can be implemented as well. The embodiment shown in FIG. 11D is similar to the embodiment shown in FIG. 11C in most respects except for the positioning of the sloped boundary portion 1124D and the first and second portions 1120D and 1122D.

Figure 11E:
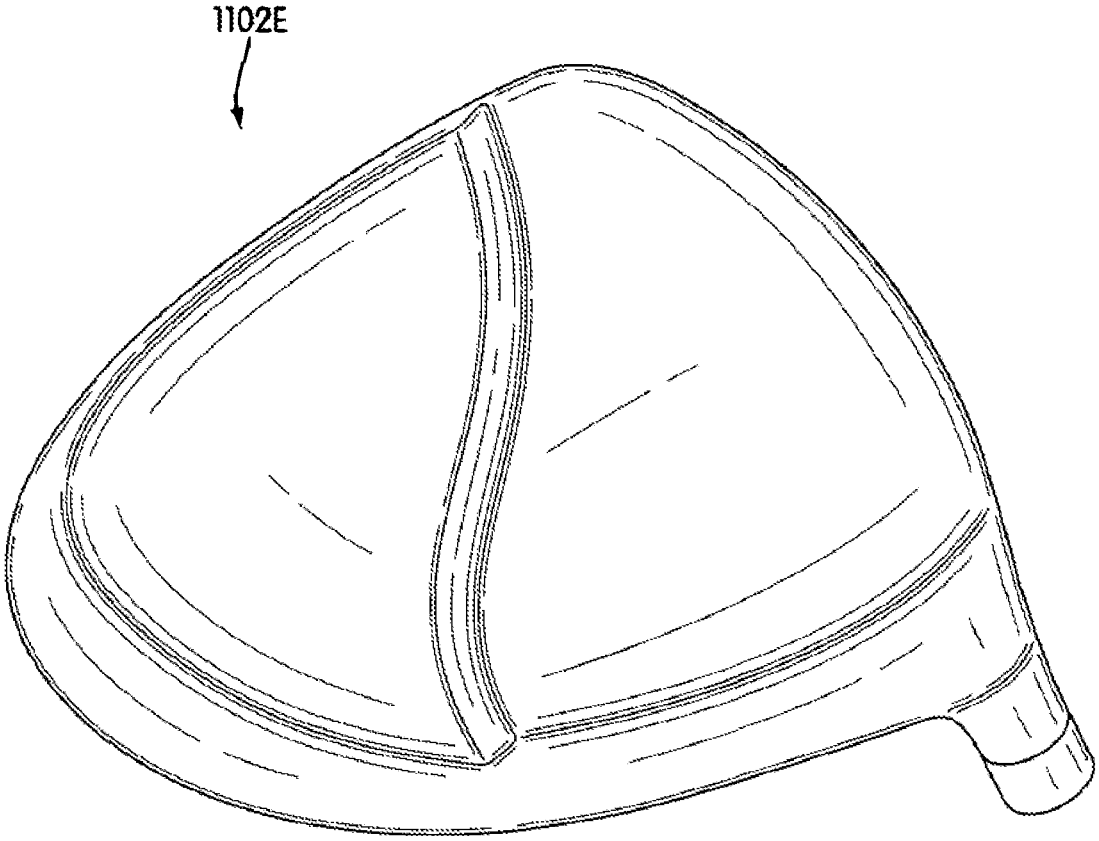
FIG. 11E generally illustrates another example golf club head structure in accordance with this disclosure.
Figure 11F:
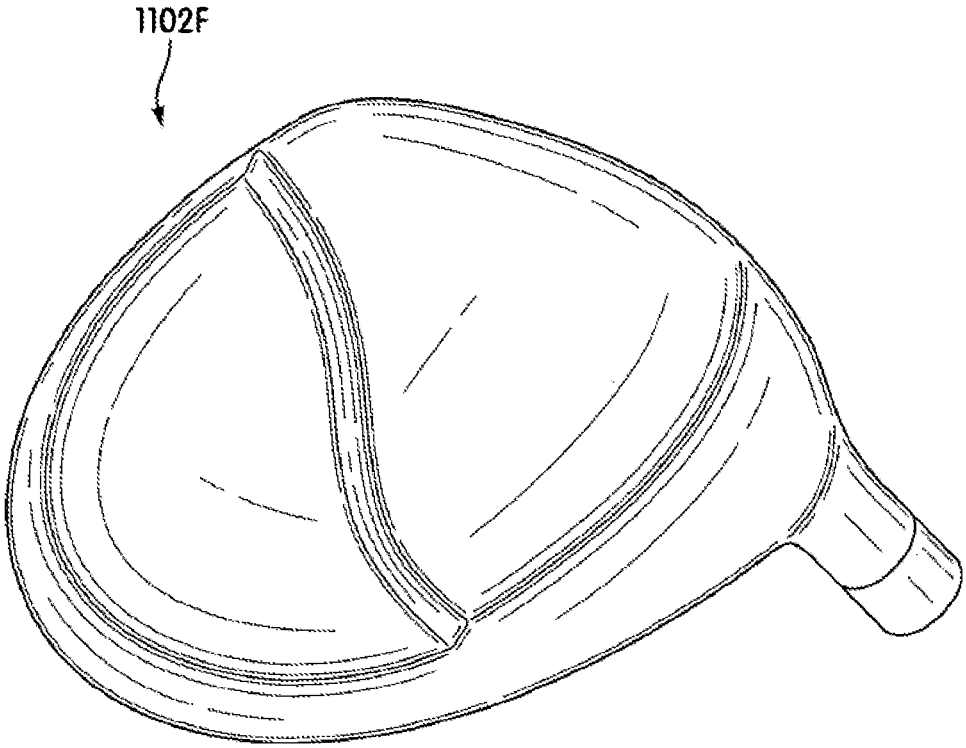
FIG. 11F generally illustrates another example golf club head structure in accordance with this disclosure.

While the embodiments shown and described have been made with reference to a square or rectangular shaped golf club head body, as mentioned above, this is merely one possibility, and other golf club head bodies within the scope of this disclosure could be shaped differently. For example, FIG. 11E illustrates an embodiment of this disclosure wherein golf club head body 1102E is a more conventional rounded shape. Further, the dimensions and/or other characteristics of a golf club head structure according to examples of this disclosure may vary significantly without departing from the disclosure. For example, any wood type club head may be provided including, for example: wood type hybrid clubs, fairway woods, drivers, etc. For instance, FIG. 11F illustrates a hybrid or fairway wood golf club head 1102F according to aspects of the present disclosure.

As described above, other aspects of this disclosure relate to golf club head structures wherein the mass and/or volume of the golf club head body are distributed so that the configuration of the club head body includes a "bump" portion and "indented" portion. The configuration of the golf club head ensures that more mass and/or volume of the golf club head is shifted toward the portion of the club head with the bump portion and away from the portion of the club head with the indented portion. In other words, the mass and/or volume of the golf club head body is distributed so as to position the center of gravity of the golf club head in a particular location and thereby create a particular ball flight trajectory bias.

Figure 12:
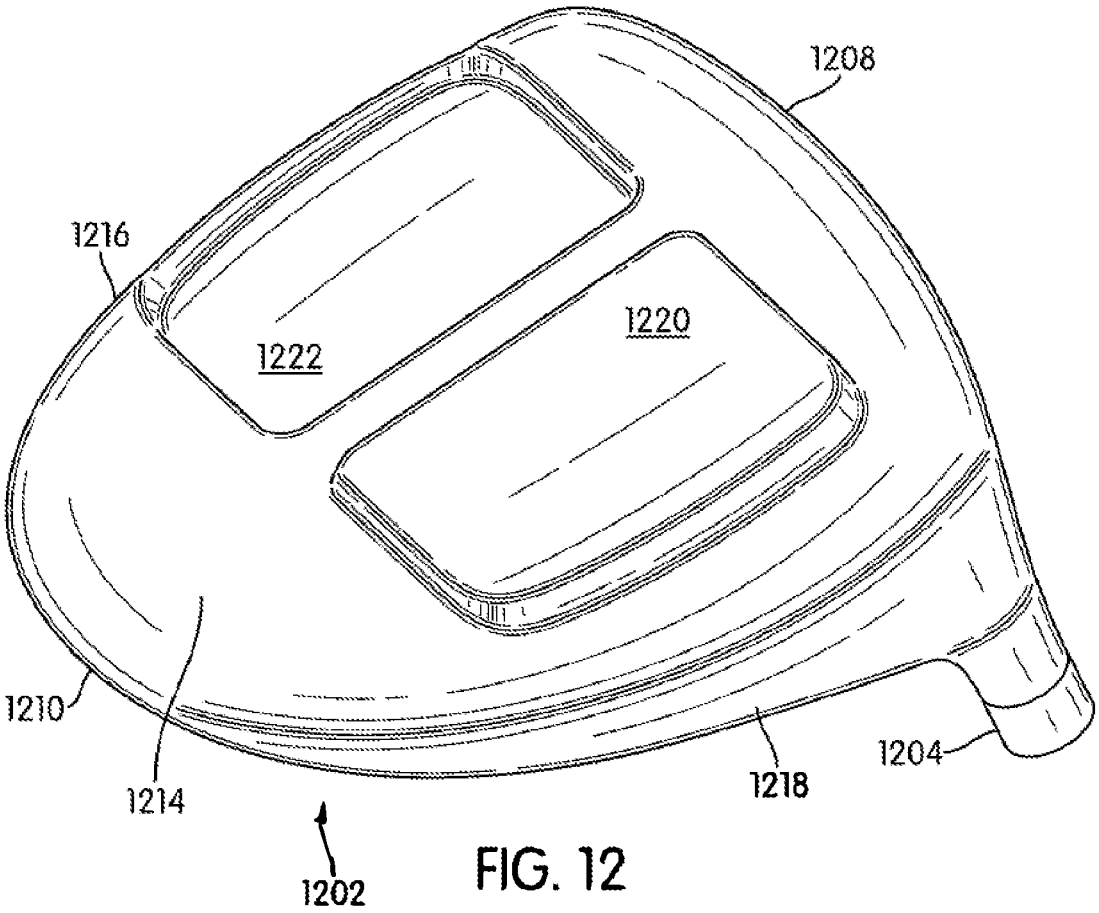
FIG. 12 generally illustrates another example golf club head structure in accordance with this disclosure.
Figure 13:
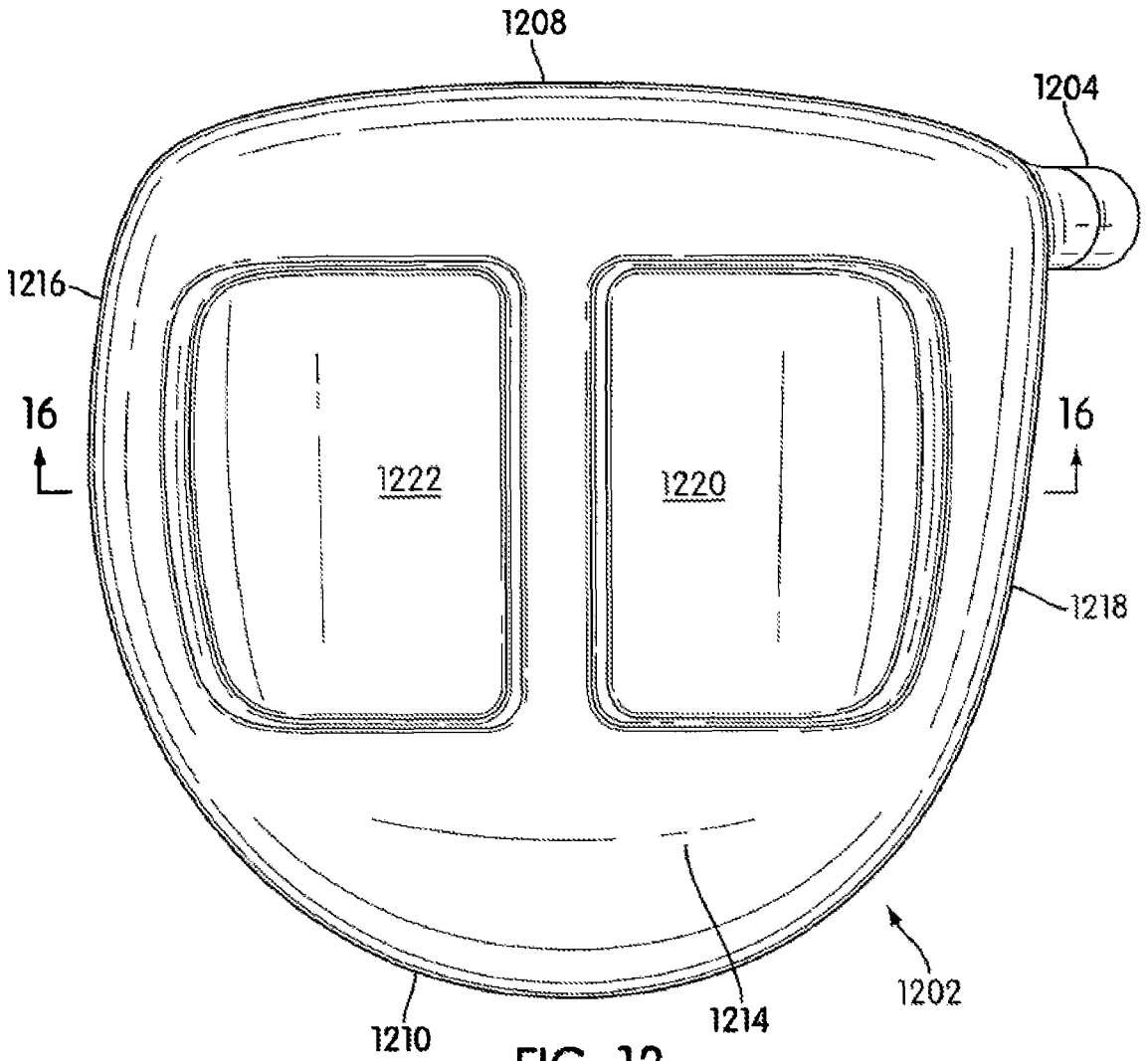
FIG. 13 is a bottom plan view of the golf club head structure shown in FIG. 12.
Figure 14:
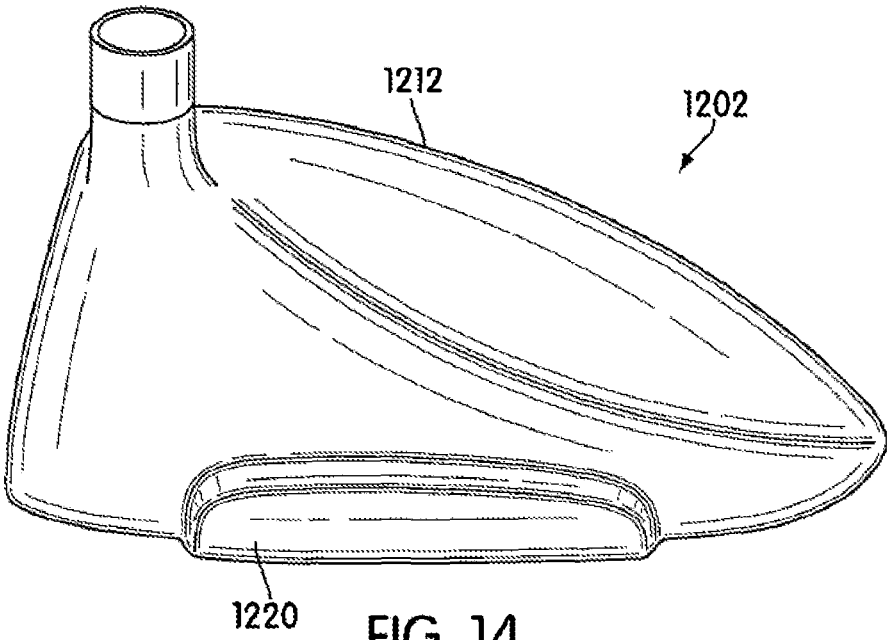
FIG. 14 is a heel view of the golf club head structure shown in FIG. 12.
Figure 15:
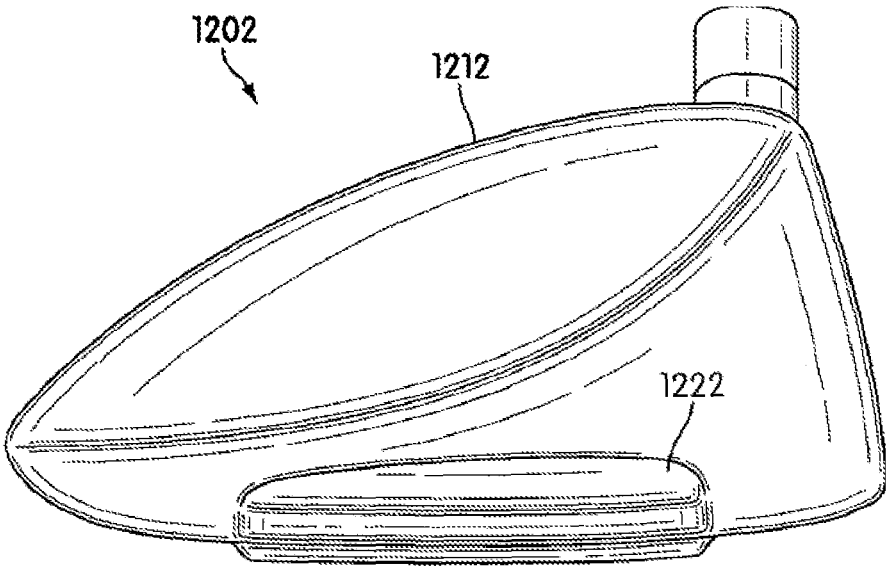
FIG. 15 is a toe view of the golf club head structure shown in FIG. 12.

FIGS. 12-15 generally illustrate an example of another wood-type golf club head 1202 in accordance with aspects of this disclosure. The club head body 1202 of this illustrated example includes a ball striking face portion 1208 at a front side thereof, a rear side 1210 opposite the front side, a crown (or top) portion 1212, a sole portion 1214, a toe side and toe edge 1216 and a heel side and heel edge 1218. As seen in FIGS. 12-13, the golf club head body 1202 may have a conventional shape (although this is not required). FIG. 14 is a heel side view of the golf club head body 1202 shown in FIG. 12 and FIG. 15 is a toe side view of this golf club head body 1202. FIGS. 14 and 15 more clearly show the profile and the crown portion 1212 of the golf club head body 1202.

Further, as seen in FIG. 12, the golf club head body 1202 has a sole portion 1214 configured so that it includes a "bump" portion 1220 and an "indented" portion 1222. The bump portion 1220 protrudes from the sole portion 1214 while the indented portion 1222 recedes into the sole portion 1214 and creates a recess in the sole portion 1214. Hence, the bump portion 1220 creates a portion of the golf club with an exaggerated depth or thickness (compared with a conventional golf club head and/or the base surface of the sole 1214) while the indented portion 1222 of the club head body creates a portion of the golf club with a reduced depth or thickness (compared with a conventional golf club head and/or the base surface of the sole 1214). According to at least some embodiments of this disclosure, the bump portion 1220 may protrude from the sole 1214 of the club head body by 2-50 mm. Similarly, the indented portion 1222 may recede into the sole portion by 2-50 mm. Therefore, when the club is at the address position (see e.g., FIG. 4), at least some portion of the first portion may be 4-100 mm lower than the second portion. In other example embodiments, this difference may be in the range of 8-90 mm, 12-80 mm, 16-70 mm and 24-60 mm. Further, according to at least some embodiments of this disclosure, the bump portion 1220 can constitute between 25-75% of the club head body's horizontal cross sectional area. Further, in some examples, the bump portion 1220 can constitute between 30-70%; between 35-65%, or even 40-60% of the club head body's horizontal cross sectional area. The indented portion 1222 can have dimensions falling within similar ranges.

The bump portion 1220 and the indented portion 1222 are configured so that a center of gravity of the club head body is nearer to one of the heel edge 1218 of the club head body or the toe edge 1216 of the club head body. For example, as seen in FIG. 12, the bump portion 1220 is nearer to the heel edge 1218 than the toe edge 1216 and the indented portion 1222 is nearer to the toe edge 1216 than the heel edge 1218 so that a majority of the volume and a majority of the mass of the club head body is nearer to the heel edge 1218 than the toe edge 1216. Therefore, this configuration shifts the center of gravity of the golf club head body 1202 nearer to the heel edge than with the toe edge. As a result, this configuration of the golf club head body can provide a draw biased trajectory to a golf ball when it is struck by the golf club head.

The dimensions and other characteristics of the bump and indented portions, 1220, 1222, will affect the distance that the center of gravity is shifted and, therefore, the amount of bias the golf club will impart to the golf ball. For example, the larger the dimensions of the bump and indented portions, 1220, 1222, the more the center of the gravity will be shifted. Conversely, the smaller the dimensions of the bump and indented portions, 1220, 1222, the less the center of the gravity will be shifted. Therefore, the amount of bias can be controlled or customized to fit particular swing types or golfer's tendencies. For example, for a golfer with a severe slice, the bump portion 1220 and the indented portions 1222 may have large dimensions (e.g., relatively large area, thickness, etc.) relative to the rest of the club head body 1202. This larger bump and indented portions, 1220, 1222 will shift the center of gravity dramatically and, therefore, compensate for the severity of the slice. Conversely, a golf club wherein the bump and indented portions, 1220, 1222 have smaller dimensions would be more appropriate if the golfer's slice is only relatively minor or for a typically straight driver of the ball that wants to promote more of a drawing type ball flight.

The bump portion may have an area of: at least 0.5 inches squared, at least 0.75 inches squared, at least 1.0 inches squared, at least 1.25 inches squared, at least 1.5 squared, or more. The indented portion may have an area of: at least 0.5 inches squared, at least 0.75 inches squared, at least 1.0 inches squared, at least 1.25 inches squared, at least 1.5 squared, or more.

According to some embodiments of the disclosure, the volume of the recess of the indented portion 1222 will be substantially the same as, or equal to the volume of the bump portion 1220. Therefore, the bump portion's depth/thickness can be exaggerated by the same amount of volume that the indented portion is recessed, while the overall volume of the club head body remains the same. For example, if the indented portion 1222 is recessed by a volume of X cubic centimeters, then the bump portion 1220 may be increased by a volume of X cubic centimeters and the overall volume of the golf club head will remain the same. However, it is noted that the bump and indented portions 1220, 1222 do not have to be enlarged or recessed by equal amounts or otherwise made of about the same size. For example, the bump portion 1220 may be exaggerated by an amount more or less than the volume of the indented portion 1222.

According to some aspects of the disclosure, the "bump" and the "indented" portions may be distinct from each other. For example, in the depicted embodiment of FIGS. 12-15, the bump portion 1220 and the indented portion 1222 are separated from each other by a base surface of the sole region 1214 so that the bump portion 1220 and the indented portion 1222 are positioned a distance apart from each other. As shown, the bump and indented portions 1220 and 1222 in this example structure are rectangularly shaped and separated from each other via a section of the sole portion 1214. In particular embodiments, the bump and indented portions, 1220 and 1222 may be positioned at least 5-50 mm apart. In other embodiments the bump and indented portions, 1220 and 1222, could be positioned 100 mm or more apart so that they are located at the edges of the sole portion 1214 in order to further affect the center of gravity and bias the golf club head. The bump and indented portions 1220 and 1222 also may extend along the side and/or crown surfaces of the club head.

In some embodiments, the bump and indented portions 1220 and 1222 may be positioned directly opposite from each other as shown in FIG. 12. For example, the indented portion 1222 and the bump portion 1220 may be symmetrical with each other relative to a centerline of the sole portion of the golf club head body through the geometric center of the club head. In other embodiments, they could be positioned offset from each other and/or at different orientations. In other words, one of the bump portion 1220 or the indented portion 1222 may be closer to the ball striking face while the other of the bump portion 1220 or the indented portion 1222 may be is closer to the rear side. Regardless of whether the bump and indented portions 1220 and 1222 are positioned directly opposite each other or offset from each other, they may be positioned at any point along the sole portion 1214 of the club head body 1202. For example, the bump and indented portions 1220 and 1222 can be positioned near the ball striking face portion 1208 or the rear side 1210. Such positioning of the bump and indented portions 1220, 1222 may affect the trajectory of the golf ball when it is struck by the golf club 1202. Therefore, such positioning would allow the golf club to be customized to match particular swing types and tendencies of golfers. For example, if the bump and indented portions 1220 and 1222 were positioned adjacent to the rear side of the club 1210, a different trajectory may be provided than if the bump and indented portions 1220 and 1222 were positioned adjacent to the face of the club 1208. Hence, it can be seen that various different trajectories could be provided to the golf ball in addition to the draw bias described above.

It is noted that the shape of the bump and indented portions also may affect the bias imparted to the golf ball when struck by the golf club. While the shapes of the bump and indented portions 1220 and 1222 shown in the drawings are rectangular, such a shape is not required. Instead, any suitable or desired shape such as circular, triangular, helical, irregular, etc. would be appropriate. In fact, it is noted that the bump portion and the indented portions, 1220, 1222 do not have to be the same shape. For example, the shape of the bump and indented portions, 1220, 1222 may follow the line of the perimeter of the golf club, so that the bump and indented portions are placed at the periphery of the golf club head. For example, if the bump and indented portions 1220, 1222 extend around the perimeter of the sole portion 1214 in a line, then the L-shaped or curved shape (depending on the shape of the club head body) of the bump and indented portions 1220, 1222, may be 5-25 mm wide and protrude from or recede into the sole portion 1214 by 5-25 mm in order to provide a particular club head weighting configuration. These dimensions are merely illustrative and other dimensions may be more appropriate depending upon the weighting configuration (and ball flight trajectory bias) desired. Hence, it is seen that size, shape, and positioning of the bump and indented portions, 1220, 1222 can be used in combination with each other in order to create a particular golf club head that will help impart a particular trajectory to the golf ball.

Figure 16A:
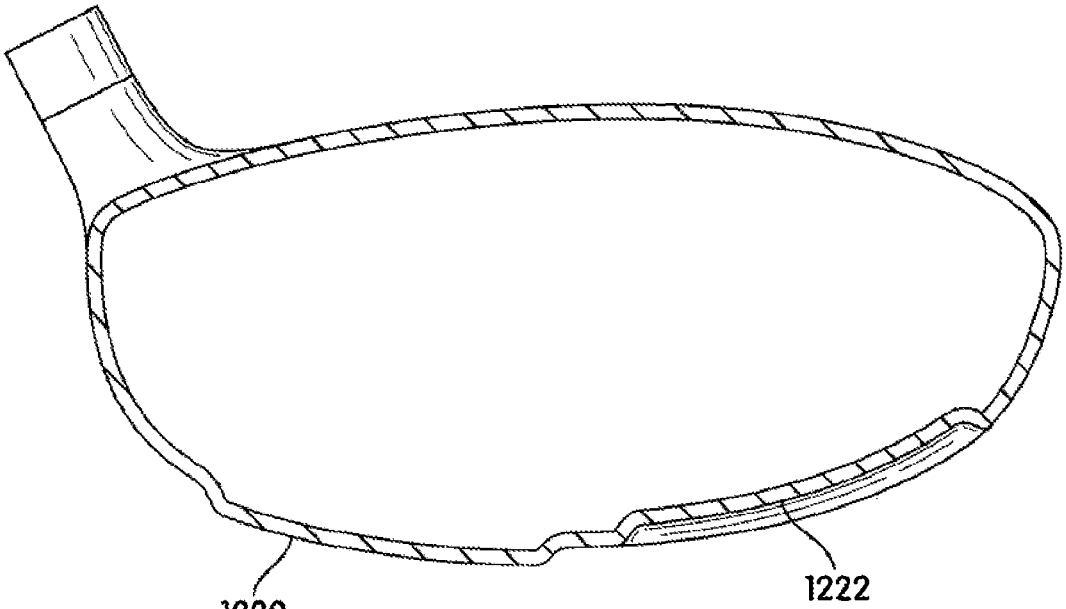
FIG. 16A is a cross sectional view of the golf club head structure taken along line 16-16 shown in FIG. 13.
Figure 16B:
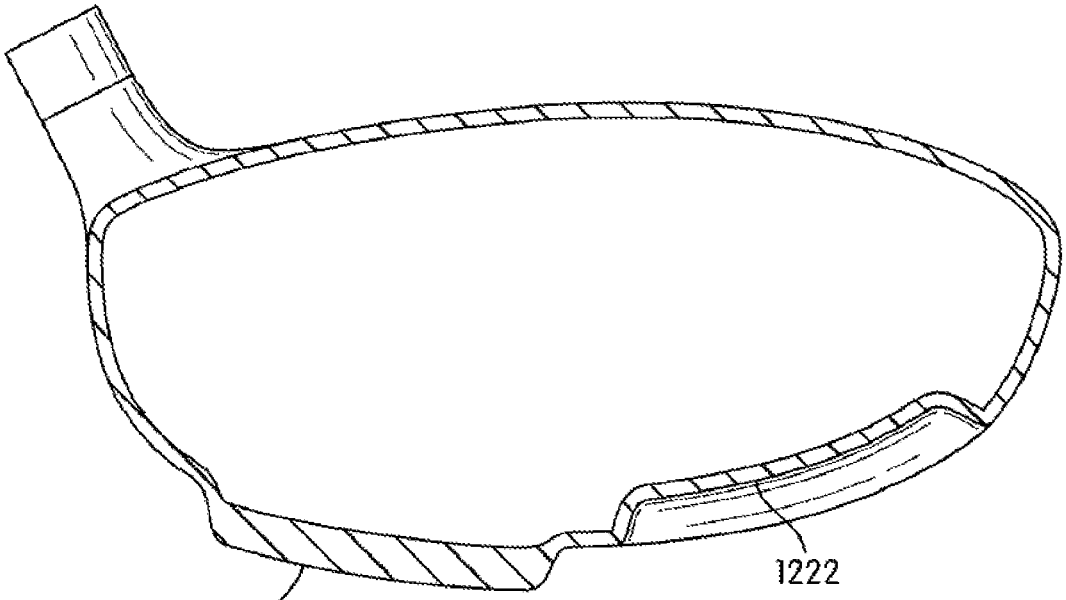
FIGS. 16B and 16C are cross sectional views of alternate golf club head structures.

FIG. 16A shows an embodiment where the cross sectional wall thickness between the bump portion and the indented portion has only a slight change. For example, the thickness of the wall of the bump portion 1220 may be between 0.05-10 mm, 0.5-9 mm; 0.8-5 mm; or 1-2 mm while the thickness of the wall of the indented portion 1222 may be between 0.025-9 mm; 0.05-8 mm, 0.75-4 mm or 0.5-1.5 mm. FIG. 16B shows an alternative embodiment wherein the cross sectional wall thickness of the bump portion 1220 is greater than the cross sectional wall thickness of the indented portion 1222. This difference in the cross sectional thickness of the bump and indented portions allows even more mass to be concentrated near the heel end portion 1218 of the golf club head 1202.

Further, according to at least some aspects of the disclosure, the bump portion 1220 is made of the same material as the rest of the golf club head body 1202. In such embodiments, the golf club head body would be formed in a conventional manner as described above. Such an embodiment is illustrated in FIG. 16A. In other embodiments, the bump portion 1220 may be made from and/or include a higher density material compared to the other portions of the golf club head body 1202. For example, the bump portion 1220 may be integral with the golf club head body and constructed of a higher density material. For example, different materials such as composites, polymers or various metals can be used to make the bump portion 1220 while the remainder of the golf club head body 1202 can be made of a different composite, polymer or metal material that is generally lighter.

Figure 16C:
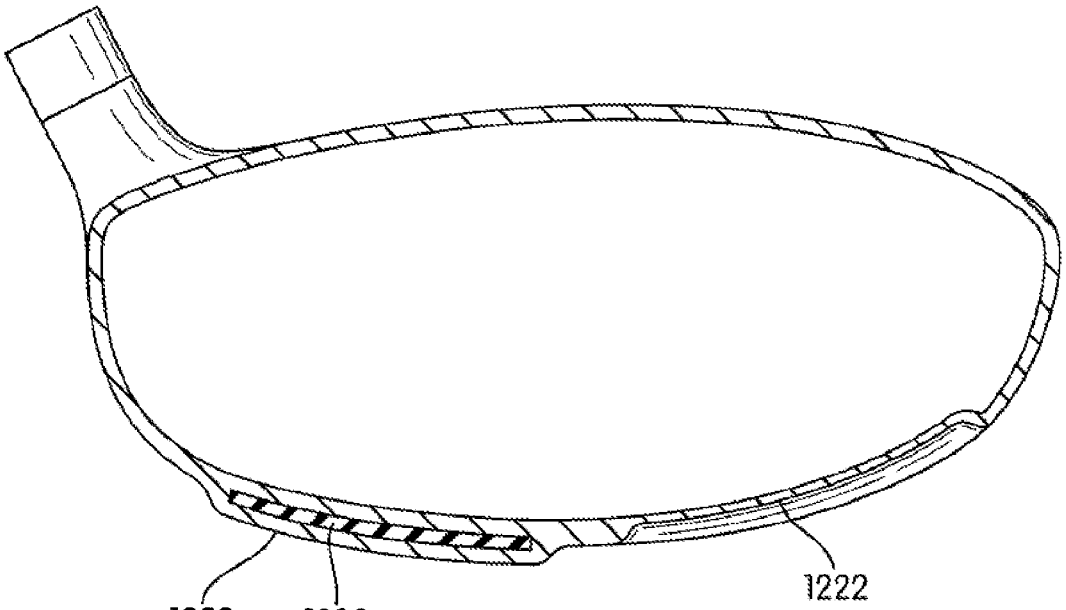

Alternatively, the bump portion 1220 may be filled with or contain a higher density material 1230, for example, as shown in FIG. 16C. In this example structure, the bump portion 1220 may be formed with a distinct cavity that is filled with the higher density material 1230. In such an embodiment, the bump portion surrounding the cavity may be made from the same material as the remainder of the golf club or, alternatively, it may be formed from a different material.

According to some embodiments, the higher density material 1230 that fills the cavity in the bump portion 1220 may be removable. For example, a higher density material 1230, such as a weight, may be snap fit or otherwise attached to the bump portion. In such an arrangement, various weights could be used to adjust different biases in the golf club. Therefore, as the slice was corrected, the different weights could be replaced to account for the corrected swing. In other words, lighter weights could be used if the slice decreased (and the user's swing improved) over time. If desired, the higher density material or weight 1230 may be openly exposed at the exterior of the club head body, e.g., to allow easy interaction, attachment, removal, etc.

While some aspects of the disclosure are directed to golf club head bodies wherein the sole portion is configured so that the golf club head body positions more mass and/or volume of the golf club head at a particular location (e.g., toward the heel side), other aspects of the disclosure are directed to golf club head bodies wherein the rear portion is configured so that the golf club head body positions more mass and/or volume of the golf club head at a particular location (e.g., toward the heel side). Further, as described above, aspects of this disclosure, relate to golf club head structures wherein the mass and/or volume of the golf club head body are distributed so that the configuration of the club head body includes a "bump" portion and an "indented" portion. Therefore, according to particular embodiments of this disclosure, the bump or indented portion may be positioned on the rear portion of the golf club as opposed to the sole or crown portion of the golf club head. An advantage of configuring the bump or indented portion of the rear portion (instead of the sole) in such a fashion is the same draw bias (or other bias) can be achieved, but the majority (if not all) of the sole can be shaped in a conventional fashion to provide a stable surface upon which the club head body can rest while at an address position and/or while contacting the ground during a swing.

Figure 17:
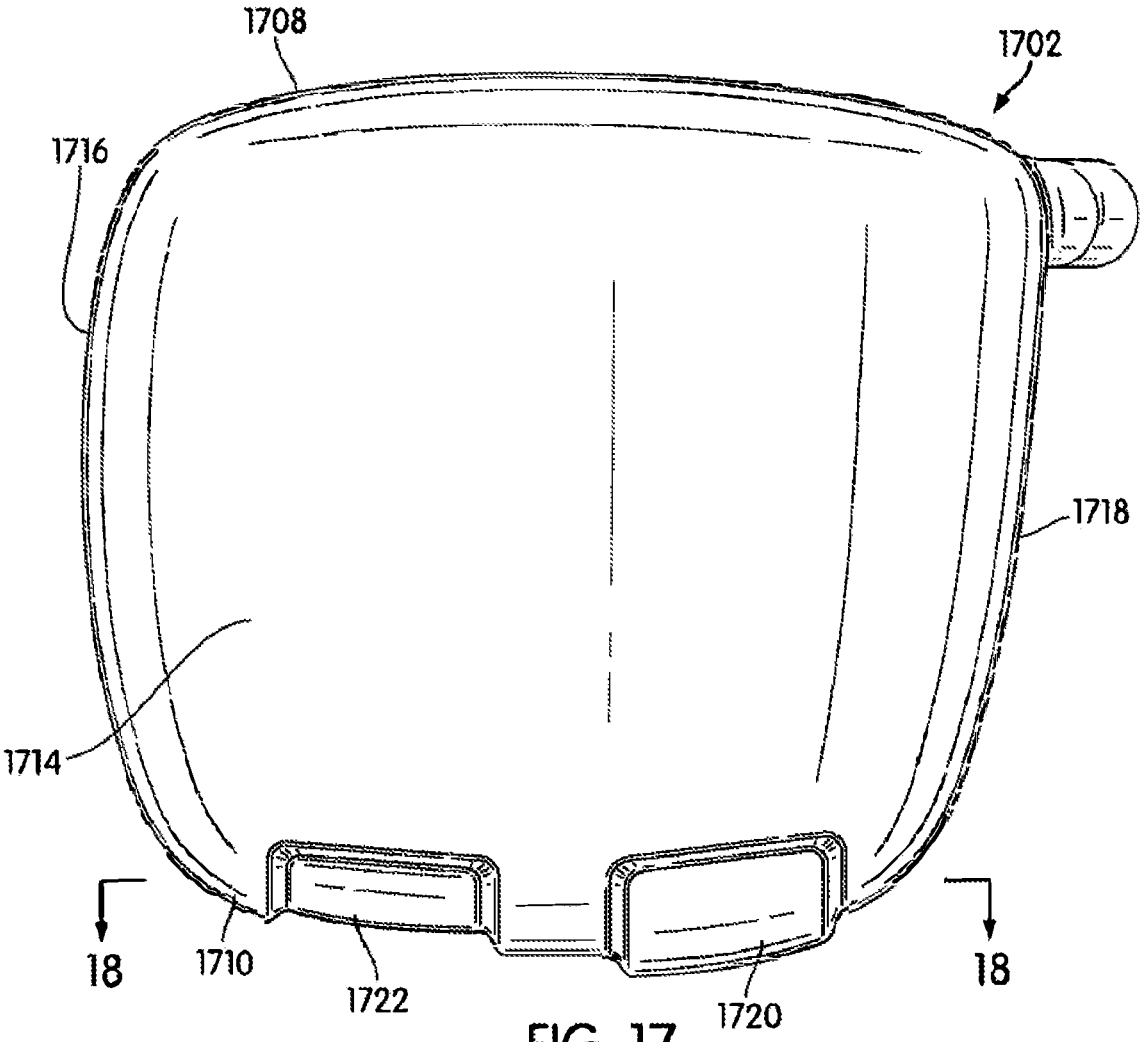
FIG. 17 generally illustrates another example golf club head structure in accordance with this disclosure.
Figure 18:
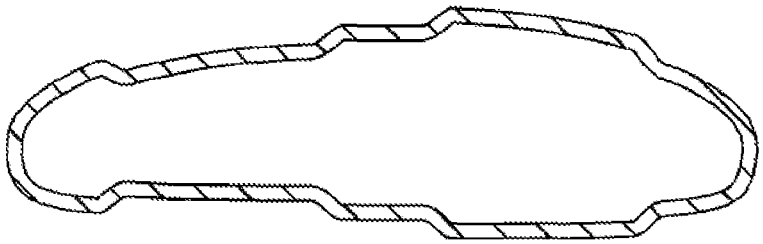
FIG. 18 is a cross sectional view of the golf club head structure taken along line 18-18 shown in FIG. 17.

FIGS. 17-18 generally illustrate an example of such a wood-type golf club head 1702 in accordance with the disclosure. The club head body 1702 of this illustrated example includes a ball striking face portion 1708 at a front side thereof, a rear side 1710 opposite the front side, a crown (or top) portion 1712, a sole portion 1714, a toe side and toe edge 1716 and a heel side and heel edge 1718. As seen in FIG. 17, the golf club head body 1702 may have a generally rectangular or square shape (although this is not required).

Further, as seen in FIG. 17, the golf club head body 1702 has its rear side 1710 configured so that it includes a "bump" portion 1720 and a "indented" portion 1722. The bump portion 1720 protrudes from the rear side 1710 while the indented portion 1722 recedes into the rear side 1710 and creates a recess in the rear portion 1710. Hence, the bump portion 1720 creates a portion of the golf club with an exaggerated breadth (compared with a conventional golf club head and/or the base surface of the rear side 1710) while the indented portion 1722 of the club head body creates a portion of the golf club with a reduced breadth (compared with a conventional golf club head and/or the base surface of the rear side 1710). In other words, the breadth of the bump portion 1720 measured from the ball striking face portion 1708 to the rear portion 1710 is greater than the breadth of the indented portion 1722 measured from the ball striking face portion 1708 to the rear portion 1710.

According to at least some embodiments of this disclosure, the bump portion 1720 may protrude from the rear of the club head body by 2-50 mm. Similarly, the indented portion 1722 may recede into the rear portion by 2-50 mm. The bump portion and the indented portion are configured so that a center of gravity of the club head body is nearer to one of the heel edge 1718 of the club head body or the toe edge 1716 of the club head body. In this illustrated example, the bump portion 1720 is nearer to the heel edge 1718 than the toe edge 1716 and the indented portion 1722 is nearer to the toe edge 1716 than the heel edge 1718 so that a majority of the volume and/or a majority of the mass of the club head body is nearer to the heel edge than the toe edge. Therefore, this configuration shifts the center of gravity of the golf club head body 1702 nearer to the heel edge as compared with the toe edge. As a result, this configuration of the golf club head body may help provide a draw biased trajectory to a golf ball when it is struck by the golf club head.

The dimensions of the bump and indented portions 1720, 1722 will affect the distance that the center of gravity is shifted. For example, the larger the dimensions of the bump and indented portions 1720, 1722, the more the center of the gravity will be shifted. Conversely, the smaller the dimensions of the bump and indented portions 1720, 1722, the less the center of the gravity will be shifted. Therefore, the location of the center of gravity of the club head can be controlled or customized to fit particular swing types or golfer's tendencies. For example, for a golfer with a severe slice, the bump portion 1720 and the indented portion 1722 may have large dimensions (e.g., area, thickness, etc.) relative to the rest of the club head body 1702. These larger bump and indented portions 1720, 1722 will shift the center of gravity dramatically and, therefore, help compensate for the severity of the slice. Conversely, a golf club wherein the bump and indented portions, 1720, 1722 have smaller dimensions would be more appropriate if the golfer's slice is only relatively minor and/or for straight hitters that wish to promote a more drawing ball flight. According to some embodiments of the disclosure, the volume of the recess of the indented portion 1722 is substantially the same as, or equal to, the volume of the bump portion 1720. Therefore, the bump portion's depth/thickness can be exaggerated by about the same amount of volume that the indented portion is recessed, while the overall volume of the club head body remains the same. For example, if the indented portion 1722 is recessed by a volume of X cubic centimeters, then the bump portion 1720 may be increased by a volume of X cubic centimeters and the overall volume of the golf club head will remain the same. However, it is noted that the bump and indented portions 1720, 1722 do not have to be enlarged or recessed by equal amounts. For example, the bump portion 1720 may be exaggerated by an amount more or less than the volume of the indented portion 1722.

The bump portion may have an area of: at least 0.5 inches squared, at least 0.75 inches squared, at least 1.0 inches squared, at least 1.25 inches squared, at least 1.5 squared, or more. The indented portion may have an area of: at least 0.5 inches squared, at least 0.75 inches squared, at least 1.0 inches squared, at least 1.25 inches squared, at least 1.5 squared, or more.

According to some aspects of the disclosure, the "bump" and the "indented" portions may be distinct from each other. For example, in the depicted embodiment, the bump portion 1720 and the indented portion 1722 are separated from each other by a surface of the rear portion 1710 so that the bump portion 1720 and the indented portion 1722 are positioned a distance apart from each other. As shown, the bump and indented portions 1720 and 1722 are rectangularly shaped and separated from each other via a section of the rear portion 1710. In particular embodiments, the bump and indented portions, 1720 and 1722, may be positioned at least 10-50 mm apart. In other embodiments the bump and indented portions, 1720 and 1722, could be positioned 100 mm or more apart so that they are located at the edges of the rear side 1710 (or even extend around to the heel and/or toe sides of the club head) in order to further affect the center of gravity and bias the golf club head.

In some embodiments, the bump and indented portions 1720 and 1722 may be positioned directly opposite from each other as shown in FIG. 17. For example, the indented portion and the bump portion may be symmetrical with each other relative to a geometric centerline of the rear portion of the golf club head body. In other embodiments, they could be positioned offset from each other. Regardless of whether the bump and indented portions 1720 and 1722 are positioned directly opposite each other or offset from each other, they may be positioned at any point along the rear portion 1710 including at least partially on the crown portion 1712 or the sole portion 1714 of the club head body 1702. Such positioning of the bump and indented portions 1720, 1722 may further affect the trajectory of the golf ball when it is struck by the golf club 1702 (e.g., the flight of the golf ball). Therefore, such positioning would allow the golf club to be configured and customized to match particular swing types and tendencies of golfers.

It is noted that the shape of the bump and indented portions also may affect the bias imparted to the golf ball when struck by the golf club. While the shape of the bump and indented portions 1720 and 1722 shown in the drawings is rectangular, such a shape is not required. Instead, any suitable or desired shape such as circular, triangular, helical, irregular, etc. would be appropriate. In fact, it is noted that the bump portion and the indented portions, 1720, 1722 do not have to be the same shape. Hence, it is seen that size, shape, and positioning of the bump and indented portions 1720, 1722 can be used in combination with each other in order to create a particular golf club head that will help impart a particular trajectory to the golf ball.

According to one embodiment of this disclosure, the cross sectional wall thickness between the bump and the indented portion 1720, 1722 has only a slight change. For example, the thickness of the wall of the bump portion 1720 may be between 0.05-10 mm, 0.5-9 mm; 0.8-5 mm; or 1-2 mm while the thickness of the wall of the second portion may be between 0.025-9 mm; 0.05-8 mm, 0.75-4 mm or 0.5-1.5 mm. In an alternative embodiment, the cross sectional thickness of the rear region of the bump portion 1720 may be greater than the cross sectional thickness of the wall of the rear region of the indented portion 1722. This difference in the cross sectional wall thickness of the wall of the respective rear regions allows even more mass to be concentrated near the heel edge 1718 of the golf club head 1702.

Further, according to at least some aspects of the disclosure, the bump portion 1720 is made of the same material as the rest of the golf club head body 1702. In such embodiments, the golf club head body would be formed in a conventional manner as described above. In other embodiments the bump portion 1720 may include a higher density material compared to the other portions of the golf club head body 1702. For example, the bump portion 1720 may be integral with the golf club head body and constructed of a higher density material. For example, different materials such as composites, polymers or various metals can be used to make the bump portion 1720 while the remainder of the golf club head body 1702 may made of a different composite, polymer or more lightweight metal materials.

Alternatively, the bump portion 1720 may be filled with or contain a higher density material. For example, according to some aspects of the disclosure, the bump portion 1720 may be formed with a distinct cavity that is filled with the higher density material in a manner similar to that shown in FIG. 16C. In such an embodiment, the bump portion surrounding the cavity may be made from the same material as the remainder of the golf club or alternatively it may be formed from a different material.

According to some embodiments, the higher density material that fills the cavity in the bump portion may be removable. For example, a higher density material, such as a weight, may be snap fit or otherwise attached to the bump portion. In such an arrangement, various weights could be used to adjust different biases in the golf club. Therefore, as the slice was corrected, the different weights could be replaced to account for the corrected swing. In other words, lighter weights could be used if the slice decreased over time (and the user's swing improved). If desired, the higher density material or weight may be openly exposed at the exterior of the club head body, e.g., to allow interaction, attachment, removal, etc.

While some aspects of the present disclosure are directed to golf club head bodies that position more mass and/or volume of the golf club head toward the heel edge as compared with the toe edge, other aspects of the disclosure are directed to golf club head bodies that position more mass and/or volume of the golf club head toward the toe edge as compared with the heel edge. Such a configuration shifts the center of gravity of the golf club head body closer to the toe edge as compared with the heel edge. As a result, this configuration of the golf club head body can provide a fade biased trajectory to a golf ball when it is struck by the golf club head. Therefore, according to at least some aspects of this disclosure, a golf club head body has a "bump" portion that extends or protrudes from the golf club head body at a toe side thereof, and an "indented" portion that recedes into the golf club head body at a heel side thereof. This configuration will help create a fade biased trajectory for a golf ball struck by the golf club head body. FIG. 19 generally illustrates an example of such a wood-type golf club head 1902A in accordance with this example of the disclosure. The portions of this golf club head body 1902A are similar to the embodiments described above and therefore, for the sake of brevity, will not be described in detail here.

Figure 19A:
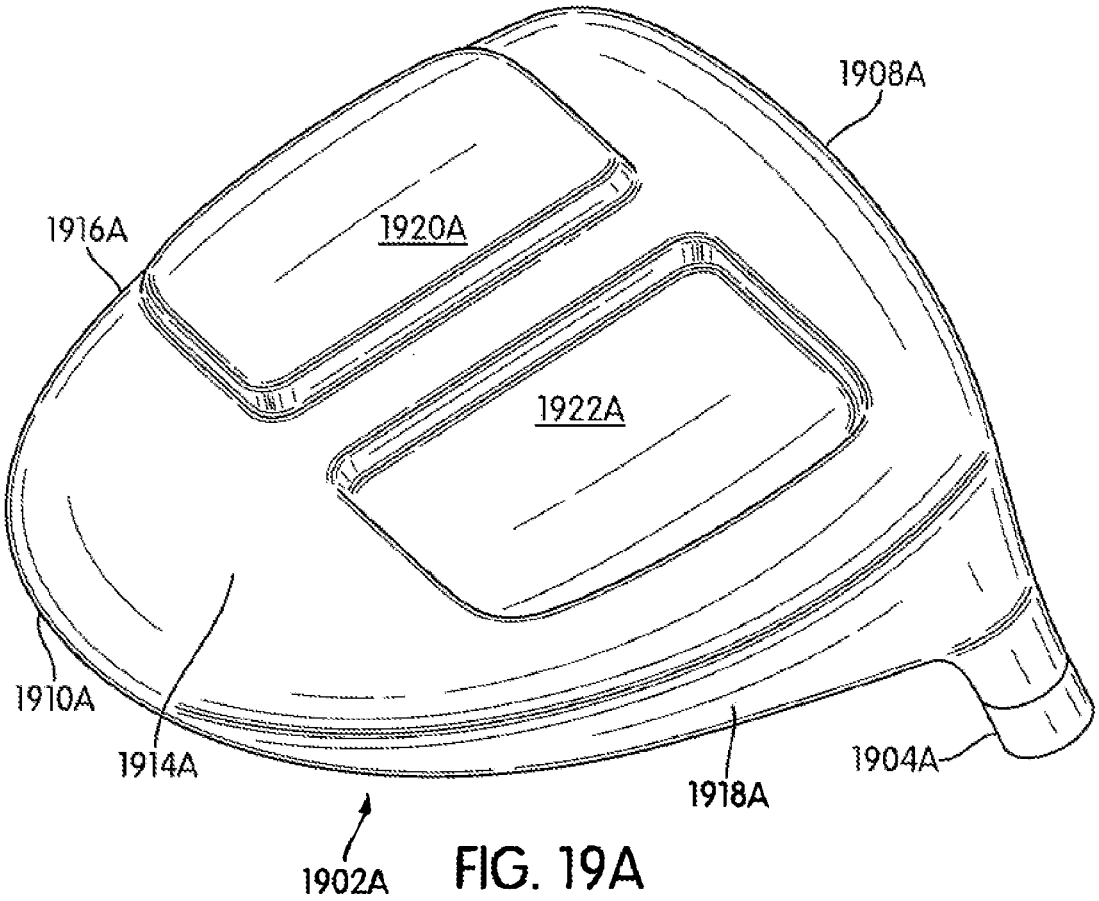
FIG. 19A generally illustrates another example golf club head structure in accordance with this disclosure.
Figure 19B:
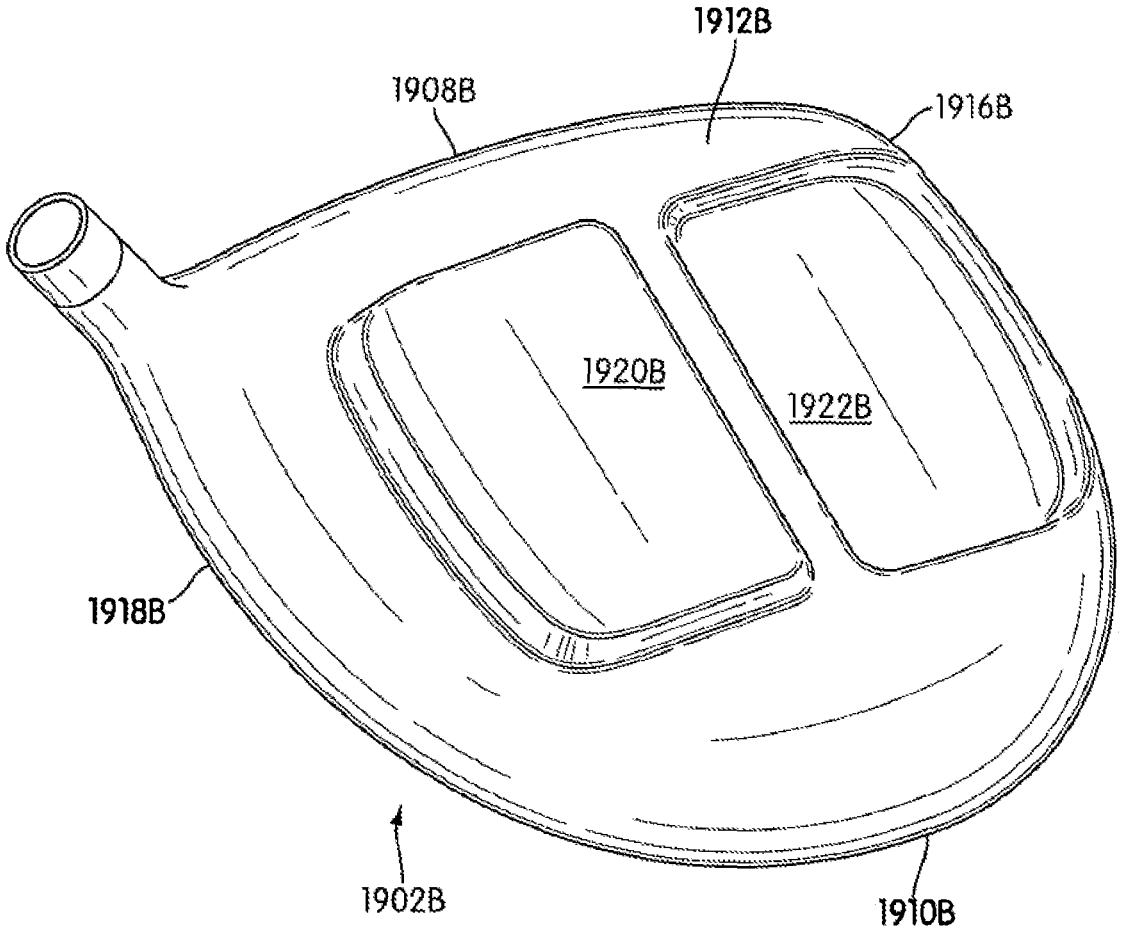
FIG. 19B generally illustrates another example golf club head structure in accordance with this disclosure.
Figure 19C:
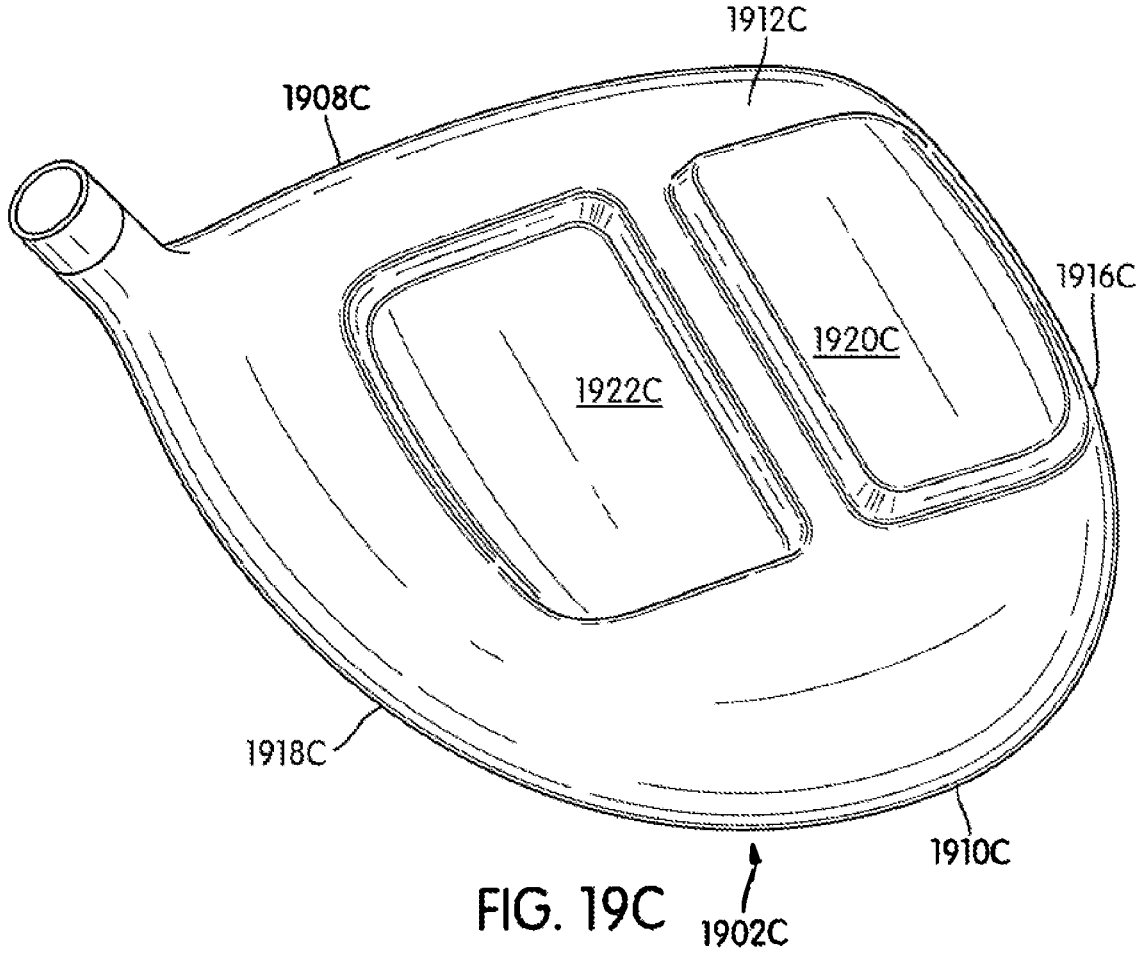
FIG. 19C generally illustrates another example golf club head structure in accordance with this disclosure.

Further, while some aspects of the disclosure are directed to golf club head bodies in which the sole portion is configured so that the golf club head body positions more mass and/or volume of the golf club head at a particular location (e.g., toward the heel side or the rear side), other aspects of the disclosure are directed to golf club head bodies wherein the crown portion is configured so that the golf club head body positions more mass and/or volume of the golf club head at a particular location (e.g., toward the heel side or the rear side). In other words, the bump and indented portions may be positioned on the crown portion of the golf club as opposed to the sole portion of the golf club head. An advantage of configuring the crown (instead of the sole) in such a fashion is that the same fade or draw biasing can be achieved, but the sole can be shaped in a conventional fashion to provide a stable surface upon which the club head body can rest while at an address position and/or when it contacts the ground during a swing. FIGS. 19B and 19C generally illustrate examples of such wood-type golf club heads 1902B and 1902C in accordance with these examples of the disclosure.

Figure 19D:
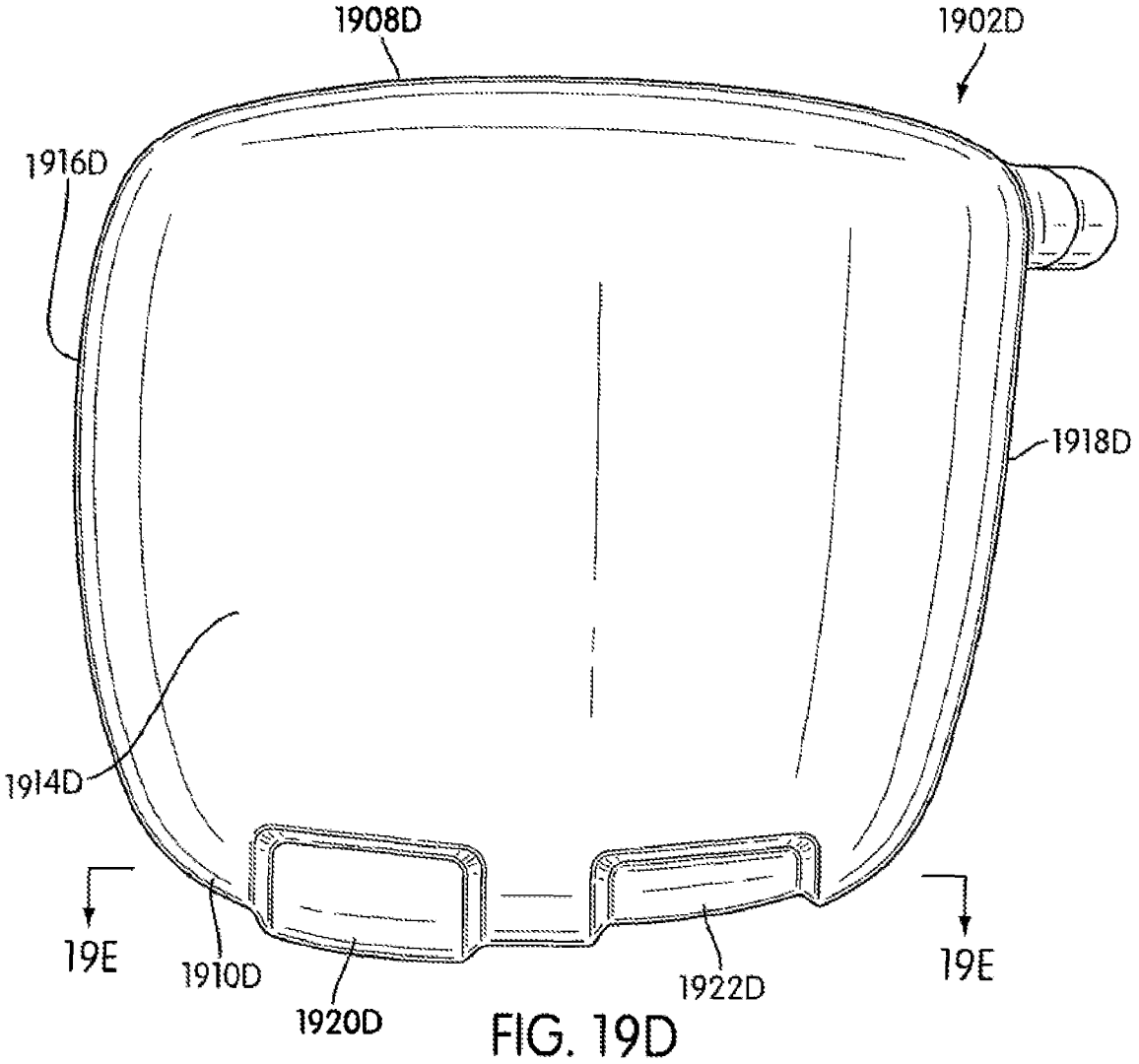
FIG. 19D generally illustrates another example golf club head structure in accordance with this disclosure.
Figure 19E:
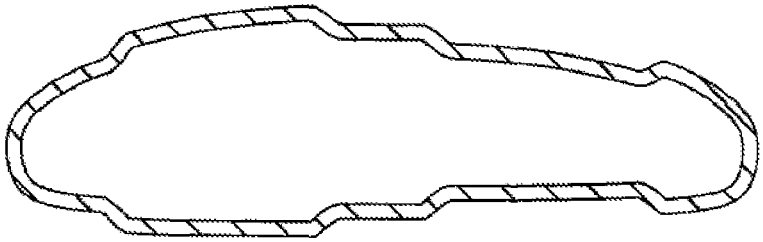
FIG. 19E is a cross sectional view of the golf club head structure taken along line 19E-19E shown in FIG. 19D.

According to at least some aspects of this disclosure, a golf club head body has a "bump" portion that extends or protrudes from the golf club head body at a toe side of the golf club head body, and an "indented" portion that recedes into the golf club head body at a heel side thereof. Hence, this configuration will help create a fade biased trajectory for a golf ball struck by the golf club head body. FIGS. 19D-19E generally illustrate an example of such a wood-type golf club head 1902D in accordance with this example of the disclosure. Such a structure 1902D may have features and characteristics similar to these described above for FIGS. 17 and 18.

Figure 20:
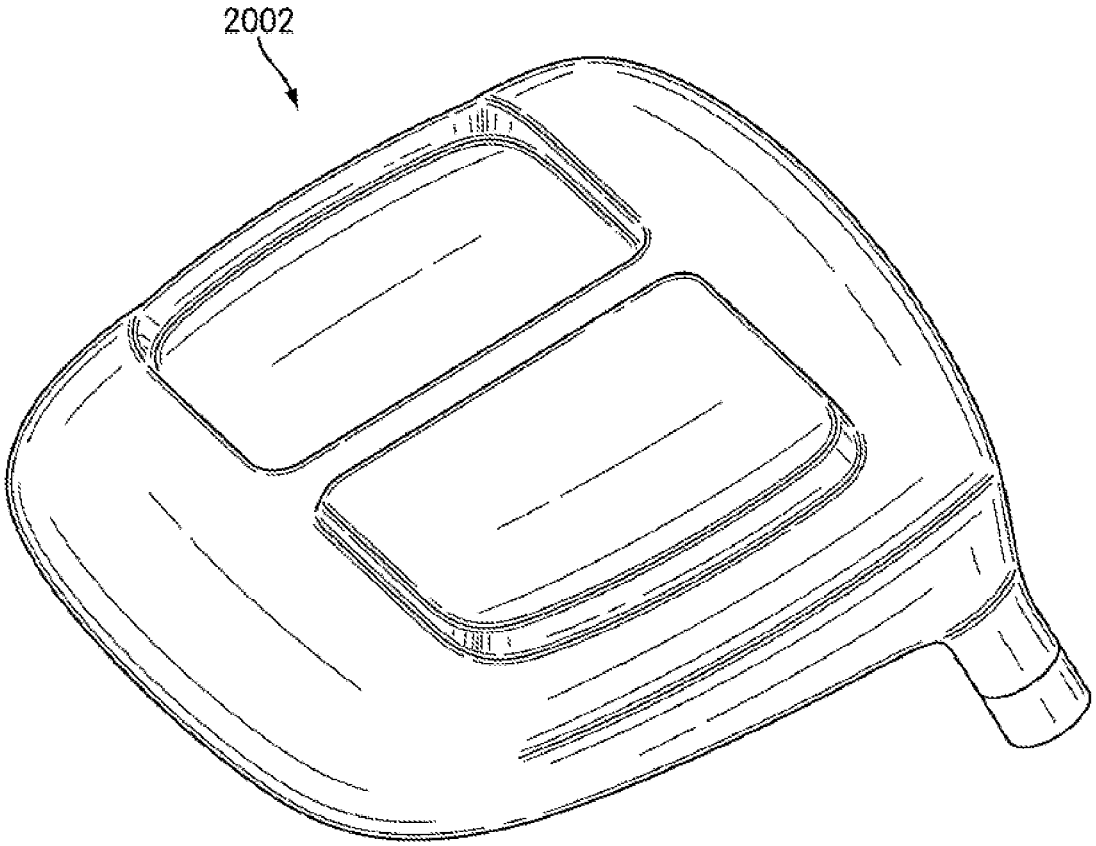
FIG. 20 generally illustrates another example golf club head structure in accordance with this disclosure.

While many of the above embodiments have been described with reference to a conventional shaped golf club head body, as mentioned above, this is merely one embodiment and other golf club head bodies within the scope of this disclosure could be shaped differently. For example, FIG. 20 illustrates an embodiment of a bump sole structure in accordance with this disclosure wherein the club head body 2002 is a generally rectangular shape. Further, the dimensions and/or other characteristics of a golf club head body structure according to examples of this disclosure may vary significantly without departing from the disclosure. For example, any wood type club head may be provided including, for example: wood type hybrid clubs, fairway woods, drivers, etc. Advantageously, aspects of this invention can be practiced with driver type golf club head structures having dimensions at or near the present USGA limits (e.g., a club head heel-to-toe length of at least 4.5 inches, an overall club head front-to-back breadth of at least 4.5 inches, and an overall club head top-to-bottom depth of at least 1.5).

While some aspects of the disclosure are directed to wood-type golf club head bodies wherein the sole, crown and/or rear portions of the golf club head body are configured so as to position more mass and/or volume of the golf club head at a particular location (e.g., toward the heel side or the rear side), other aspects of the disclosure are directed to iron-type golf club head bodies wherein the rear portion of the golf club head body is configured to position more mass and/or volume of the golf club head at a particular location (e.g., toward the heel side). Further, as described above, at least some example aspects of this disclosure relate to golf club head structures wherein the mass and/or volume of the golf club head body are distributed so that configuration of the club head body includes a "bump" portion and "indented" portion. Therefore, according to particular embodiments of this disclosure, the bump or indented portions may be positioned on the rear portion of the iron-type golf club as opposed to a wood-type golf club head.

Figure 21:
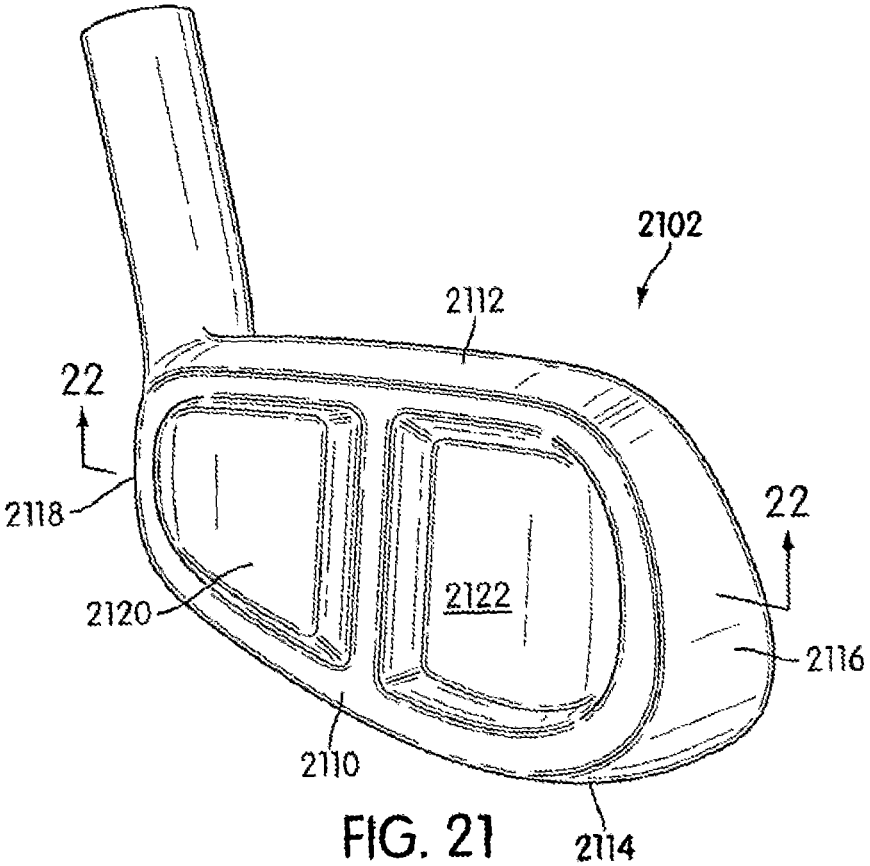
FIG. 21 generally illustrates another example golf club head structure in accordance with this disclosure.
Figure 22:
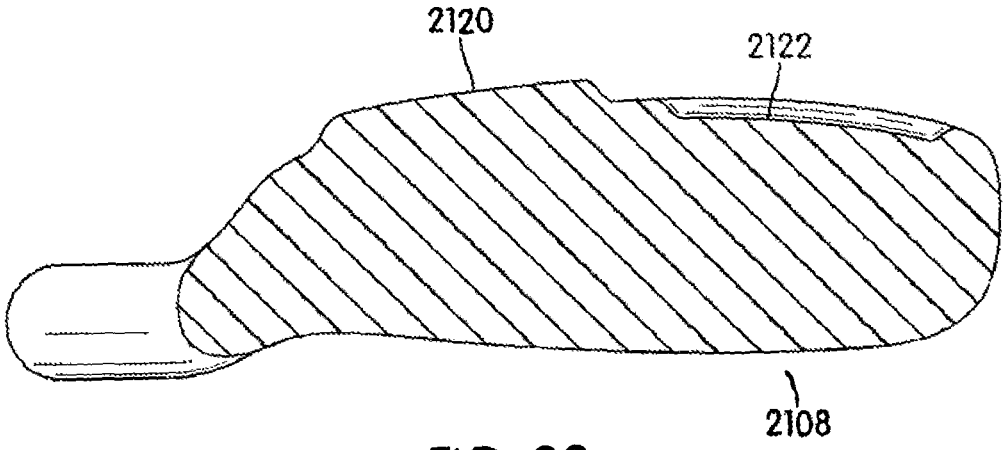
FIG. 22 is a cross sectional view of the golf club head structure taken along line 22-22 shown in FIG. 21.

FIGS. 21-22 generally illustrate an example of such an iron-type golf club head 2102 in accordance with this aspect of the disclosure. The club head body 2102 of this illustrated example includes a ball striking face portion 2108 on a front side thereof, a rear side 2110 opposite the front side, a crown (or top) portion 2112, a sole portion 2114, a toe side and toe edge 2116 and a heel side and heel edge 2118.

Further, as seen in FIG. 21, the golf club head body 2102 has its rear side 2110 configured so that it includes a "bump" portion 2120 and a "indented" portion 2122. The bump portion 2120 protrudes from the rear side 2110 while the indented portion 2122 recedes into the rear side 2110 and creates a recess in the rear side 2110 (e.g., which may correspond to a portion of a perimeter weighting structure and/or a cavity back structure of the golf club head). Hence, the bump portion 2120 creates a portion of the golf club with an exaggerated front to rear thickness (compared with a conventional golf club head and/or with a base thickness of the club head structure) while the indented portion 2122 of the club head body creates a portion of the golf club with a reduced front to rear thickness (compared with a conventional golf club head and/or with a base thickness of the club head structure). In other words, the thickness of the bump portion 2120 measured from the ball striking face portion 2108 to the rear side 2110 is greater than the thickness of the indented portion 2122 measured from the ball striking face portion 2108 to the rear side 2110 (at least when measured at horizontally even locations).

According to at least some embodiments of this disclosure, the bump portion 2120 may protrude from the base surface of the rear of the club head body by 1-30 mm. Similarly, the indented portion 2122 may recede into the rear side from the base surface by 1-30 mm. The bump portion may have an area of: at least 0.5 inches squared, at least 0.75 inches squared, at least 1.0 inches squared, at least 1.25 inches squared, at least 1.5 squared, or more. The indented portion may have an area of: at least 0.5 inches squared, at least 0.75 inches squared, at least 1.0 inches squared, at least 1.25 inches squared, at least 1.5 squared, or more.

The bump portion and the indented portion are configured so that a center of gravity of the club head body is nearer to one of the heel edge 2118 of the club head body or the toe edge 2116 of the club head body. For example, the bump portion 2120 may be nearer to the heel edge 2118 than the toe edge 2116 and the indented portion 2122 may be nearer to the toe edge 2116 than the heel edge 2118 so that a majority of the volume and/or a majority of the mass of the club head body is nearer to the heel edge 2118 than the toe edge 2116. This configuration shifts the center of gravity of the golf club head body 2102 nearer to the heel edge 2118 as compared with the toe edge 2116. As a result, this configuration of the golf club head body may provide a draw biased trajectory to a golf ball when it is struck by the golf club head.

The dimensions of the bump and indented portions, 2120, 2122, may affect the distance that the center of gravity is shifted. For example, the larger the dimensions of the bump and indented portions, 2120, 2122, the more the center of the gravity will be shifted. Conversely, the smaller the dimensions of the bump and indented portions, 2120, 2122, the less the center of the gravity will be shifted. Therefore, the location of the center of gravity can be customized to fit particular swing types or golfer's tendencies. For example, for a golfer with a severe slice, the bump portion 2120 and the indented portions 2120 may have large dimensions (e.g., area, thickness, etc.) relative to the rest of the club head body 2102. These larger bump and indented portions 2120, 2122 will shift the center of gravity dramatically and, therefore, compensate for the severity of the slice. Conversely, a golf club wherein the bump and indented portions 2120, 2122 have smaller dimensions would be more appropriate if the golfer's slice is only relatively minor and/or for relatively straight hitters that wish to promote a more drawing ball flight trajectory.

According to some embodiments of the disclosure, the volume of the recess of the indented portion 2122 may be substantially the same as, or equal to, the volume of the bump portion 2120. Therefore, the bump portion's depth/thickness can be exaggerated by the same amount of volume that the indented portion is recessed, while the overall volume of the club head body remains the same. For example, if the indented portion 2122 is recessed by a volume of X cubic centimeters, then the bump portion 2120 may be increased by a volume of X cubic centimeters and the overall volume of the golf club head will remain the same. However, it is noted that the bump and indented portions 2120, 2122 do not have to be enlarged or recessed by equal amounts. For example, the bump portion 2120 may be exaggerated by an amount more or less than the volume of the indented portion 2122.

According to some aspects of the disclosure, the "bump" and the "indented" portions may be distinct from each other. For example, in the depicted embodiment, the bump portion 2120 and the indented portion 2122 are separated from each other by a base surface of the rear side 2110 so that the bump portion and the indented portion are positioned a distance apart from each other. As shown in this illustrated example the bump and indented portions 2120 and 2122 are generally rectangularly shaped and separated from each other via a section of the rear side 2110. In particular embodiments, the bump and indented portions, 2120 and 2122, may be positioned at least 0.5-50 mm apart. In other embodiments the bump and indented portions, 2120 and 2122, could be positioned 55 mm or more apart so that they are located at the edges of the rear portion 2110 in order to further affect the center of gravity and bias the golf club head.

In some embodiments, the bump and indented portions 2120 and 2122 may be positioned directly opposite from each other as shown in FIG. 21. In other embodiments, they could be positioned offset from each other. In other words, one of the bump portion or the indented portion may be closer to the top portion while the other of the bump portion or the indented portion may be closer to the sole portion. Regardless of whether the bump and indented portions 2120 and 2122 are positioned directly opposite each other or offset from each other, they may be positioned at any point along the rear portion 2110 including at least partially on the top portion 2112 or the sole portion 2114 of the club head body 2102. Such positioning of the bump and indented portions, 2120, 2122 may further affect the trajectory of the golf ball when it is struck by the golf club 2102. Therefore, such positioning would allow the golf club to be configured and customized to match particular swing types and tendencies of golfers.

It is noted that the shape of the bump and indented portions also may affect the bias imparted to the golf ball when struck by the golf club. While the shape of the bump and indented portions 2120 and 2122 shown in the drawings is generally rectangular, such a shape is not required. Instead, any suitable shape such as circular, triangular, polygonal, helical, irregular, etc. would be appropriate. In fact, it is noted that the bump portion and the indented portions, 2120, 2122 do not have to be the same shape. For example, the shape of the bump and indented portion portions, 2120, 2122 may follow the line of the perimeter of the golf club, so that the bump and indented portions are placed at the periphery of the golf club head. For example, if the bump and indented portions 2120, 2122, extend around the perimeter of the top portion 2112 in a line, then the L-shaped or ring shape (depending on the shape of the club head body) of the bump and indented portions 2120, 2122, may be 5-10 mm wide and protrude from or recede into the rear side 2110 by 5-10 mm in order to provide a particular center of gravity configuration. These dimensions are merely illustrative and other dimensions may be more appropriate depending upon the center of gravity characteristics desired. Hence, it is seen that size, shape, and positioning of the bump and indented portions, 2120, 2122 can be used in combination with each other in order to create a particular golf club head that will help impart a particular trajectory to the golf ball.

According to one embodiment of this disclosure, the thickness between the bump and the indented portion, 2120, 2122 has only a slight change. For example, the thickness of the bump portion 2120 may be between 1-30 mm while the thickness of the second portion may be between 0.025-29 mm. As some additional examples, the thickness of the bump portion 2120 may be between 0.05-10 mm, 0.5-9 mm; 0.8-5 mm; or 1-2 mm while the thickness of the indented portion may be between 0.025-9 mm; 0.05-8 mm, 0.75-4 mm or 0.5-1.5 mm. In an alternative embodiment, the thickness of the bump portion 2120 may be greater than the thickness of the indented portion 2122. This difference in the thicknesses of the respective regions allows even more mass to be concentrated near the heel end portion 2118 of the golf club head 2102.

Further, according to at least some aspects of the disclosure, the bump portion 2120 may be made of the same material as the rest of the golf club head body 2102. In such embodiments, the golf club head body would be formed in a conventional manner as described above. In other embodiments the bump portion 2120 may be made from and/or include a higher density material compared to the other portions of the golf club head body 2102. For example, the bump portion 2120 may be integral with the golf club head body and constructed of a higher density material. As additional examples, different materials such as composites, polymers or various metals can be used to make the bump portion 2120 while the remainder of the golf club head body 2102 can be made of a different composite, polymer or other metal materials (e.g., lighter materials). As another example, if desired, the bump portion 2120 and/or the indented portion 2122 may be made from one or more inserts that are secured into the rear cavity of a perimeter weighted cavity back club head.

Alternatively, the bump portion 2120 may be filled with or produced to contain a higher density material. For example, according to some aspects of the disclosure, the bump portion 2120 may be formed with a distinct cavity that may be filled with the higher density material (e.g., as illustrated in FIG. 16C described above. In such an embodiment the bump portion surrounding the cavity may be made from the same material as the remainder of the golf club or alternatively it may be formed from a different material. If desired, the higher density material may be accessible from the exterior of the club head body to allow easier access, removal, exchange, etc.

According to some embodiments, the higher density material that fills the cavity in the bump portion may be removable. For example, a higher density material, such as a weight, may be snap fit or otherwise attached to the bump portion. In such an arrangement, various weights could be used to produce different biases in the golf club. Therefore, as the slice is corrected, the different weights could be replaced to account for the corrected swing. In other words, lighter weights could be used if the slice decreased over time.

Figure 23:
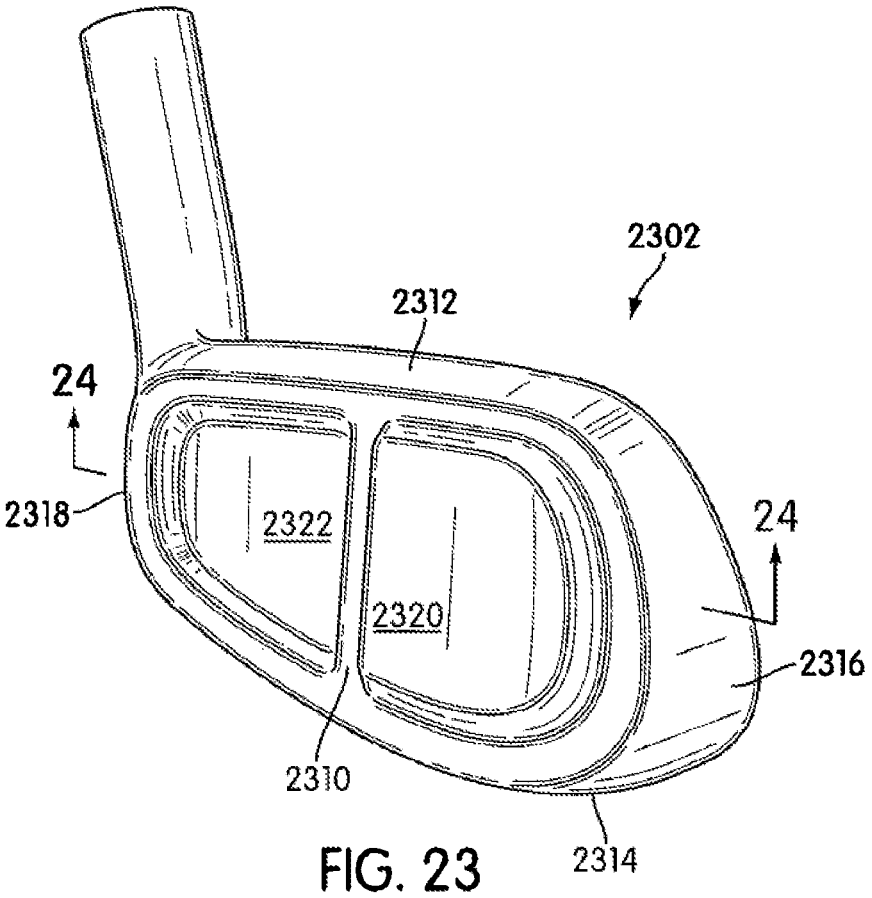
FIG. 23 generally illustrates another example golf club head structure in accordance with this disclosure.
Figure 24:
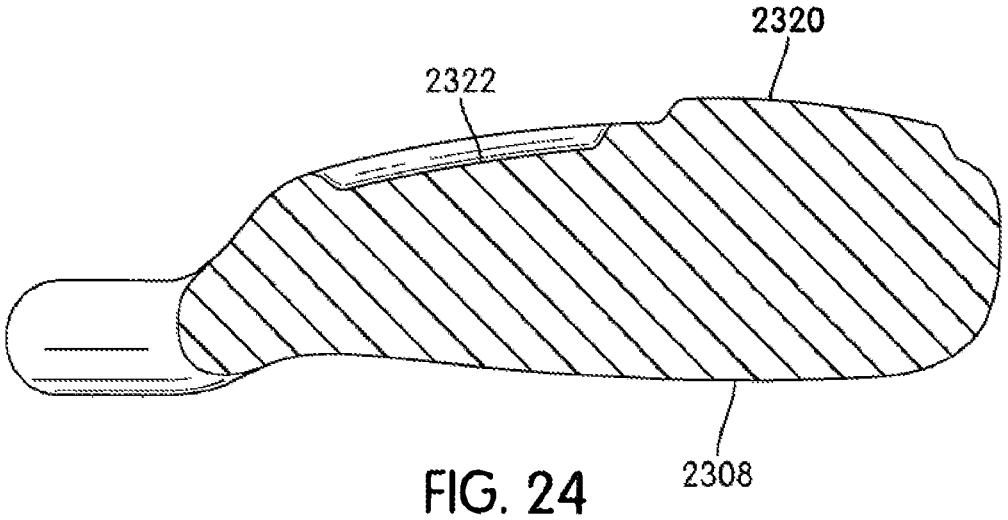
FIG. 24 is a cross sectional view of the golf club head structure taken along line 24-24 shown in FIG. 23.

While some aspects of the present disclosure are directed to golf club head bodies that position more mass and/or volume of the golf club head toward the heel side as compared with the toe side, other aspects of the disclosure are directed to golf club head bodies that position more mass and/or volume of the golf club head toward the toe side as compared with the heel side. Such a configuration shifts the center of gravity of the golf club head body closer to the toe side as compared with the heel side. As a result, this configuration of the golf club head body can provide a fade biased trajectory to a golf ball when it is struck by the golf club head. Therefore, according to at least some aspects of this disclosure, a golf club head body has a "bump" portion that extends or protrudes from the golf club head body at a toe side thereof, and an "indented" portion that recedes into the golf club head body at a heel side thereof. FIGS. 23-24 generally illustrate an example of such an iron-type golf club head 2302 in accordance with the disclosure.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For example, it is noted that according to some aspects of this disclosure, the bump portion in both the iron and wood type club heads does not have to be exaggerated much at all. Instead, the bump portion can be merely exaggerated by a slight amount beyond a conventional depth/thickness and the indented portion can be recessed similarly. Further, it is noted that according to some aspects of this invention, the bump portion does not have to be present at all. Instead, the golf club head body may have only an indented portion that is recessed by a particular amount. This configuration will still help create a biased trajectory for a golf ball struck by the golf club head, because the indented portion will still help ensure that more of the mass and/or volume of the golf club head is distributed toward the portion opposite the indented portion.

Similarly, according to some aspects of this invention, the club head body may be configured without an indented portion. Instead the golf club may have only a bump portion that protrudes by a particular amount. This configuration will still create a biased trajectory for a golf ball struck by the golf club head, because the bump portion will still ensure that more of the mass and/or volume of the golf club head to be distributed toward the bump portion.

Also, it is noted that the above features (e.g., the bump and indented portions) could be disposed internally within the golf club head body so that the exterior of the golf club head (e.g., the sole portion) would remain conventional, but the golf club head body could still provide the above described weighting characteristics. For example, the exterior wall of the club head body would remain a conventional shape, but the interior portion of the wall could include the bump portion to adjust the mass of the golf club head body and, thereby, position the weight and center of gravity of the golf club head body in a desired location.

Additionally, the various features and concepts described above in conjunction with FIGS. 1A through 24 may be used individually and/or in any combination or subcombination without departing from this disclosure.

We claim:

1. A golf club head comprising:

an iron-type golf club head body comprising a ball striking face portion at a front side thereof, a rear side opposite the front side, a crown portion, a sole portion, a toe side, and a heel side;

wherein the rear side of the iron-type golf club head body is configured so that the iron-type golf club head body includes:

a single bump that protrudes from the rear side;

a single indented portion that recedes into the rear side and creates a recess in the rear side;

further wherein the bump and the indented portion are configured so that a center of gravity of the iron-type golf club head body is nearer to the toe side of the iron-type golf club head body, and so that a majority of a volume and a majority of a mass of the iron-type golf club head body is located nearer the toe side;

wherein the bump and the indented portion follow a perimeter line of the iron-type golf club head body such that the bump and the indented portion are positioned at a periphery of the iron-type golf club head body;

wherein the bump and the indented portion are positioned directly opposite from one another; and wherein the bump and the indented portion are separated from each other by a base surface of the rear side so that the bump and the indented portion are positioned a distance apart from each other.

2. The golf club head according to claim 1, wherein the iron-type golf club head body is made of at least partially a composite material.

3. The golf club head according to claim 1, wherein the bump comprises a front to rear thickness;

the indented portion comprises a front to rear thickness; and wherein the bump front to rear thickness is greater than the indented portion front to rear thickness.

4. The golf club head according to claim 1, wherein the bump protrudes from the rear side of the iron-type golf club head body by 1-30 mm.

5. The golf club head according to claim 1, wherein the indented portion recedes into the rear side of the club head body 1-30 mm.

6. The golf club head according to claim 1, wherein the bump comprises an area of at least 0.5 $in^2$, and the indented portion comprises an area of at least 0.5 $in^2$.

7. The golf club head according to claim 1, wherein the iron-type golf club head body is made of a composite material.

8. The golf club head according to claim 1, wherein a volume of the recess of the indented portion is equal to a volume of the bump.

9. The golf club head according to claim 1, wherein the iron-type golf club head body comprises a metal material;

the bump and the indented portion comprise a composite material.

10. The golf club head according to claim 1, wherein the bump and the indented portion are positioned at least 0.50 mm apart.

11. The golf club head according to claim 1, wherein one of the bump or the indented portion is closer to the toe side while the other of the bump or the indented portion is closer to the heel side.

12. The golf club head according to claim 1, wherein the bump or the indented portion is polygonal.

13. The golf club head according to claim 1, wherein the bump and the indented portion are integral with the iron-type golf club head body.

* * * * *